US011408198B2

(12) United States Patent
Cheng

(10) Patent No.: US 11,408,198 B2
(45) Date of Patent: Aug. 9, 2022

(54) ELECTRIFIED MORTISE LOCK FOR SLIDING DOOR

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 188 days.

(21) Appl. No.: 16/999,212

(22) Filed: Aug. 21, 2020

(65) Prior Publication Data

US 2021/0054655 A1 Feb. 25, 2021

Related U.S. Application Data

(60) Provisional application No. 62/889,710, filed on Aug. 21, 2019.

(51) Int. Cl.

| | |
|---|---|
| ***E05B 17/20*** | (2006.01) |
| ***E05B 65/08*** | (2006.01) |
| ***E05B 63/08*** | (2006.01) |
| ***E05B 9/00*** | (2006.01) |
| ***E05B 9/02*** | (2006.01) |
| ***E05B 63/12*** | (2006.01) |
| *E05B 47/00* | (2006.01) |

(Continued)

(52) U.S. Cl.

CPC ..... *E05B 17/2026* (2013.01); *E05B 9/002* (2013.01); *E05B 9/02* (2013.01); *E05B 17/2003* (2013.01); *E05B 17/2007* (2013.01); *E05B 17/2088* (2013.01); *E05B 63/08* (2013.01); *E05B 63/12* (2013.01); *E05B 63/127* (2013.01); *E05B 65/087* (2013.01); *E05B 15/04* (2013.01); *E05B 47/0002* (2013.01); *E05B 47/0012* (2013.01); *E05B 47/0607* (2013.01); *E05B 2047/0069* (2013.01); *E05Y 2900/132* (2013.01)

(58) Field of Classification Search

CPC .. E05B 47/0012; E05B 63/08; E05B 47/0673; E05B 47/0002; E05B 9/002; E05B 9/02; E05B 17/2007; E05B 47/0607; E05B 63/12; E05B 65/087; E05B 2047/0069; E05Y 2900/132

See application file for complete search history.

(56) References Cited

U.S. PATENT DOCUMENTS 315,186 A * 4/1885 Thaxter ..... E05B 47/0002 292/144
1,242,085 A * 10/1917 Voight ..... E05B 63/14 70/120

(Continued)

*Primary Examiner* — Mark A Williams
(74) *Attorney, Agent, or Firm* — Craig A. Simmermon

(57) ABSTRACT

Electrified mortise lock for sliding door is a mortise lock for a sliding door. Electrified mortise lock for sliding door is electrified wherein an electric motor is used to latch and unlatch the mortise lock and lock and unlock the mortise lock. Electrified mortise lock for sliding door includes multiple types of door locks including sliding door locks that meet the ANSI and BHMA standards for a privacy, entry, office, and classroom door lock. Electrified mortise lock for sliding door mounts within a mortise pocket of a sliding door. Electrified mortise lock for sliding door can automatically latch when the sliding door in closed and automatically unlatch when the sliding door is opened. Electrified mortise lock for sliding door can also automatically lock when the sliding door in closed and automatically unlock when the sliding door is opened. Electrified mortise lock for sliding door receives power from a power unit located: in the upper door jamb or in the strike plate in the door jamb.

6 Claims, 26 Drawing Sheets

(51) Int. Cl.
*E05B 47/06* (2006.01)
*E05B 15/04* (2006.01)

(56) References Cited

U.S. PATENT DOCUMENTS 3,890,608 A * 6/1975 Peterson ..... E05B 45/06
340/545.7
5,228,730 A * 7/1993 Gokcebay ..... E05B 47/0002
292/144
5,474,348 A * 12/1995 Palmer ..... E05B 47/0669
292/144
2008/0211239 A1* 9/2008 Keller ..... E05B 47/0607
292/164
2011/0203331 A1* 8/2011 Picard ..... E05B 17/22
29/829
2013/0277988 A1* 10/2013 Ji ..... E05B 59/00
292/33
2014/0033773 A1* 2/2014 Myers ..... E05B 17/0004
292/144
2014/0175807 A1* 6/2014 Lambrou ..... E05B 63/0065
292/92
2015/0176311 A1* 6/2015 Picard ..... G08B 15/005
292/143
2015/0184425 A1* 7/2015 Ellis ..... E05B 47/0673
292/144
2016/0017638 A1* 1/2016 Dore Vasudevan .... E05B 55/12
292/137
2016/0060904 A1* 3/2016 Dore Vasudevan .....
E05B 47/0673
292/144
2016/0145904 A1* 5/2016 Lowder ..... E05B 47/0001
292/145
2018/0340352 A1* 11/2018 Compton ..... E05B 55/00
2019/0085596 A1* 3/2019 Walsh ..... E05B 47/0001

* cited by examiner

ELECTRIFIED MORTISE LOCK FOR SLIDING DOOR

CROSS-REFERENCE TO RELATED APPLICATIONS

The instant application claims the benefit of Provisional Application Ser. No. 62/889,710 entitled "SLIDING/POCKET DOOR LOCK WITH ADVANCED FEATURES" filed on Aug. 21, 2019, which is hereby incorporated by reference herein.

DESCRIPTION

Background of the Invention

1. Field of the Invention

This invention relates to a mortise lock or a mortise lockset for a sliding door. A mortise lockset is a lockset for a door that requires a pocket or a mortise to be cut into the edge of the door wherein a mortise lock is installed. A mortise lock set may be installed into a hinged door or a sliding door. Specifically, this invention relates to a mortise lock that is installed into a sliding door. The mortise lock of this invention is special because it has an electromechanical mechanism that automatically latches and unlatches the mortise lock and automatically locks and unlocks the mortise lock.

2. Description of Related Art

There are many mortise locksets in the prior art however there are none for a sliding door with an electromechanical mechanism that latches and unlatches and locks and unlocks the mortise lock as shown and described below. Electrified mortise lock for sliding door is the first mortise lock for a sliding door with an electromechanical mechanism that meets the ANSI and BHMA standards for a privacy, entry, office, and classroom door lock.

BRIEF SUMMARY OF THE INVENTION

Electrified mortise lock for sliding door is a sliding door lock mechanism that is fully contained within a rectangular cuboid shaped casing or housing.

Electrified mortise lock for sliding door is a system with interchangeable components to yield multiple types of door locks.

Electrified mortise lock for sliding door can be configured to meet the ANSI and BHMA standards for a privacy, entry, office, and classroom door lock for a sliding door.

Electrified mortise lock for sliding door mounts within a mortise pocket of a sliding door and engages with an inside door knob or lever on the inside of a room.

Electrified mortise lock for sliding door mounts within a mortise pocket of a sliding door and engages with an electric motor located contained within electrified mortise lock for sliding door.

The electric motor operates to electrically extend and retract a deadbolt for a sliding door.

It is an aspect of electrified mortise lock for sliding door to have a mechanism that automatically electrically latches the sliding door when the sliding door is closed.

It is an aspect of electrified mortise lock for sliding door to have a mechanism that automatically mechanically unlatches the sliding door when the inside door knob or door lever is turned.

It is an aspect of electrified mortise lock for sliding door to have a mechanism that automatically electrically unlatches the sliding door when electrified mortise lock for sliding door is electrically signaled to do so.

It is an aspect of electrified mortise lock for sliding door to have a mechanism that keeps the sliding door latched when the outside door knob or door lever is turned.

It is an aspect of electrified mortise lock for sliding door to have a mechanism that automatically locks the sliding door when the sliding door is closed.

It is an aspect of electrified mortise lock for sliding door to have a mechanism that automatically unlocks the sliding door when the inside door knob or door lever is turned.

It is an aspect of electrified mortise lock for sliding door to have a mechanism that keeps the sliding door locked when the outside door knob or door lever is turned.

It is an aspect of electrified mortise lock for sliding door to have a deadbolt that extends to latch and/or lock the sliding door and retracts to unlatch and/or unlock the sliding door.

It is an aspect of electrified mortise lock for sliding door to have a deadbolt with an upper deadbolt wing and a lower deadbolt wing wherein both extend or protrude from deadbolt to latch and/or lock the sliding door and both retract into deadbolt to unlatch and/or unlock the sliding door.

It is an aspect of electrified mortise lock for sliding door to connect with an exterior control unit that sends signals to electrified mortise lock for sliding door.

It is an aspect of electrified mortise lock for sliding door to connect with an electronic user interface such as an electrical switch, a keyboard, a pin pad, a fingerprint scanner, a retinal scanner, or any other known type of user interface, which is used to signal electrified mortise lock for sliding door to latch or unlatch and lock or unlock.

It is an aspect of electrified mortise lock for sliding door to have circuit board with electronic components.

It is an aspect of electrified mortise lock for sliding door to have an electric motor that is connected to the circuit board with electronic components.

It is an aspect of circuit board with electronic components to control the electric motor and interface with the external control unit.

DEFINITION LIST

Figure 1:
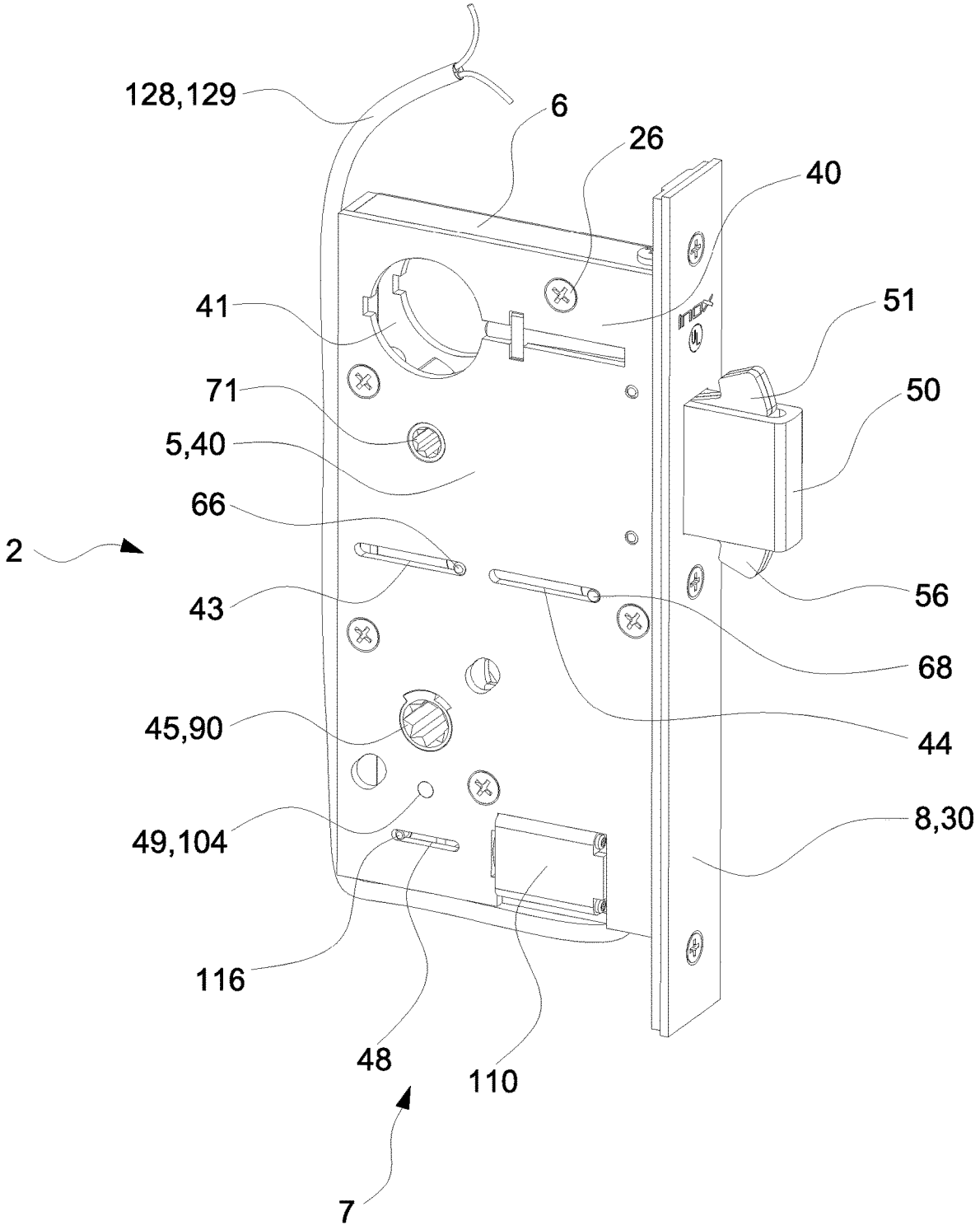
FIG. 1 is a front perspective view of electrified mortise lock for sliding door.

| Term | Definition |
|---|---|
| 2 | Electrified Mortise Lock for Sliding Door |
| 4 | First Side of Mortise Lock |
| 5 | Second Side of Mortise Lock |
| 6 | Upper Side of Mortise Lock |
| 7 | Lower Side of Mortise Lock |
| 8 | Opening Side of Mortise Lock |
| 9 | Retracting Side of Mortise Lock |
| 10 | Mortise Housing Base |
| 11 | Lock Cylinder Mounting Hole |
| 12 | Upper Deadbolt Mounting Pin |
| 13 | Lower Deadbolt Mounting Pin |
| 14 | Y-Turn Hub Mounting Hole on Mortise Housing Base |
| 15 | Deadbolt Shaft Slot Track |
| 16 | Lever Hub Mounting Hole on Mortise Housing Base |
| 17 | Key Notch on Lever Hub Mounting Hole |
| 18 | Electric Motor Mounting Hole on Mortise Housing Base |
| 19 | Screw Bracket Slot Track on Mortise Housing Base |
| 20 | Support Pillar |
| 21 | Circuit Board Mounting Pillar |

-continued

| Term | Definition |
|---|---|
| 22 | Pin Mounting Hole in Mortise Housing Cover Plate |
| 24 | Screw Hole in Mortise Housing Cover Plate |
| 26 | Mortise Housing Screw |
| 30 | Mortise Housing Face Plate |
| 32 | Deadbolt Clearance Hole in Mortise Housing Face Plate |
| 34 | Power Transfer Unit Clearance Hole in Mortise Housing Face Plate |
| 36 | Upper Tab Flange |
| 38 | Lower Tab Flange |
| 39 | Female Threaded or Tapped Hole |
| 40 | Mortise Housing Cover Plate |
| 41 | Lock Cylinder Mounting Hole on Mortise Housing Cover Plate |
| 42 | Y-Turn Hub Mounting Hole on Mortise Housing Cover Plate |
| 43 | Retracting Side Deadbolt Shaft Slot Track on Mortise Housing Cover Plate |
| 44 | Opening Side Deadbolt Shaft Slot Track on Mortise Housing Cover Plate |
| 45 | Lever Hub Mounting Hole on Mortise Housing Cover Plate |
| 46 | Key Notch on Lever Hub Mounting Hole |
| 47 | Electric motor Mounting Hole on Mortise Housing Cover Plate |
| 48 | Screw Bracket Slot Track on Mortise Housing Cover Plate |
| 49 | Screw Lever Pivot Pin Mounting Hole |
| 50 | Deadbolt |
| 51 | Upper Deadbolt Wing |
| 52 | Upper Deadbolt Wing Pivot Pin |
| 53 | Upper Deadbolt Wing Latch Protrusion |
| 54 | Upper Deadbolt Wing Heel Protrusion |
| 55 | Deadbolt Wing Spring |
| 56 | Lower Deadbolt Wing |
| 57 | Lower Deadbolt Wing Pivot Pin |
| 58 | Lower Deadbolt Wing Latch Protrusion |
| 59 | Lower Deadbolt Wing Heel Protrusion |
| 60 | Deadbolt Shaft |
| 62 | Deadbolt Attachment Arm on Deadbolt Shaft |
| 63 | Deadbolt Attachment Pin on Deadbolt Shaft |
| 64 | Pendulum Arm Pocket in Deadbolt Shaft |
| 65 | Pin Hole on Deadbolt Shaft |
| 66 | Retracting Side Slide Pin on Deadbolt Shaft |
| 68 | Opening Side Slide Pin on Deadbolt Shaft |
| 69 | Deadbolt Position Indicator |
| 70 | Y-Turn Hub |
| 71 | Socket on Y-Turn Hub |
| 72 | First Arm on Y-Turn Hub |
| 74 | Second Arm on Y-Turn Hub |
| 76 | Pendulum Arm on Y-Turn Hub |
| 78 | Head on Pendulum Arm |
| 79 | Pendulum Arm Pin |
| 80 | Bolt Retraction Lever |
| 82 | Pivot Hole on Bolt Retraction Lever |
| 84 | Upper Arm on Bolt Retraction Lever |
| 86 | Pendulum Arm Pin Slot Track on Bolt Retraction Lever |
| 88 | Lower Arm on Bolt Retraction Lever |
| 89 | Screw Bracket Pin Slot Track on Bolt Retraction Lever |
| 90 | Lever Hub |
| 92 | Socket on Lever Hub |
| 94 | First Key Tab on Lever Hub |
| 96 | Second Key Tab on Lever Hub |
| 98 | First Ridge on Lever Hub |
| 99 | Second Ridge on Lever Hub |
| 100 | Screw Lever |
| 102 | Upper End of Screw Lever |
| 104 | Pivot Pin on Screw Lever |
| 106 | Lower End of Screw Lever |
| 108 | Screw Bracket Pin Slot Track on Screw Lever |
| 110 | Electric Motor |
| 112 | Screw on Electric Motor |
| 114 | Screw Bracket |
| 116 | Screw Bracket Pin |
| 118 | Power Wires on Electric Motor |
| 120 | Mortise Lock Circuit Board |
| 122 | Microprocessor, Integrated Circuit, or Chip on MLCB |
| 124 | Deadbolt Retracted Sensor |
| 126 | Deadbolt Extended Sensor |
| 128 | Positive Power Wire for Mortise Lock Circuit Board |
| 129 | Negative Power Wire for Mortise Lock Circuit Board |
| 130 | Power Transfer Unit |
| 132 | Base on Power Transfer Unit |
| 134 | Positive Power Contact on Power Transfer Unit |

-continued

| Term | Definition |
|---|---|
| 136 | Negative Power Contact on Power Transfer Unit |
| 138 | Magnet on Power Transfer Unit |
| 140 | Power Unit |
| 142 | Base on Power Unit |
| 144 | Positive Power Contact on Power Unit |
| 145 | Positive Power Wire on Power Unit |
| 146 | Negative Power Contact on Power Unit |
| 147 | Negative Power Wire on Power Unit |
| 148 | Magnetic Sensor on Power Unit |
| 150 | Power Unit Circuit Board |
| 152 | Microprocessor, Integrated Circuit, or Chip on PUCB |
| 154 | Positive Power Wire for Mortise Lock Circuit Board |
| 156 | Negative Power Wire for Mortise Lock Circuit Board |
| 160 | Magnet on Deadbolt |
| 162 | Deadbolt Magnetic Sensor |
| 170 | Deadbolt Monitoring Switch |
| 172 | Positive Power Wire for Deadbolt Monitoring Switch |
| 174 | Negative Power Wire for Deadbolt Monitoring Switch |
| 176 | Positive Power Contact for Deadbolt Monitoring Switch on Power Transfer Unit |
| 178 | Negative Power Contact for Deadbolt Monitoring Switch on Power Transfer Unit |
| 180 | Lever Hub Monitoring Switch |
| 182 | Positive Power Wire for Lever Hub Monitoring Switch |
| 184 | Negative Power Wire for Lever Hub Monitoring Switch |
| 186 | Positive Power Contact for Lever Hub Monitoring Switch on Power Transfer Unit |
| 188 | Negative Power Contact for Lever Hub Monitoring Switch on Power Transfer Unit |
| 190 | Positive Power Contact for Deadbolt Monitoring Switch on Power Unit |
| 192 | Negative Power Contact for Deadbolt Monitoring Switch and Lever Hub Monitoring Switch on Power Unit |
| 194 | Positive Power Contact for Lever Hub Monitoring Switch on Power Unit |
| 196 | Negative Power Contact for Lever Hub Monitoring Switch on Power Unit |

DETAILED DESCRIPTION OF THE INVENTION

Electrified mortise lock for sliding door 2 is a component of or a portion of a mortise lockset. A mortise lockset is a lockset for a door that requires a pocket or mortise to be cut into the edge of the door wherein a mortise lock is installed. A mortise lock set may be installed in a hinged door or a sliding door. A mortise lockset comprises: a mortise lock; a face plate (not depicted); a spindle (not depicted); two knobs (not depicted) or two levers (not depicted); and a strike plate (not depicted). All components of a mortise lockset are usually sold together as a set or kit. The mortise lock, spindle, two knobs or two levers, and face plate are installed into the door (not depicted). The strike plate is installed in the door jamb (not depicted) or wall (not depicted).

Electrified mortise lock for sliding door 2 is a mortise lock that is installed into a sliding door (not depicted). Electrified mortise lock for sliding door 2 is a complicated electromechanical device. Electrified mortise lock for sliding door 2 is a complicated series of mechanical actions encased within a rigid rectangular cuboid shaped case or housing that is installed within the pocket or mortise of a sliding door. A sliding door is any type of door that slides left or right to open and close rather than pivot or rotate to open or close. A sliding door could be a barn door, patio door, French door, pocket door, or any other type of sliding door.

Electrified mortise lock for sliding door 2 is special because it automatically electrically latches or extends a deadbolt 50 when the sliding door is closed and automatically electrically unlatches or retracts deadbolt 50 when electrically signaled to do so. Electrified mortise lock for sliding door 2 also automatically unlatches or retracts deadbolt 50 when the interior door knob or door lever is turned. The exterior door knob or door lever does not unlatch or retract deadbolt 50. Hence, electrified mortise lock for sliding door 2 has an automatic electrical latching and unlatching mechanisms along with an automatic electrical locking and unlocking mechanism.

A sliding door has a width, a length, and a thickness. A sliding door has a vertical axis running parallel to its length dimension and a horizontal axis running parallel to its width dimension. A sliding door has an inward side, an outward side, an upper side, a lower side, an opening side, and a retracting side. The inward side of the sliding door is the large vertical side or panel side of the sliding door that is adjacent to the interior of the room. The outward side of the sliding door is the large vertical side or panel side of the sliding door that is adjacent to the exterior of the room. The upper side of the sliding door is the horizontal side or edge of the door that is most proximate to the ceiling of the room. The lower side of the sliding door is the horizontal side or edge of the door that is most proximate to the floor of the building. The opening side of the sliding door is the vertical side or edge of the door that parts or slides open to allow passage through the doorway and slides closed to disallow passage through the doorway. The retracting side of the sliding door is the vertical side or edge of the door that is opposite from the opening side of the sliding door. A sliding door may be installed so that it slides open in the left direction or slides open to in right direction.

Figure 2:
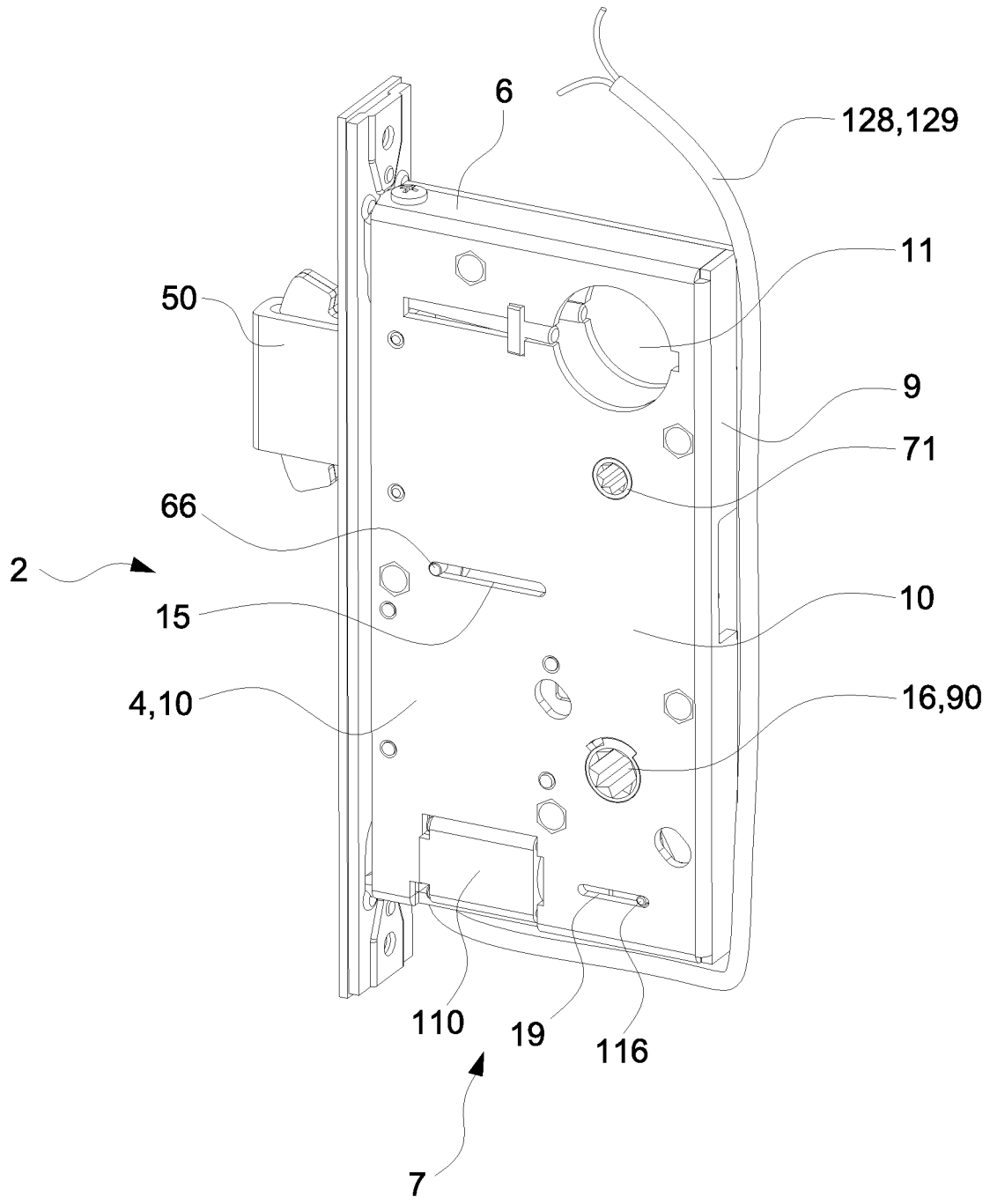
FIG. 2 is a rear perspective view of electrified mortise lock for sliding door.
Figure 3:
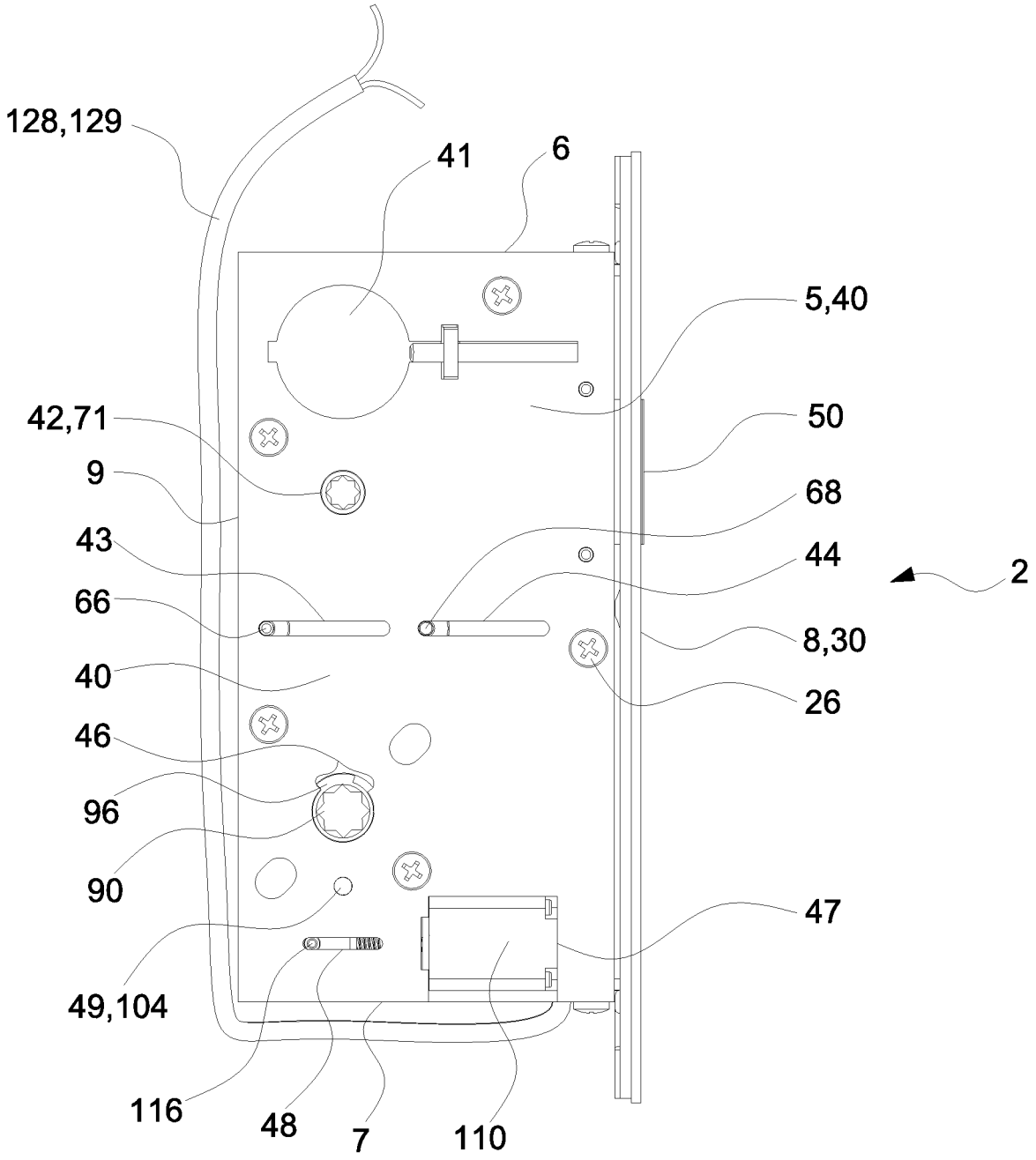
FIG. 3 is a side elevation view of the second side of electrified mortise lock for sliding door.
Figure 4:
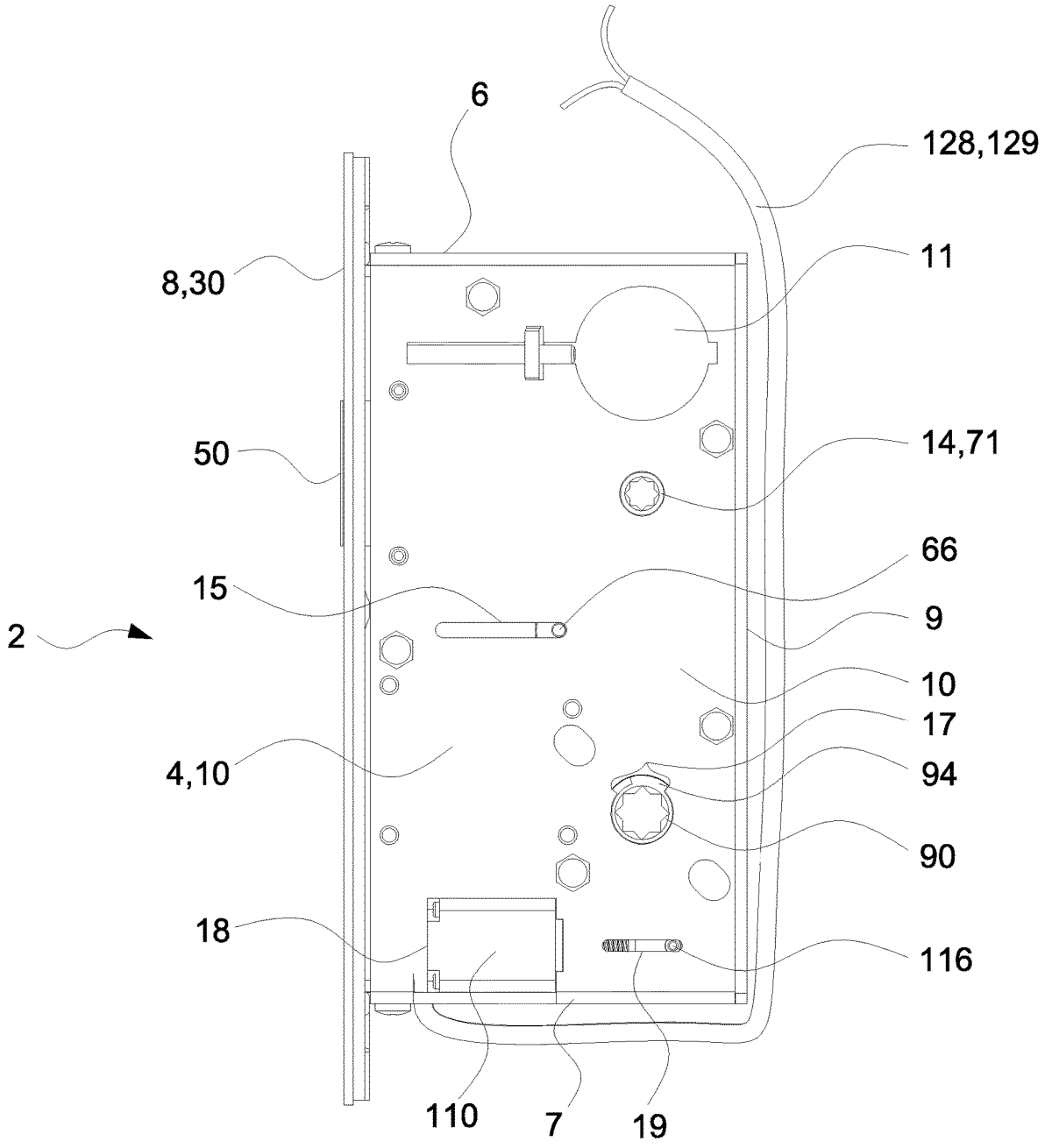
FIG. 4 is a side elevation view of the first side of electrified mortise lock for sliding door.

Mortise housing base 10, mortise housing face plate 30, and mortise housing cover plate 40 are attached together, as discussed below, to form a rigid hollow box shaped member or a rectangular cuboid shaped case or housing that encases and holds all other components of electrified mortise lock for sliding door 2, as depicted in FIGS. 1 and 2. The rigid hollow box shaped member or rectangular cuboid shaped case or housing has a width, a length, and a thickness. The rigid hollow box shaped member or rectangular cuboid shaped case or housing has a vertical axis running parallel to its length dimension and a horizontal axis running parallel to its width dimension. The rigid hollow box shaped member or rectangular cuboid shaped case or housing is installed within a pocket or mortise cut into opening side of the sliding door. The rigid hollow box shaped member or rectangular cuboid shaped case or housing is installed with its vertical axis running vertically and parallel with the vertical axis of the sliding door and its horizontal axis running horizontally and parallel with the horizontal axis of the sliding door. The rigid hollow box shaped member or rectangular cuboid shaped case or housing contains a complicated assembly of various mechanical actions that control the mortise lockset and allow the mortise lockset to function. The complicated assembly of mechanical actions causes the deadbolt 50 to protrude and retract from mortise housing base 10 at various times during operation of the mortise lockset.

The rigid hollow box shaped member or rectangular cuboid shaped case or housing has a first side 4, a second side 5, an upper side 6, a lower side 7, an opening side 8, and a retracting side 9. First side 4 and second side 5 are the two large vertical sides of electrified mortise lock for sliding door 2 that are parallel with the inward side and the outward side of the sliding door. Electrified mortise lock for sliding door 2 may be installed with its first side 4 adjacent to the inward side or the outward side of the sliding door. As discussed below, this allows for a single embodiment of electrified mortise lock for sliding door 2 to be installed in either a "left opening" sliding door or a "right opening" sliding door. The upper side 6 is the horizontal side of electrified mortise lock for sliding door 2 that is most proximate to the ceiling of the room with electrified mortise lock for sliding door 2 installed in the sliding door. The lower side 7 is the horizontal side of electrified mortise lock for sliding door 2 that is most proximate to the floor of the room with electrified mortise lock for sliding door 2 installed in the sliding door. The opening side 8 is the vertical side of electrified mortise lock for sliding door 2 that aligns with or is flush with the opening side of the sliding door with electrified mortise lock for sliding door 2 installed in the sliding door. As discussed below, opening side 8 of electrified mortise lock for sliding door 2 butts up against or contacts the door jamb or wall when the sliding door is closed and deadbolt 50 protrude and retract from opening side 8. The retracting side 9 is the vertical side of electrified mortise lock for sliding door 2 that is opposite from the opening side 8 and deepest in the pocket or mortise of the sliding door into which the electrified mortise lock for sliding door 2 is installed. This convention or system of naming sides and edges is carried on throughout this application.

Electrified mortise lock for sliding door 2 comprises: a mortise housing base 10; a mortise housing face plate 30; a mortise housing cover plate 40; a plurality of mortise housing screws 26; a deadbolt 50; a deadbolt shaft 60; a Y-turn hub 70; a bolt retraction lever 80; a lever hub 90; a screw lever 100; an electric motor 110; and a mortise lock circuit board 120.

Mortise housing base 10 comprises: a first side, an upper side, a lower side, and a retracting side. Mortise housing base 10 is rigid hollow four-sided rectangular cuboid or box-shaped member with two missing sides. First side of mortise housing base 10 is the first side 4 of electrified mortise lock for sliding door 2. First side of mortise housing base 10 is a rigid rectangular planar member with a length, a width, an inside surface, an outside surface, an upper edge, a lower edge, an opening edge, and a retracting edge. The width of first side of mortise housing base 10 is about 2-6 inches. The length of first side of mortise housing base 10 is about 4-8 inches. Upper side of mortise housing base 10 is the upper side 6 of electrified mortise lock for sliding door 2. Upper side of mortise housing base 10 is a rigid rectangular planar member with a length, a width, an inside surface, an outside surface, a first edge, a second edge, an opening edge, and a retracting edge. The width of upper side of mortise housing base 10 is about 0.25 to 2.5 inches. The length of upper side is equal to the width of first side. Lower side of mortise housing base 10 is the lower side 7 of electrified mortise lock for sliding door 2. Lower side of mortise housing base 10 is a rigid rectangular planar member with a length, a width, an inside surface, an outside surface, a first edge, a second edge, an opening edge, and a retracting edge. The width of lower side of mortise housing base 10 is about 0.25 to 2.5 inches and equal to that of the upper side. The length of lower side is equal to the width of first side. Retracting side of mortise housing base 10 is the retracting side 9 of electrified mortise lock for sliding door 2. Retracting side of mortise housing base 10 is a rigid rectangular planar member with a length, a width, an inside surface, an outside surface, a first edge, a second edge, an upper edge, and a lower edge. The width of retracting side of mortise housing base 10 is about 0.25 to 2.5 inches and equal to that of the upper side. The length of retracting side is equal to the length of first side. Mortise housing base 10 may be made of any known material such as: metal, steel, aluminum, plastic, composite, wood, fiberglass, ceramic, or any other known material.

The upper edge of the first side is rigidly attached to the first edge of upper side so that these members are perpendicular to each other and the opening edge of the first side aligns with the opening edge of the upper side and the retracting edge of the first side aligns with the retracting edge of the upper side. Rigid attachment may be accomplished by any known means such as: brake bending, pressed seam, weld, glue, epoxy, adhesive, bolts, screws, rivets, clips, snaps, pins, or fasteners. In best mode, the first side and the upper side of mortise housing base 10 are made from the same sheet of rigid material that is brake bent at ninety degrees to form the first side. The lower edge of the first side is rigidly attached to the first edge of lower side so that these members are perpendicular to each other and the opening edge of the first side aligns with the opening edge of the lower side and the retracting edge of the first side aligns with the retracting edge of the lower side. Rigid attachment may be accomplished by any known means such as: brake bending, pressed seam, weld, glue, epoxy, adhesive, bolts, screws, rivets, clips, snaps, pins, or fasteners. In best mode, the lower side and the first side of mortise housing base 10 are made from the same sheet of rigid material that is brake bent at ninety degrees to form the lower side. The retracting edge of the first side is rigidly attached to the first side of retracting side so that these members are perpendicular to each other and the upper edge of the first side aligns with the upper edge of the retracting side and the lower edge of the first side aligns with the lower edge of the retracting side. Rigid attachment may be accomplished by any known means such as: brake bending, pressed seam, weld, glue, epoxy, adhesive, bolts, screws, rivets, clips, snaps, pins, or fasteners. In best mode, the retracting side and the first side of mortise housing base 10 are made from the same sheet of rigid material that is brake bent at ninety degrees to form the retracting side.

The first side of mortise housing base 10 contains a plurality structures that are used to mount and retain the various components of electrified mortise lock for sliding door 2 as discussed below. The first side of mortise housing base 10 comprises: a lock cylinder mounting hole 11; an upper deadbolt mounting pin 12; a lower deadbolt mounting pin 13; a Y-turn hub mounting hole 14; a deadbolt shaft slot track 15; a lever hub mounting hole 16; an electric motor mounting hole 18; a screw bracket slot track 19; a plurality of support pillars 20; and a plurality of circuit board mounting pillars 21.

Lock cylinder mounting hole 11 is a circular hole in the first side of mortise housing base 10. Lock cylinder mounting hole 11 has a diameter of about 0.5 to 2 inches. Lock cylinder mounting hole 11 is located in the corner of the first side of mortise housing base 10 adjacent to the upper edge and the retracting edge of the first side of mortise housing base 10. Lock cylinder mounting hole 11 in mortise housing base 10 and lock cylinder mounting hole 41 in mortise housing cover plate 40 function to receive, hold, and mount a lock cylinder (not depicted) into electrified mortise lock for sliding door 2. A lock cylinder is not an element of this invention but is included for certain versions of electrified mortise lock for sliding door 2. A lock cylinder is included with versions of the electrified mortise lock for sliding door 2 that require the sliding door to lock on the outside such as with privacy, entry, office, communicating, patio, classroom, or storeroom lock sets. A lock cylinder may be installed or mounted within lock cylinder mounting holes 11, 41. A lock cylinder is a horizontal cylindrical member with an inside end, an outside end, and a swing arm. The inside end is oriented towards the inside or interior of the room. The outside end is oriented toward the outside or exterior of the room. The inside end may have a keyhole that is accessible from the inside of the room. The outside end has a keyhole that is accessible from the outside of the room. A key (not depicted) mates or engages with keyhole to rotate the swing arm on lock cylinder as the key is rotated. The swing arm is located within the interior of electrified mortise lock for sliding door 2. The swing arm engages with the first and second arms 72,74 on Y-turn hub 70 as discussed below. The inside end or the outside end of lock cylinder may be installed within lock cylinder mounting hole 11.

Upper deadbolt mounting pin 12 is a solid rigid horizontal cylindrical member with a diameter, a length, a first end, a second end, and a longitudinal axis. Upper deadbolt mounting pin 12 has a diameter of about 0.0625 to 0.5 inches. The length of upper deadbolt mounting pin 12 is equal to the width of upper side of mortise housing base 10. The first end of upper deadbolt mounting pin 12 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of upper deadbolt mounting pin 12 into a hole in the first side of mortise housing base 10. The second end of upper deadbolt mounting pin 12 has a shoulder that steps down to a smaller diameter than that of the rest of the pin. Upper deadbolt mounting pin 12 is located just above deadbolt 50, as depicted. Upper deadbolt mounting pin 12 contacts deadbolt 50 and helps slideably attach deadbolt 50 to mortise housing base 10 and mortise housing face plate 30 as discussed below. Upper deadbolt mounting pin 12 also contacts upper deadbolt wing 51 and actuates the rotation of upper deadbolt wing 51 as discussed below.

Lower deadbolt mounting pin 13 is a solid rigid horizontal cylindrical member with a diameter, a length, a first end, a second end, and a longitudinal axis. Lower deadbolt mounting pin 13 has a diameter of about 0.0625 to 0.5 inches. The length of lower deadbolt mounting pin 13 is equal to the width of upper side of mortise housing base 10. The first end of lower deadbolt mounting pin 13 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of upper deadbolt mounting pin 12 into a hole in the first side of mortise housing base 10. The second end of lower deadbolt mounting pin 13 has a shoulder that steps down to a smaller diameter than that of the rest of the pin. Lower deadbolt mounting pin 13 is located just below deadbolt 50, as depicted. Lower deadbolt mounting pin 13 contacts deadbolt 50 and helps slideably attach deadbolt 50 to mortise housing base 10 and mortise housing face plate 30 as discussed below. Lower deadbolt mounting pin 13 also contacts lower deadbolt wing 56 and actuates the rotation of lower deadbolt wing 56 as discussed below.

Y-turn hub mounting hole 14 is a circular hole in the first side of mortise housing base 10. Y-turn hub mounting hole 14 has a diameter of about 0.125 to 1.0 inches. Y-turn hub mounting hole 14 is located just below lock cylinder mounting hole 11, as depicted. Y-turn hub mounting hole 14 in the first side of mortise housing base 10 and Y-turn hub mounting hole 42 in mortise housing cover plate 40 function to receive, hold, and mount Y-turn hub 70. Y-turn hub 70 is pivotally attached to Y-turn hub mounting hole 14 in the first side of mortise housing base 10 and Y-turn hub mounting hole 42 in mortise housing cover plate 40.

Deadbolt shaft slot track 15 is an oblong hole or slot in the first side of mortise housing base 10. Deadbolt shaft slot track 15 has a width, a length, and a longitudinal axis. The width of deadbolt shaft slot track 15 is about 0.0625 to 0.5 inches. The length of deadbolt shaft slot track 15 is about 0.5 to 2 inches. Deadbolt shaft slot track 15 is located adjacent to the opening edge of the first side of mortise housing base 10 with its longitudinal axis perpendicular to the opening edge of the first side of mortise housing base 10, as depicted. Dead bolt shaft slot track 15 functions as a slot or track for an opening side slide pin 68 on deadbolt shaft 60 to slide within. As discussed below, deadbolt shaft 60 is slideably attached to the first side of mortise housing base 10 by placing the first end of opening side slide pin 68 within deadbolt shaft slot track 15.

Lever hub mounting hole 16 is a circular hole in the first side of mortise housing base 10. Lever hub mounting hole 16 has a diameter of about 0.5 to 2.0 inches. Lever hub mounting hole 16 is located in the corner of the first side of mortise housing base 10 adjacent to the lower edge and the retracting edge of the first side of mortise housing base 10. Lever hub mounting hole 16 functions to receive, hold, and mount lever hub 90. Lever hub 90 is pivotally attached to lever hub mounting hole 16 in mortise housing base 10 and lever hub mounting hole 45 in mortise housing cover plate 40 as discussed below.

Lever hub mounting hole 16 has a key notch 17 on its circumference. Key notch 17 is notch, void, or crenellation in the first side of mortise housing base 10 along the circumference or perimeter of lever hub mounting hole 16. Key notch 17 has a width. Key notch 17 has an opening end and a retracting end. A first key tab 94 on lever hub 90 engages with key notch 17 and nests within key notch 17 to function as a rotation stop or limiter for lever hub 90 where first key tab 94 strikes or contacts the opening end of key notch 17 thereby limiting the rotation of lever hub 90 in that direction and strikes or contacts the retracting end of key notch 17 thereby limiting the rotation of lever hub 90 in the other direction.

Electric motor mounting hole 18 is a rectangular hole in the first side of mortise housing base 10. Electric motor mounting hole 18 has a width, length, and a longitudinal axis. Electric motor mounting hole 18 has a width of about 0.25 to 2.0 inches a length of about 0.5 to 3.0 inches. Electric motor mounting hole 18 is sized to make a slip fit or press fit with the exterior dimensions of electric motor 110. Electric motor mounting hole 18 is located adjacent to the lower edge of the first side of mortise housing base 10 with its longitudinal axis parallel with the planes of the upper and lower sides of mortise housing base 10 and perpendicular to the plane of the retracting side of mortise housing base 10 as depicted. Electric motor mounting hole 18 in mortise housing base 10, along with electric motor mounting hole 47 in mortise housing cover plate 40, function to attach or mount electric motor 110 to mortise housing base 10 and mortise housing cover plate 40 as discussed below.

Screw bracket slot track 19 is an oblong hole or slot in the first side of mortise housing base 10. Screw bracket slot track 19 has a width, a length, and a longitudinal axis. The width of screw bracket slot track 19 is about 0.0625 to 0.5 inches. The length of screw bracket slot track 19 is about 0.5 to 2 inches. Screw bracket slot track 19 is located adjacent to the lower side of mortise housing base 10 with its longitudinal axis parallel to the lower side of mortise housing base 10, as depicted. Screw bracket slot track 19 functions as a slot or a track for a screw bracket pin 116 to slide within. As discussed below, screw bracket 114 and screw bracket pin 116 is slideably attached to the first side of mortise housing base 10 by placing screw bracket pin 116 within screw bracket slot track 19.

Each of the plurality of support pillars 20 is a hollow rigid horizontal cylindrical member with an inner diameter, an outer diameter, a length, a first end, a second end, an inside surface, an outside surface, and a longitudinal axis. Each of the plurality of support pillars 20 has an outer diameter of about 0.125 to 0.75 inches. The length of each of the plurality of support pillars 20 is equal to the width of upper side of mortise housing base 10. The first end of each of the plurality of support pillars 20 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of each of the plurality of support pillars 20 into a hole in the first side of mortise housing base 10. The second end of each of the plurality of support pillars 20 is a female threaded fitting connection. The inner diameter on the second end of each of the plurality of support pillars 20 is lined with female thread that engages with male thread on a mortise housing screw 26. Each of the plurality of support pillars 20 and mortise housing screws 26 function to help attach and support mortise housing cover plate 40 to mortise housing base 10 as discussed below.

Each of the plurality of circuit board mounting pillars 21 is a hollow rigid horizontal cylindrical member with an inner diameter, an outer diameter, a length, a first end, a second end, an inside surface, an outside surface, and a longitudinal axis. Each of the plurality of circuit board mounting pillars 21 has an outer diameter of about 0.125 to 0.75 inches. The length of each of the plurality of circuit board mounting pillars 21 is less than to the width of upper side of mortise housing base 10. The first end of each of the plurality of circuit board mounting pillars 21 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of each of the plurality of circuit board mounting pillars 21 into a hole in the first side of mortise housing base 10. The second end of each of the plurality of circuit board mounting pillars 21 is a female threaded fitting connection. The inner diameter on the second end of each of the plurality of circuit board mounting pillars 21 is lined with female thread that engages with male thread on a circuit board screw. Each of the plurality of circuit board mounting pillars 21 and circuit board screws function to attach and support mortise lock circuit board 120 to mortise housing base 10 as discussed below. Mortise housing face plate 30 is a rigid rectangular planar member with a length, a width, an inside surface, an outside surface, a first edge, a second edge, an upper edge, and a lower edge. The width of mortise housing face plate 30 is about 0.5 to 2.5 inches and is about 0.5 inches wider than the upper side of mortise housing base 10. The length of mortise housing face plate 30 is about 6-10 inches and is about 2.0 inches longer than the first side of mortise housing base 10.

Mortise housing face plate 30 is reversibly attachable to mortise housing base 10. Mortise housing face plate 30 is attached to mortise housing base 10 with its plane perpendicular to that of the first side of mortise housing base 10, and its first edge aligned with and adjacent to the opening edge of the first side of mortise housing base 10 and its second edge aligned with and adjacent to the opening edge of mortise housing cover plate 40. Reversible attachment may be accomplished by any known means such as: bolts, screws, clips, snaps, pins, fasteners, or any other means. When attached, mortise housing face plate 30 is the opening side 8 of electrified mortise lock for sliding door 2. Mortise housing face plate 30 comprises: a deadbolt clearance hole 32 and optionally a power transfer unit clearance hole 34.

Deadbolt clearance hole 32 is a rectangular or square hole in mortise housing face plate 30. Deadbolt clearance hole 32 has a width of about 0.25 to 1.5 inches and length of about 0.5 to 2.5 inches. Deadbolt clearance hole 32 could also be a circular hole in mortise housing face plate 30. Deadbolt clearance hole 32 has diameter of about 0.5 to 2.5 inches. Deadbolt clearance hole 32 is located in between upper tab flange 36 and a lower tab flange 38. Deadbolt clearance hole 32 functions to provide a clearance hole through face plate 30, through which deadbolt 50 protrudes out of and retracts into in order to latch, unlatch, lock, and/or unlock electrified mortise lock for sliding door 2 as discussed below.

Mortise housing face plate 30 may further comprises a power transfer unit clearance hole 34. Power transfer unit clearance hole 34 is only present in some embodiments of electrified mortise lock for sliding door 2. Power transfer unit clearance hole 34 is a rectangular hole in mortise housing face plate 30. Power transfer unit clearance hole 34 has a width of about 0.25 to 1.5 inches and length of about 0.5 to 2.5 inches. Power transfer unit clearance hole 34 could also be a circular hole in mortise housing face plate 30. Power transfer unit clearance hole 34 is located below deadbolt clearance hole 32. Power transfer unit clearance hole 34 functions to provide a clearance hole in face plate 30 for the power transfer unit 130. In some embodiments of electrified mortise lock for sliding door 2, the power transfer unit 130 is installed within mortise lock wherein the positive power contact 134 and the negative power contact 136 are positioned within power transfer unit clearance hole 34 as discussed below. In other embodiments of electrified mortise lock for sliding door 2, the power transfer unit 130 is installed within the upper side of the sliding door as discussed below.

Mortise housing face plate 30 may further comprise: an upper tab flange 36 and a lower tab flange 38. Upper tab flange 36 and lower tab flange 38 function to reversibly attach mortise housing face plate 30 to mortise housing base 10.

Upper tab flange 36 is a tab or flange protruding from the inner surface of mortise housing face plate 30, near the upper edge of mortise housing face plate 30. Upper tab flange 36 is a rigid planar protrusion extending perpendicularly from the inner surface of mortise housing face plate 30. The plane of upper tab flange 36 is parallel to that of the upper side of mortise housing base 10 and perpendicular to plane of mortise housing face plate 30. Upper tab flange 36 has a female threaded or tapped hole 39 running there though. Female threaded or tapped hole 39 engages with male thread on a mortise housing screw 26 to reversibly attach the upper tab flange 36 to the upper side of mortise housing base 10.

Lower tab flange 38 is a tab or flange protruding from the inner surface of mortise housing face plate 30, near the lower edge of mortise housing face plate 30. Lower tab flange 38 is a rigid planar protrusion extending perpendicularly from the inner surface of mortise housing face plate 30. The plane of lower tab flange 38 is parallel to that of the lower side of mortise housing base 10 and perpendicular to plane of mortise housing face plate 30. Lower tab flange 38 has a female threaded or tapped hole 39 running there though. Female threaded or tapped hole 39 engages with male thread on a mortise housing screw 26 to reversibly attach the lower tab flange 38 to the lower side of mortise housing base 10.

Mortise housing cover plate 40 is a rigid rectangular planar member with a length, a width, an inside surface, an outside surface, an upper edge, a lower edge, an opening edge, and a retracting edge. The width of mortise housing cover plate 40 is about 2-6 inches. The length of mortise housing cover plate 40 is about 4-8 inches. Mortise housing cover plate 40 is reversibly attachable to mortise housing base 10. Mortise housing cover plate 40 is attached to mortise housing base 10 with its plane perpendicular to that of the upper and lower sides of mortise housing base 10 and parallel with the first side of mortise housing base 10. Mortise housing cover plate 40 is attached to mortise housing base 10 with its upper edge aligned with and adjacent to the second edge of the upper side of mortise housing base 10, its lower edge aligned with and adjacent to the second edge of the lower side of mortise housing base 10, its retracting edge aligned with and adjacent to the second edge of the retracting side of mortise housing base 10, and its opening edge aligned with and adjacent to the second edge of mortise housing face plate 30. Reversible attachment may be accomplished by any known means such as: bolts, screws, clips, snaps, pins, fasteners, or any other means. When attached, mortise housing cover plate 40 is the second side 5 of electrified mortise lock for sliding door 2. Mortise housing cover plate 40 comprises: a lock cylinder mounting hole 41; a Y-turn hub mounting hole 42; a retracting side deadbolt shaft slot track 43; an opening side deadbolt shaft slot track 44; a lever hub mounting hole 45; an electric motor mounting hole 47; a screw bracket slot track 48; a screw lever pivot pin mounting hole 49; a plurality of pin mounting holes 22; and a plurality of screw holes 24.

Lock cylinder mounting hole 41 is a circular hole in mortise housing cover plate 40. Lock cylinder mounting hole 41 has a diameter of about 0.5 to 2 inches. Lock cylinder mounting hole 41 is located in the corner of mortise housing cover plate 40 adjacent to the upper edge and the retracting edge of mortise housing cover plate 40. Lock cylinder mounting hole 11 in mortise housing base 10 and lock cylinder mounting hole 41 in mortise housing cover plate 40 function to receive, hold, and mount a lock cylinder (not depicted) into electrified mortise lock for sliding door 2. A lock cylinder is not an element of this invention but is included for certain versions of electrified mortise lock for sliding door 2. A lock cylinder is included with versions of the electrified mortise lock for sliding door 2 that require the sliding door to lock on the outside such as with privacy, entry, office, communicating, patio, classroom, or storeroom lock sets. A lock cylinder may be installed or mounted within lock cylinder mounting holes 11, 41. A lock cylinder is a horizontal cylindrical member with an inside end, an outside end, and a swing arm. The inside end is oriented towards the inside or interior of the room. The outside end is oriented toward the outside or exterior of the room. The inside end may have a keyhole that is accessible from the inside of the room. The outside end has a keyhole that is accessible from the outside of the room. A key (not depicted) mates or engages with the keyholes to rotate the swing arm on lock cylinder as the key is rotated. The swing arm is located within the interior of electrified mortise lock for sliding door 2. The swing arm engages with the first and second arms 74,75 on Y-turn hub 70 as discussed below. The inside end or the outside end of lock cylinder may be installed within lock cylinder mounting hole 41.

Y-turn hub mounting hole 42 is a circular hole in mortise housing cover plate 40. Y-turn hub mounting hole 42 has a diameter of about 0.125 to 1.0 inches. Y-turn hub mounting hole 42 is located just below lock cylinder mounting hole 41, as depicted. Y-turn hub mounting hole 14 in the first side of mortise housing base 10 and Y-turn hub mounting hole 42 in mortise housing cover plate 40 function to receive, hold, and mount Y-turn hub 70. Y-turn hub 70 is pivotally attached to Y-turn hub mounting hole 14 in the first side of mortise housing base 10 and Y-turn hub mounting hole 42 in mortise housing cover plate 40.

Retracting side deadbolt shaft slot track 43 is an oblong hole or slot in mortise housing cover plate 40. Retracting side deadbolt shaft slot track 43 has a width, a length, and a longitudinal axis. The width of retracting side deadbolt shaft slot track 43 is about 0.0625 to 0.5 inches. The length of retracting side deadbolt shaft slot track 43 is about 0.5 to 2 inches. Retracting side deadbolt shaft slot track 43 is located adjacent to the retracting edge of mortise housing cover plate 40 with its longitudinal axis perpendicular to the retracting edge of mortise housing cover plate 40, as depicted. Retracting side deadbolt shaft slot track 43 functions as a slot or track for a retracting side slide pin 66 on deadbolt shaft 60 to slide within. As discussed below, deadbolt shaft 60 is slideably attached to mortise housing cover plate 40 by placing the second end of retracting side slide pin 66 within retracting side deadbolt shaft slot track 43.

Opening side deadbolt shaft slot track 44 is an oblong hole or slot in mortise housing cover plate 40. Opening side deadbolt shaft slot track 44 has a width, a length, and a longitudinal axis. The width of opening side deadbolt shaft slot track 44 is about 0.0625 to 0.5 inches. The length of opening side deadbolt shaft slot track 44 is about 0.5 to 2 inches. Opening side deadbolt shaft slot track 44 is located adjacent to the opening edge of mortise housing cover plate 40 with its longitudinal axis perpendicular to the opening edge of mortise housing cover plate 40, as depicted. Opening side deadbolt shaft slot track 44 functions as a slot or track for an opening side slide pin 68 on deadbolt shaft 60 to slide within. As discussed below, deadbolt shaft 60 is slideably attached to mortise housing cover plate 40 by placing the second end of opening side slide pin 68 within retracting side deadbolt shaft slot track 43.

Lever hub mounting hole 45 is a circular hole in mortise housing cover plate 40. Lever hub mounting hole 45 has a diameter of about 0.5 to 2.0 inches. Lever hub mounting hole 45 is located in the corner of mortise housing cover plate 40 adjacent to the lower edge and the retracting edge mortise housing cover plate 40. Lever hub mounting hole 45 in mortise housing cover plate 40 functions to receive, hold, and mount lever hub 90. Lever hub 90 is pivotally attached to lever hub mounting hole 45 in mortise housing cover plate 40 as discussed below.

Lever hub mounting hole 45 has a key notch 46 on its circumference. Key notch 46 is notch, void, or crenellation in mortise housing cover plate 40 along the circumference or perimeter of lever hub mounting hole 45. Key notch 46 has a width. Key notch 46 has an opening end and a retracting end. A second key tab 96 on lever hub 90 engages with key notch 46 and nests within key notch 46 to function as a rotation stop for lever hub 90 where second key tab 96 strikes or contacts the one side of key notch 46 thereby limiting the rotation of lever hub 90 in that direction and strikes or contacts the other side of key notch 46 thereby limiting the rotation of lever hub 90 in the other direction.

Electric motor mounting hole 47 is a rectangular hole in mortise housing cover plate 40. Electric motor mounting hole 47 has a width, length, and a longitudinal axis. Electric motor mounting hole 47 has a width of about 0.25 to 2.0 inches a length of about 0.5 to 3.0 inches. Electric motor mounting hole 47 is sized to make a slip fit or press fit with the exterior dimensions of electric motor 110. Electric motor mounting hole 47 is located adjacent to lower edge of mortise housing cover plate 40 with its longitudinal axis parallel with the planes of the upper and lower sides of mortise housing base 10 and perpendicular to the plane of the retracting side of mortise housing base 10 as depicted. Electric motor mounting hole 47 in mortise housing cover plate 40, along with electric motor mounting hole 18 in mortise housing base 10, function to attach or mount electric motor 110 to mortise housing base 10 and mortise housing cover plate 40 as discussed below.

Screw bracket slot track 48 is an oblong hole or slot in mortise housing cover plate 40. Screw bracket slot track 48 has a width, a length, and a longitudinal axis. The width of screw bracket slot track 48 is about 0.0625 to 0.5 inches. The length of screw bracket slot track 48 is about 0.5 to 2 inches. Screw bracket slot track 48 is located adjacent to the retracting edge of mortise housing cover plate 40 with its longitudinal axis perpendicular to the retracting edge of mortise housing cover plate 40, as depicted. Screw bracket slot track 48 functions as a slot or a track for a screw bracket pin 116 to slide within. As discussed below, screw bracket 114 and screw bracket pin 116 are slideably attached to the mortise housing cover plate 40 by placing screw bracket pin 116 within screw bracket slot track 48.

Screw lever pivot pin mounting hole 49 is a circular hole in mortise housing cover plate 40. Screw lever pivot pin mounting hole 49 has a diameter of about 0.125 to 0.5 inches. Screw lever pivot pin mounting hole 49 is located just below lever hub mounting hole 45, as depicted. Screw lever pivot pin mounting hole 49 functions to receive, hold, and mount pivot pin 104 on screw lever 100. Screw lever 100 is pivotally attached to screw lever pivot pin mounting hole 49 in mortise housing cover plate 40 as discussed below.

Each of the plurality of pin mounting holes 22 is a circular hole in mortise housing cover plate 40. Each of the plurality of pin mounting holes 22 has a diameter of about 0.0625 to 0.5 inches. Each of the plurality of pin mounting holes 22 functions to receive, hold, and mount the second end of a pin, such as: upper deadbolt mounting pin 12 and lower deadbolt mounting pin 13. The second end of each of these pins forms a slip fit or clearance fit within each of the plurality of pin mounting holes 22 when the mortise housing cover plate 40 is installed onto mortise housing base 10. As stated, the second end of each of these pins has a shoulder that steps down to a smaller diameter that slides or fits into each of the plurality of pin mounting holes 22. When the mortise housing cover plate 40 is installed onto mortise housing base 10, the second ends of upper deadbolt mounting pin 12 and lower deadbolt mounting pin 13 are flush with the outside surface of mortise housing cover plate 40. This construction adds strength and stability to the pins as they are attached at both their first and second ends.

Each of the plurality of screw holes 24 is a circular hole in mortise housing cover plate 40 with a beveled edge. Each of the plurality of screw holes 24 functions to provide a clearance hole for the first end of a mortise housing screw 26 to pass through and engage with the female thread on a support pillar 20. Each of the plurality of screw holes 24 has an inner diameter of about 0.0625 to 0.5 inches. Each of the plurality of screw holes 24 is located to exactly align with the second end of a support pillar 20. The beveled edge or each screw hole 24 allows the head of each mortise housing screw 26 to be counter sunk into the mortise housing cover plate 40 and flush with the outside surface of mortise housing cover plate 40 when installed.

Each of the plurality of mortise housing screws 26 is a screw, bolt, fastener, clip, or similar. Each of the plurality of mortise housing screws 26 has a first end, a second end, and a longitudinal axis. The first end of each mortise housing screw 26 has male thread that is sized to engage with the female thread on the second end of each support pillar 20. The second end of each mortise housing screw 26 has a head that engages with a tool such as a driver, wrench, socket, bit, or similar. To install mortise housing cover plate 40 to mortise housing base 10, mortise housing cover plate 40 is aligned with mortise housing base 10 and placed onto mortise housing base 10 so that the second ends of mounting pins 12,13 align with a pin mounting hole 22 and are inserted therein, and the second ends of each of the plurality of support pillars 20 aligns with a screw hole 24, wherein mortise housing screws 26 are installed and tighten down onto support pillars 20. Installing the mortise housing cover plate 40 is the last step to assembling the electrified mortise lock for sliding door 2. Before installing the mortise housing cover plate 40, all internal mechanisms and components of electrified mortise lock for sliding door 2 must first be installed and the mortise housing face plate 30 must first be installed as discussed below.

Deadbolt 50 is a rigid rectangular cuboid shaped member. Deadbolt 50 has a width of about 0.5-2 inches, a length of about 1-4 inches, and a thickness of about 0.25 to 1 inches. Deadbolt 50 has a first side, a second side, an upper side, a lower side, an opening side, a retracting side, a longitudinal axis, and a longitudinal bisect. The longitudinal axis of deadbolt 50 runs through its opening side and retracting side. Deadbolt 50 is slideably attached to mortise housing base 10 and mortise housing cover plate 40 with its longitudinal axis running horizontally wherein the deadbolt 50 slides back and forth horizontally along its longitudinal axis. Deadbolt 50 has a retracted position and an extended position. In the retracted position, sliding door is unlatched. In the extended position, sliding door is latched. In the retracted and extended positions, the retracting side of deadbolt 50 remains inside of electrified mortise lock for sliding door 2. In the retracted and extended positions, the opening side of deadbolt 50 remains outside of electrified mortise lock for sliding door 2. In the extended position, deadbolt 50 extends or protrudes through deadbolt clearance hole 32 on mortise housing face plate 30 so that its longitudinal bisect extends beyond deadbolt clearance hole 32 and is outside of electrified mortise lock for sliding door 2. In the retracted position, deadbolt 50 retracts through deadbolt clearance hole 32 on mortise housing face plate 30 so that its longitudinal bisect retracts within deadbolt clearance hole 32 and is inside of electrified mortise lock for sliding door 2. Deadbolt 50 functions to latch and unlatch sliding door as described below.

Deadbolt 50 is partially hollow with a rectangular cuboid shaped hollow cavity extending from its lower edge to its upper edge. The hollow cavity breaks through the upper side and the lower side of deadbolt 50. The hollow cavity does not break through the first side, second side, or opening side. The hollow cavity may optionally break through retracting side to receive the deadbolt attachment arm 62 to provide a groove for a tongue and groove connection with deadbolt shaft 60 as discussed below. The hollow cavity is a smaller rectangular cuboid that is concentric with that of deadbolt 50 with access at the upper and lower sides. This hollow cavity contains a complicated action mechanism or assembly of parts comprising: an upper deadbolt wing 51; an upper deadbolt wing pivot pin 52; an upper deadbolt wing latch protrusion 53; an upper deadbolt wing heel protrusion 54; a deadbolt wing spring 55; a lower deadbolt wing 56; an lower deadbolt wing pivot pin 57; a lower deadbolt wing latch protrusion 58; and a lower deadbolt wing heel protrusion 59. This complicated action mechanism or assembly of parts must first be installed within deadbolt 50 prior to installing deadbolt 50 into mortise housing base 10 and mortise housing face plate 30. This complicated action mechanism or assembly of parts functions to help extend and retract upper and lower deadbolt wings 51,56 as described below.

Upper deadbolt wing 51 is a rigid oblong member with a first side, a second side, an upper side, a lower side, an opening side, a retracting side, a pivot pin hole, a latch protrusion 53, a heel protrusion 54, and a longitudinal axis. Upper deadbolt wing 51 has a length of about 1 to 3 inches. The longitudinal axis of upper deadbolt wing 51 runs essentially horizontally and parallel with that of deadbolt 50. Latch protrusion 53 is a rigid tab, protrusion, or catch that extends or protrudes upwards from the upper side of upper deadbolt wing 51 adjacent to the opening side of upper deadbolt wing 51. Heel protrusion 54 is a rigid tab, protrusion, or catch that extends or protrudes upwards from the lower side of upper deadbolt wing 51 adjacent to the retracting side of upper deadbolt wing 51. Pivot pin hole is located in the center of upper deadbolt wing 51 in between the latch protrusion 53 and the heel protrusion 54 of upper deadbolt wing 51. Upper deadbolt wing 51 is pivotally attached within the hollow cavity of deadbolt 50 with upper deadbolt wing pivot pin 52 inserted through pivot pin hole in upper deadbolt wing 51. Upper deadbolt wing 51 is a lever member that pivots about upper deadbolt wing pivot pin 52 which acts as a fulcrum. Latch protrusion 53 pivots upwards to catch within a strike plate (not depicted) in a door jamb (not depicted) in order to latch sliding door with deadbolt 50 in the extended position. Latch protrusion 53 pivots downwards to clear the strike plate in a door jamb in order to unlatch the sliding door.

Lower deadbolt wing 56 is a rigid oblong member with a first side, a second side, an upper side, a lower side, an opening side, a retracting side, a pivot pin hole, a latch protrusion 58, a heel protrusion 59, and a longitudinal axis. Lower deadbolt wing 56 has a length of about 1 to 3 inches. The longitudinal axis of lower deadbolt wing 56 runs essentially horizontally and parallel with that of deadbolt 50. Latch protrusion 58 is a rigid tab, protrusion, or catch that extends or protrudes downwards from the lower side of lower deadbolt wing 56 adjacent to the opening side of lower deadbolt wing 56. Heel protrusion 59 is a rigid tab, protrusion, or catch that extends or protrudes downwards from the lower side of lower deadbolt wing 56 adjacent to the retracting side of lower deadbolt wing 56. Pivot pin hole is located in the center of lower deadbolt wing 56 in between the latch protrusion 58 and the heel protrusion 59 of lower deadbolt wing 56. Lower deadbolt wing 56 is pivotally attached within the hollow cavity of deadbolt 50 with lower deadbolt wing pivot pin 57 inserted through pivot pin hole in lower deadbolt wing 56. Lower deadbolt wing 56 is a lever member that pivots about lower deadbolt wing pivot pin 57 which acts as a fulcrum. Latch protrusion 58 pivots downwards to catch within a strike plate (not depicted) in a door jamb (not depicted) in order to latch sliding door with deadbolt 50 in the extended position. Latch protrusion 58 pivots upwards to clear the strike plate in a door jamb in order to unlatch the sliding door.

Deadbolt wing spring 55 is a compression spring with an upper end, a lower end, and a longitudinal axis. Deadbolt wing spring 55 is installed between upper and lower deadbolt wings 51,56. Upper deadbolt wing 51 is installed in the hollow cavity of deadbolt 50 through the hole in the upper side of deadbolt 50 and pivotally attached to deadbolt 50 with upper deadbolt wing pivot pin 52. Lower deadbolt wing 56 is installed in the hollow cavity of deadbolt 50 through the hole in the lower side of deadbolt 50 and pivotally attached to deadbolt 50 with lower deadbolt wing pivot pin 57. Deadbolt wing spring 55 is installed in the hollow cavity of deadbolt 50 with its longitudinal axis running vertically with its upper end in contact with the lower side of upper deadbolt wing 51 and its lower end in contact with the upper side of lower deadbolt wing 56. Deadbolt wing spring 55 is installed between upper and lower deadbolt wings 51,56. There may be a window into the hollow cavity on the first and second sides of deadbolt 50, as depicted, to help with the installation deadbolt wing spring 55 in between upper and lower deadbolt wings 51,56. Deadbolt wing spring 55 is installed on the retracting side of upper and lower deadbolt wing pivot pins 52,57 and thus creates bias spring pressure that rotates or extends upper deadbolt wing heel protrusion 54 upwards and lower deadbolt wing heel protrusion 59 downwards.

Upper deadbolt wing latch protrusion 53 is actuated to rotate upwards by heel protrusion 54 contacting upper deadbolt mounting pin 12 as deadbolt 50 extends out of deadbolt clearance hole 32. When deadbolt 50 is in the retracted position, heel protrusion 54 is not in contact with upper deadbolt mounting pin 12 and deadbolt wing spring 55 forces the retracting side of upper deadbolt wing 51 upwards to retract upper deadbolt wing latch protrusion 53 within the hollow cavity of deadbolt 50. When deadbolt 50 is in the extended position, heel protrusion 54 is in contact with upper deadbolt mounting pin 12, which pushes the retracting side of upper deadbolt wing downwards to extend upper deadbolt wing latch protrusion 53 upwards to extend out of the hollow cavity of deadbolt 50.

Lower deadbolt wing latch protrusion 58 is actuated to rotate downwards by heel protrusion 59 contacting lower deadbolt mounting pin 13 as deadbolt 50 extends out of deadbolt clearance hole 32. When deadbolt 50 is in the retracted position, heel protrusion 59 is not in contact with lower deadbolt mounting pin 13 and deadbolt wing spring 55 forces the retracting side of lower deadbolt wing 56 downwards to retract lower deadbolt wing latch protrusion 58 within the hollow cavity of deadbolt 50. When deadbolt 50 is in the extended position, heel protrusion 59 is in contact with lower deadbolt mounting pin 13, which pushes the retracting side of lower deadbolt wing upwards to extend lower deadbolt wing latch protrusion 58 downwards to extend out of the hollow cavity of deadbolt 50.

Deadbolt shaft 60 is a rigid oblong planar member with a first side, a second side, an upper edge, a lower edge, an opening edge, a retracting edge, and a longitudinal axis. Deadbolt shaft 60 has a width of about 0.5 to 2 inches. Deadbolt shaft 60 has a length of about 1 to 3 inches. Deadbolt shaft 60 functions to rigidly attach to deadbolt 50 and slideably attach to the first side of mortise housing base 10. Deadbolt shaft 60 comprises: a deadbolt attachment arm 62; a pendulum arm pocket 64; a retracting side slide pin 66; an opening side slide pin 68; and deadbolt position indicator 69.

Deadbolt attachment arm 62 is a long planar protrusion or arm member protruding from the upper edge of deadbolt shaft 60 adjacent to the opening edge of deadbolt shaft 60. Deadbolt attachment arm 62 has a length equal to the width of deadbolt 50. Deadbolt attachment arm 62 is in the same plane as that of deadbolt shaft 60. Deadbolt attachment arm 62 is rigidly attached to the retracting side of deadbolt 50. Rigid attachment may be accomplished by any known means such as: pressed fit, pressed seam, weld, glue, epoxy, adhesive, bolts, screws, rivets, clips, snaps, pins, or fasteners. In best mode, rigid attachment is done with pins. In best mode, deadbolt 50 has two pin holes adjacent to the retracted edge of deadbolt 50. In best mode, deadbolt attachment arm 62 has two pin holes that align with the pin holes on deadbolt 50. Each pin hole is a circular hole that functions to receive a deadbolt attachment pin 63 to rigidly attach deadbolt attachment arm 62 to deadbolt 50. Each deadbolt attachment pin 63 is a rigid cylindrical member sized to make slip fit or press fit within the pin holes on deadbolt attachment arm 62 and deadbolt 50. In best mode, deadbolt attachment arm is inserted slightly into the hollow cavity at the retracting side of deadbolt 50 and then pinned, as depicted. This is a pinned tongue and groove joint or rigid connection where deadbolt attachment arm 62 is the tongue and the hollow cavity in deadbolt 50 is the groove.

Pendulum arm pocket 64 is a void or hole in deadbolt shaft 60. Pendulum arm pocket 64 is rectangular or square shaped notch or void taken out of the upper edge of deadbolt shaft 60, adjacent to the retracted edge of deadbolt shaft 60. Pendulum arm pocket 64 does not break through the retracted edge of deadbolt shaft 60. Pendulum arm pocket 64 functions to receive and hold within it, the lower end of pendulum arm 76 of Y-turn hub 70 as discussed below. The lower end of pendulum arm 76 of Y-turn hub 70 rides within pendulum arm pocket 64 to cause deadbolt shaft 60 to slide back and forth horizontally as Y-turn hub 70 is rotated and vice versa.

Deadbolt shaft 60 has a first pin hole located in the corner of the retracting edge and the lower edge of deadbolt shaft 60 as depicted. First pin hole is a circular hole that functions to receive a retracting side slide pin 66. Retracting side slide pin 66 is a solid rigid horizontal cylindrical member with a diameter, a length, a first end, a second end, a longitudinal axis, and a longitudinal bisect. Retracting side slide pin 66 has a diameter of about 0.0625 to 0.5 inches. The length of retracting side slide pin 66 is equal to the width of upper side of mortise housing base 10. The longitudinal bisect of retracting side slide pin 66 is rigidly attached to first pin hole in deadbolt shaft 60 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. The second end of retracting side slide pin 66 slides within or rides within the retracting side deadbolt shaft slot track 43 on mortise housing cover plate 40 to help slideably attach deadbolt shaft 60 to mortise housing base 10 and mortise housing cover plate 40.

Deadbolt shaft 60 has a second pin hole located in the corner of the opening edge and the lower edge of deadbolt shaft 60 as depicted. Second pin hole is a circular hole that functions to receive an opening side slide pin 68. Opening side slide pin 68 is a solid rigid horizontal cylindrical member with a diameter, a length, a first end, a second end, a longitudinal axis, and a longitudinal bisect. Opening side slide pin 68 has a diameter of about 0.0625 to 0.5 inches. The length of opening side slide pin 68 is equal to the width of upper side of mortise housing base 10. The longitudinal bisect of opening side slide pin 68 is rigidly attached to second pin hole in deadbolt shaft 60 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. The first end of opening side slide pin 68 slides within or rides within the deadbolt shaft slot track 15 on mortise housing base 10 to help slideably attach deadbolt shaft 60 to mortise housing base 10 and mortise housing cover plate 40. The second end of opening side slide pin 68 slides within or rides within the opening side deadbolt shaft slot track 44 on mortise housing cover plate 40 to help slideably attach deadbolt shaft 60 to mortise housing base 10 and mortise housing cover plate 40.

Figure 5:
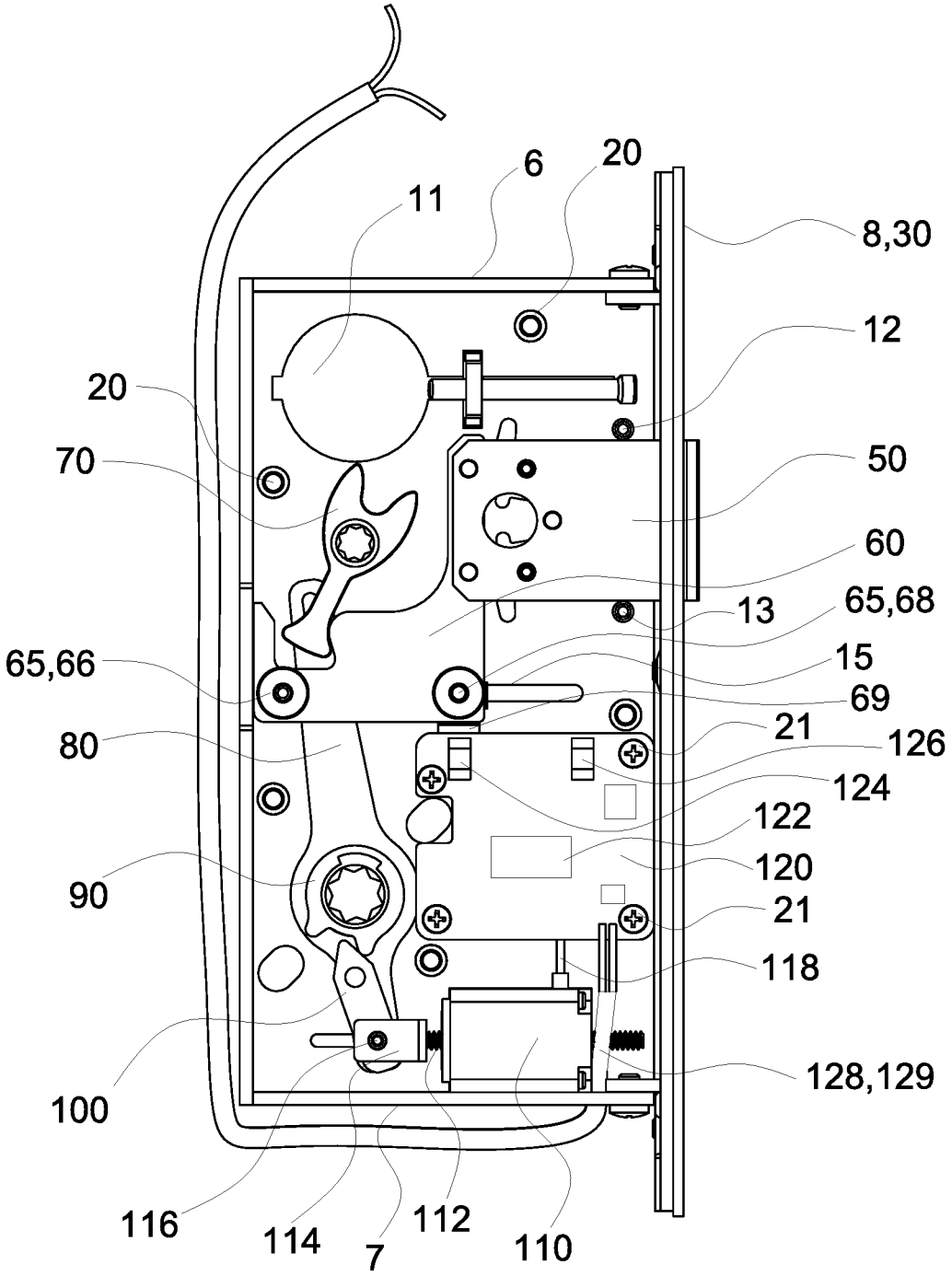
FIG. 5 is a side elevation view of the second side of electrified mortise lock for sliding door with the mortise housing cover plate removed and the deadbolt in the retracted position.
Figure 6:
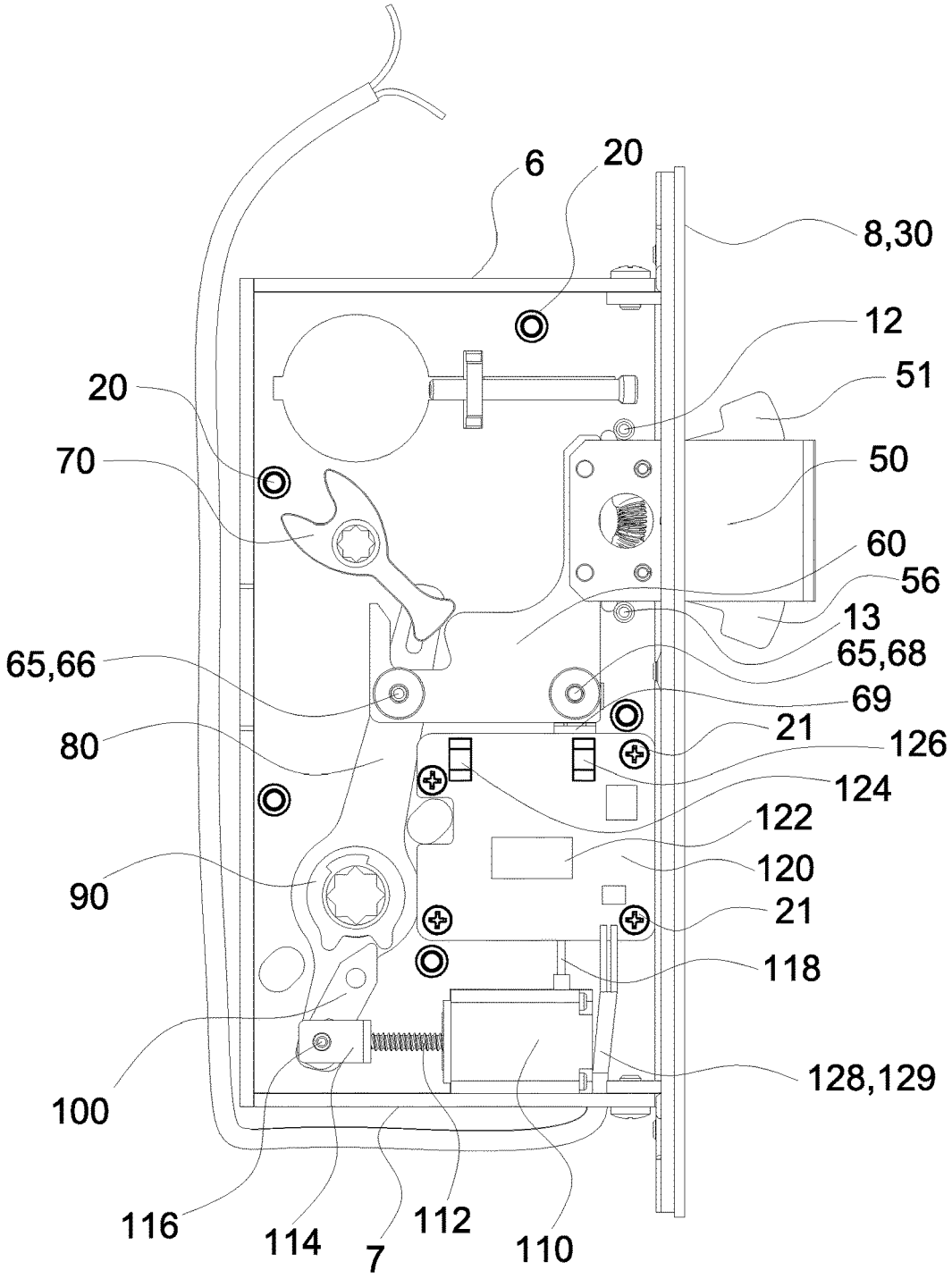
FIG. 6 is a side elevation view of the second side of electrified mortise lock for sliding door with the mortise housing cover plate removed and the deadbolt in the extended position.
Figure 7:
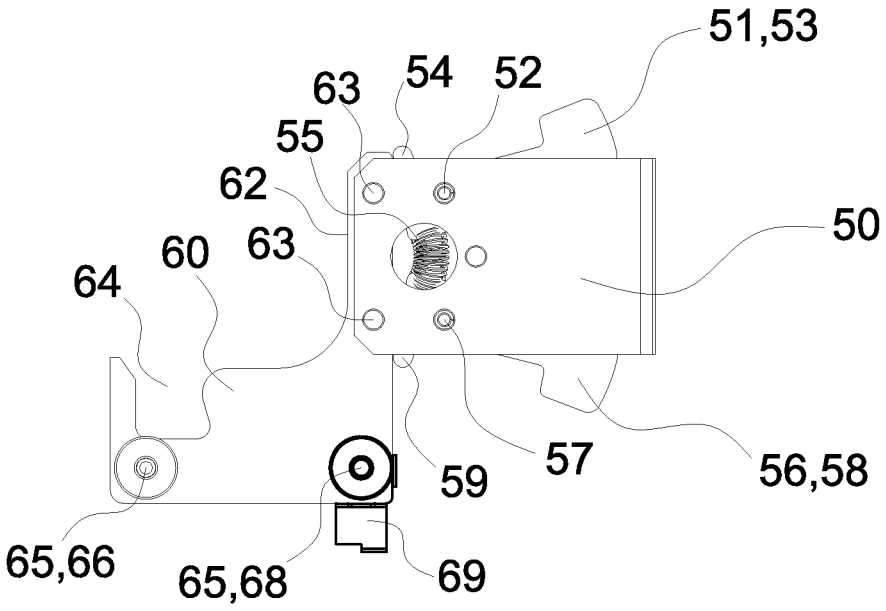
FIG. 7 is an enlarged view of the second side of deadbolt and deadbolt shaft.
Figure 8:
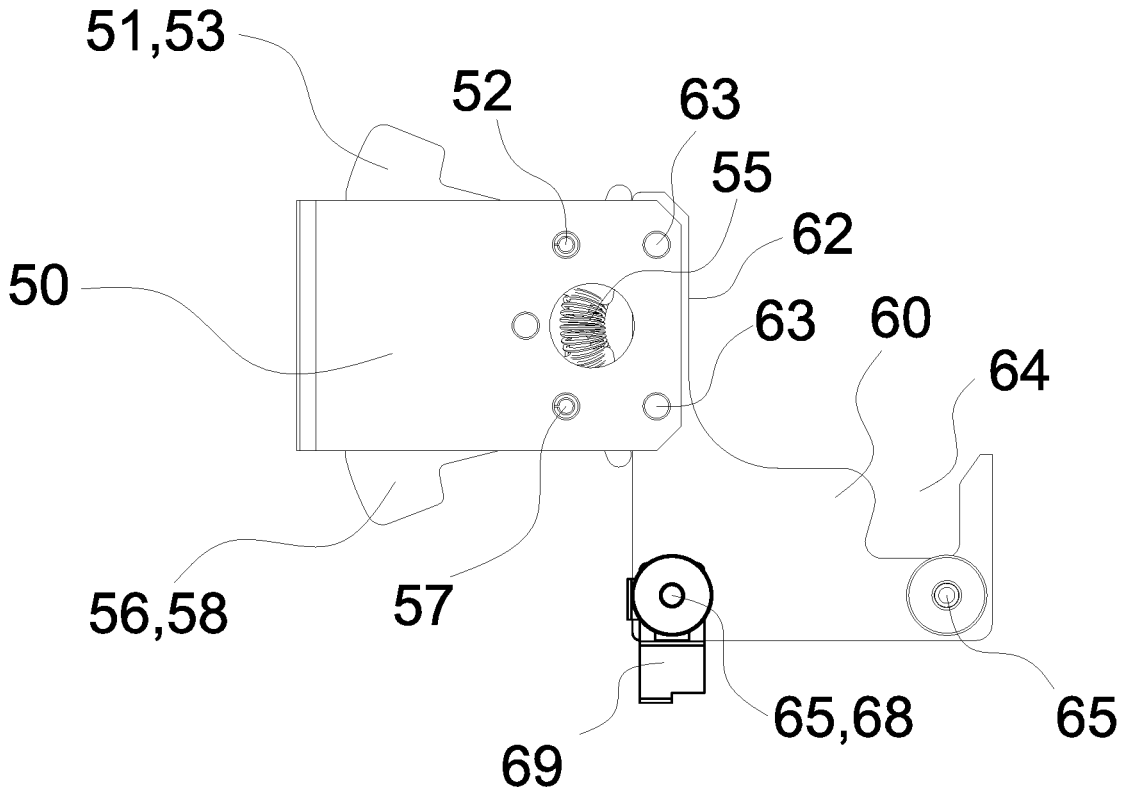
FIG. 8 is an enlarged view of the first side of deadbolt and deadbolt shaft.
Figure 9:
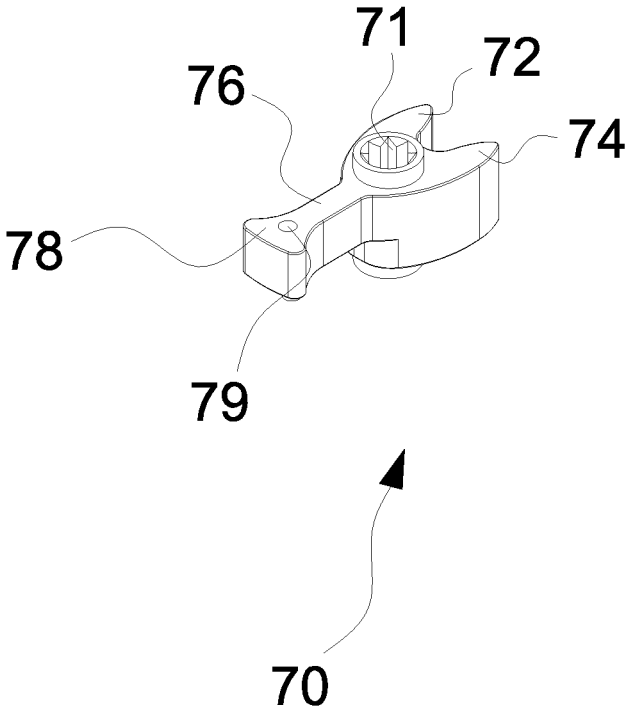
FIG. 9 is an enlarged view of the second side of Y-turn hub.
Figure 10:
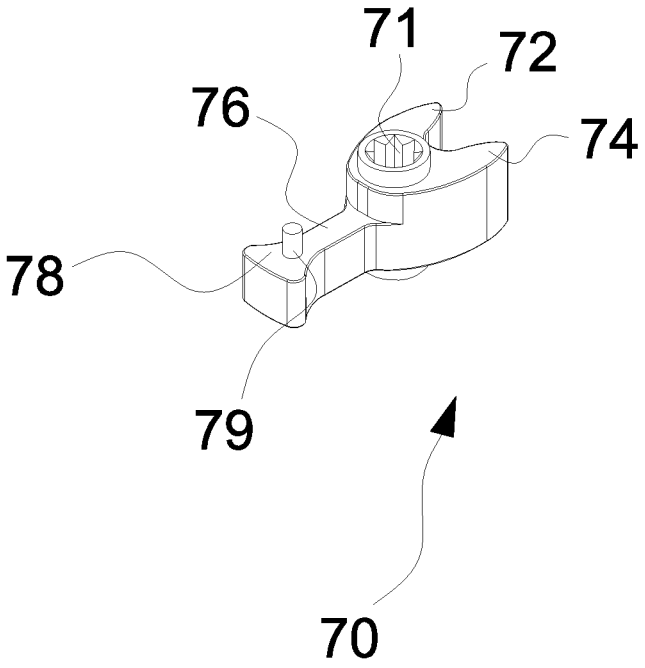
FIG. 10 is an enlarged view of the first side of Y-turn hub.
Figure 11:
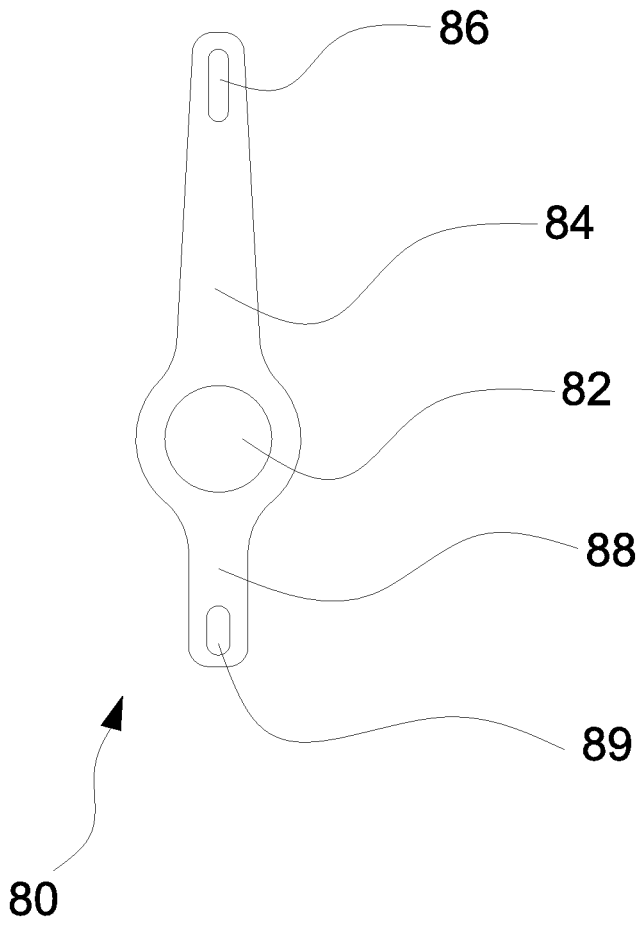
FIG. 11 is an enlarged view of bolt retraction lever.
Figure 12:
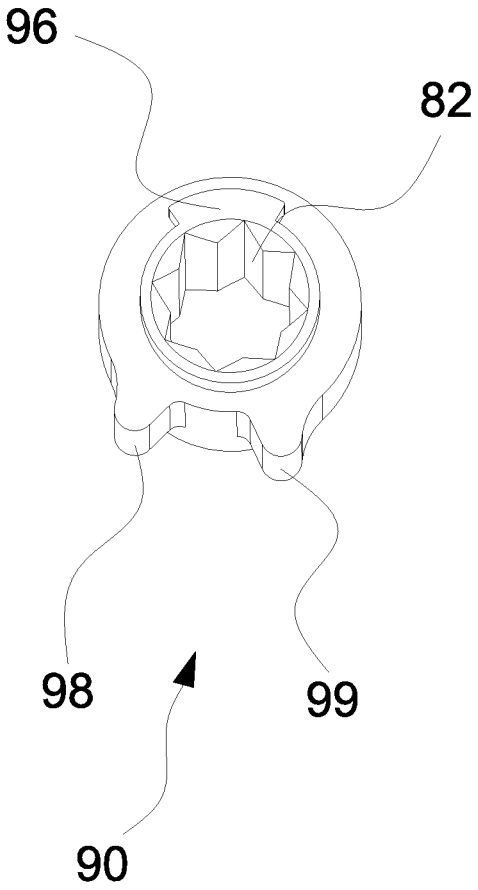
FIG. 12 is an enlarged view of the second side of lever hub.
Figure 13:
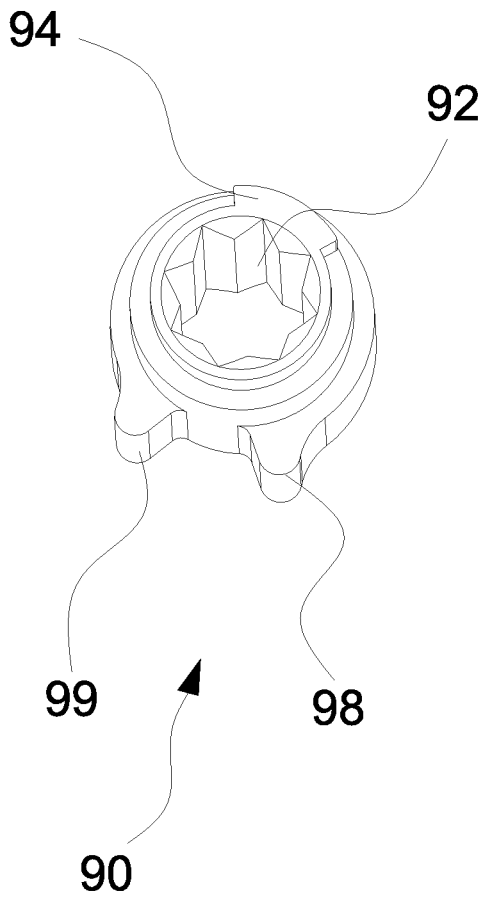
FIG. 13 is an enlarged view of the first side of lever hub.
Figure 14:
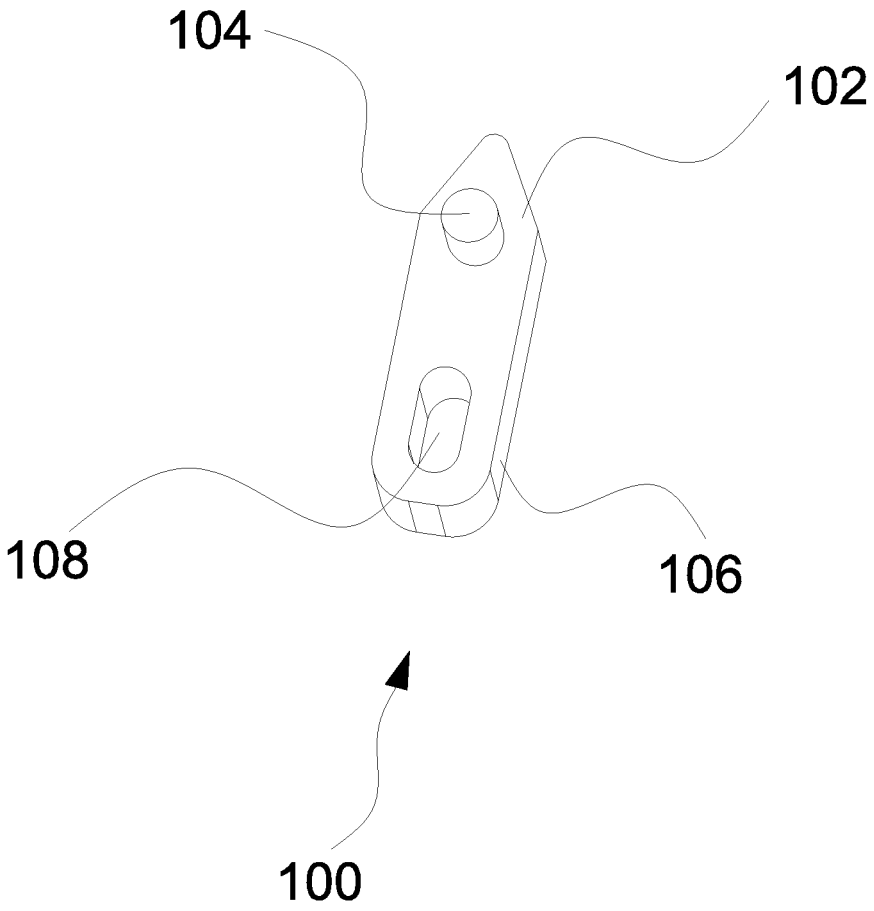
FIG. 14 is an enlarged view of the second side of screw lever.
Figure 15:
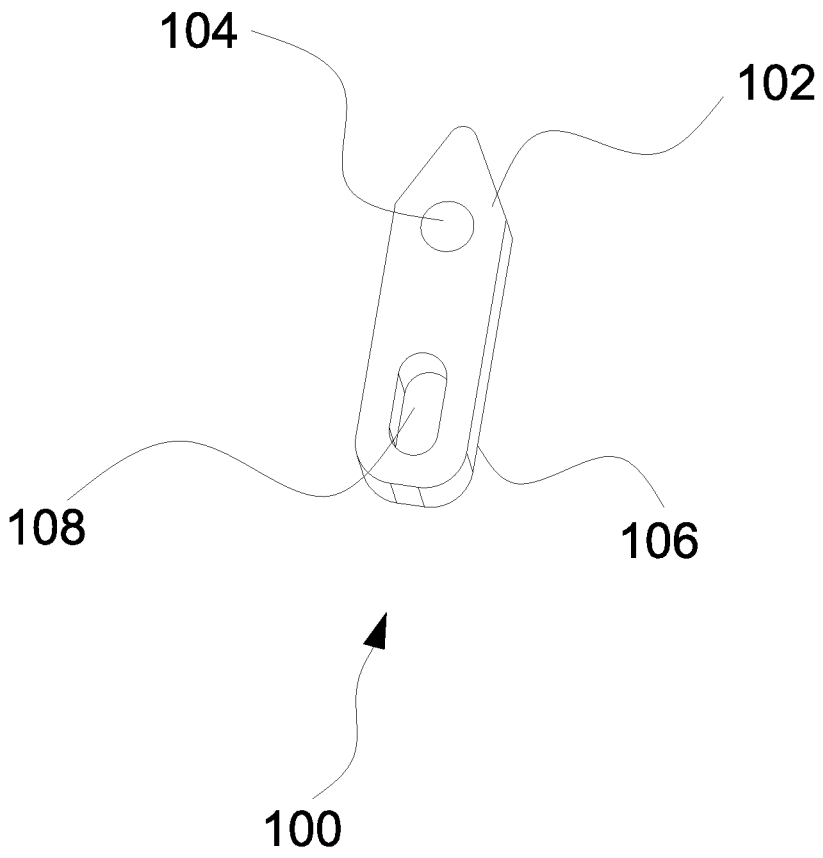
FIG. 15 is an enlarged view of the first side of screw lever.
Figure 16:
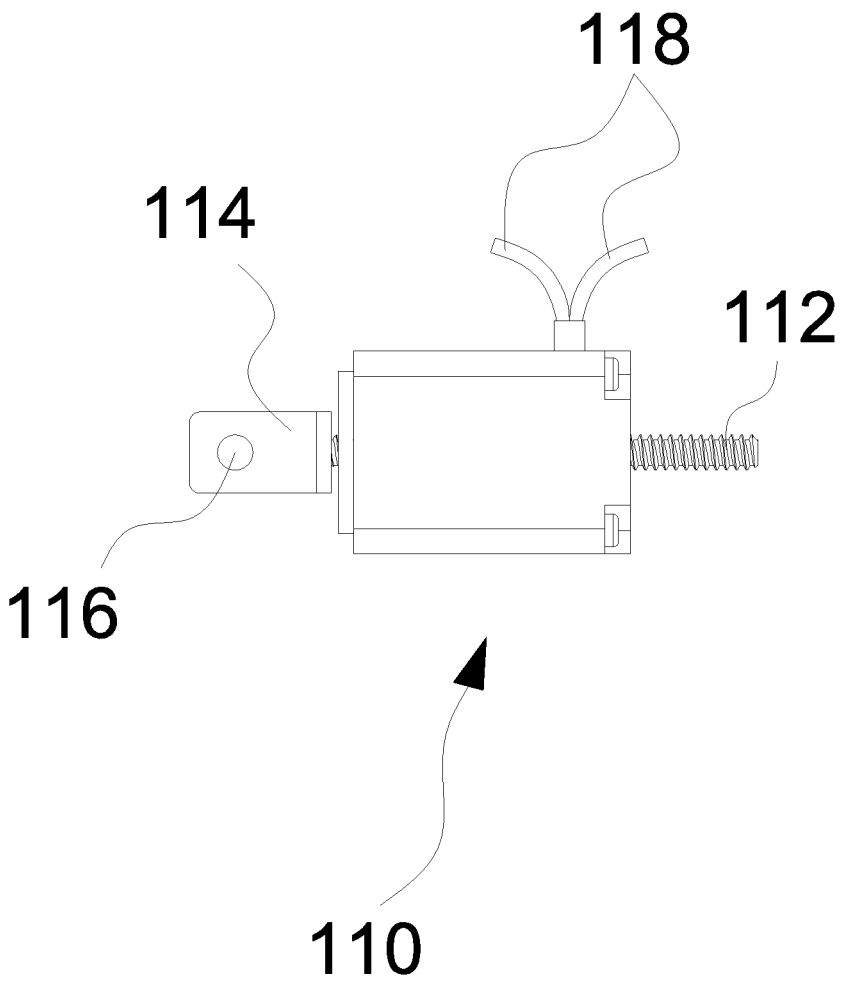
FIG. 16 is an enlarged view of the second side of electric motor.
Figure 17:
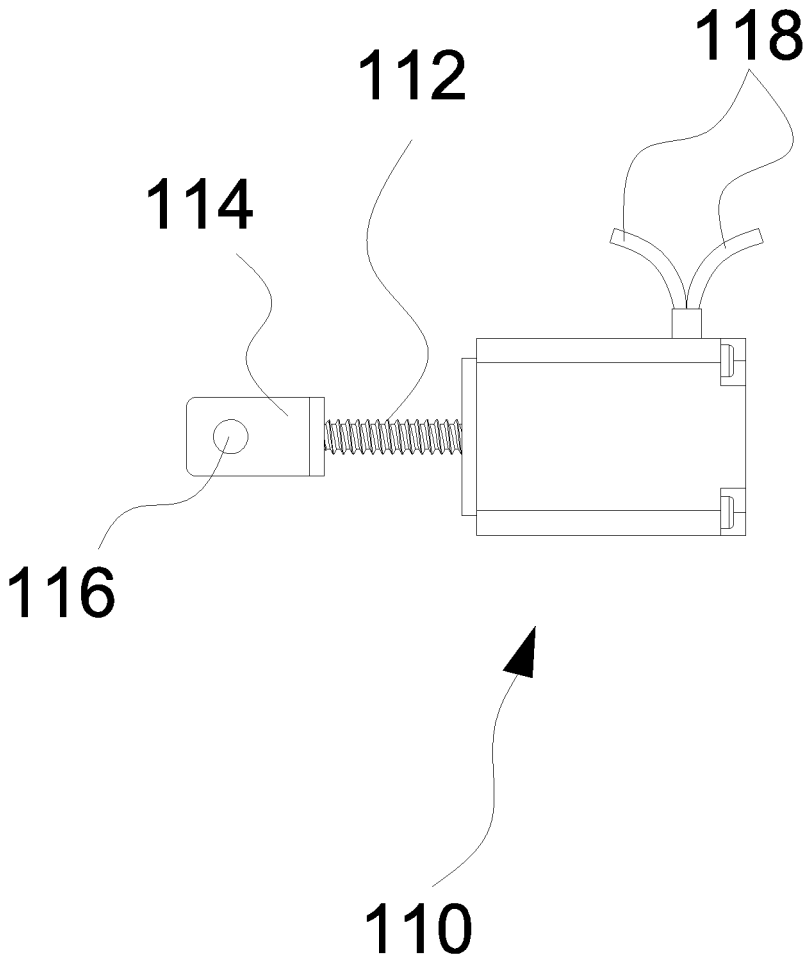
FIG. 17 is an enlarged view of the first side of electric motor.

Deadbolt position indicator 69 is a rigid tab member with an upper end and a lower end. The upper end of deadbolt position indicator 69 is rigidly attached to the opening side slide pin 68 on deadbolt shaft 60 or the lower edge of deadbolt shaft 60. Deadbolt position indicator 69 projects or extends downward from the lower edge of deadbolt shaft 60. The lower end of deadbolt position indicator 69 overlaps mortise lock circuit board 120. The lower end of deadbolt position indicator 69 extends beyond the upper edge of mortise lock circuit board 120 as depicted. Deadbolt position indicator 69 slides toward the retracting side 9 of mortise lock when deadbolt 50 is retracted and deadbolt position indicator 69 slides toward the opening side 8 of mortise lock when deadbolt 50 is extended as depicted. Deadbolt position indicator 69 functions in tandem with deadbolt retracted sensor 124 and deadbolt extended sensor 126 to tell microprocessor, integrated circuit, or chip 122 whether the deadbolt 50 is in the extended position or in the retracted position. When deadbolt 50 is in the retracted position, deadbolt position indicator 69 is located on, adjacent to, or just below deadbolt retracted sensor 124 as depicted in FIG. 5. When deadbolt 50 is in the extended position, deadbolt position indicator 69 is located on, adjacent to, or just below deadbolt extended sensor 126 as depicted in FIG. 6.

Y-turn hub 70 is a hub or center of a wheel or rotating member. Y-turn hub 70 is a rigid member. Y-turn hub 70 comprises: a socket 71; a first arm 72; a second arm 74; a pendulum arm 76; and a pendulum arm pin 79. Socket 71 is a hole through the center of Y-turn hub 70. First arm 72, second arm 74, and pendulum arm 76 are each a rigid protrusions or arms that extends radially outward from socket 71. The rotation of Y-turn hub 70 functions to extend and retract deadbolt 50. Y-turn hub 70 functions to transfer rotational motion from a swing arm (not depicted) on a lock cylinder and/or rotational motion from a thumb turn (not depicted) or coin turn (not depicted) to translational or linear motion of deadbolt shaft 60. The rotation of Y-turn hub 70 causes deadbolt shaft 60 to slide back and forth and deadbolt 50 to extend and retract or latch and unlatch.

Socket 71 is a rigid cylindrical hole through Y-turn hub 70. Socket 71 has open ends. Socket 71 runs thorough the center of Y-turn hub 70. Socket 71 has a first end, a second end, an inner diameter, an inner surface, an outer diameter, an outer surface, and a longitudinal axis. Y-turn hub 70 is pivotally attached to the first side of mortise housing base 10 at the first end of socket 71 and pivotally attached to mortise housing cover plate 40 at the second end of socket 71 so that the longitudinal axis of socket 71 is perpendicular to the planes of first side of mortise housing base 10 and mortise housing cover plate 40. The outer diameter of socket 71 is sized to make a slip fit with the diameter of Y-turn hub mounting hole 14 and Y-turn hub mounting hole 42. The outer surface of socket 71 is smooth. The inner surface of socket 71 has a plurality of points or ridges that function to engage with a square spindle or shaft from a thumb turn (not depicted) or coin turn (not depicted). A spindle or shaft from a thumb turn or coin turn may be inserted and installed through socket 71 to form a connection therewith so that Y-turn hub 70 rotates along with the spindle or shaft from a thumb turn or coin turn. The rotation of Y-turn hub 70 drives the linkage to extend and retract deadbolt 50. A thumb turn or coin turn is not an element of electrified mortise lock for sliding door 2 but is included with a mortise lock set.

First arm 72 is a rigid oblong member or arm protruding radially outward from the exterior surface of socket 71. When Y-turn hub 70 is pivotally attached properly, first arm 72 extends in the direction pointing upwards and towards the towards the opening edge of the first side of mortise housing base 10. First arm 72 has an overall length of about 0.125 to 0.75 inches.

Second arm 74 is a rigid oblong member or arm protruding radially outward from the exterior surface of socket 71. When Y-turn hub 70 is pivotally attached properly, second arm 74 extends in the direction pointing upwards and towards the towards the retracting edge of the first side of mortise housing base 10. Second arm 74 has an overall length of about 0.125 to 0.75 inches.

First and second arms 72,74 engage with a swing arm (not depicted) on a lock cylinder (not depicted) to rotate Y-turn hub 70 as the swing arm on lock cylinder is rotated. When a key or thumb turn rotates lock cylinder, the swing arm on lock cylinder is also rotated, which contacts or collides with first arm 72 when rotated in one direction and contacts or collides with second arm 74 when rotated in the other direction. Thus, when installed into auto-latching/locking mortise lock for sliding door 2, lock cylinder functions to rotate Y-turn hub 70.

Pendulum arm 76 is a rigid oblong member or arm protruding radially outward from the exterior surface of socket 71. When y-turn hub 70 is pivotally attached properly, pendulum arm 76 extends in the direction pointing downwards. Pendulum arm 76 has an overall length of about 0.15 to 1.5 inches. There is a head 78 or wide portion on the radial end of pendulum arm 76. Head 78 has a first side and a second side. When Y-turn hub 70 is pivotally attached properly, the first side of pendulum arm is adjacent to the first side of mortise housing base 10. Head 78 functions to nest within and ride within pendulum arm pocket 64 in deadbolt shaft 60. With this arrangement, deadbolt shaft 60 slides back and forth within deadbolt shaft slot tracks 15,43,44 as pendulum arm 76 rotates back and forth. Pendulum arm 76 functions to slide or laterally move deadbolt shaft 60 as pendulum arm 76 is rotated.

Pendulum arm pin 79 is a rigid solid cylindrical member extending from the head 78 of pendulum arm 76. Pendulum arm pin 79 extends or protrudes perpendicularly outwards from the first side of head 78. Pendulum arm pin 79 has a diameter of about 0.0625 to 0.5 inches and a length of about 0.125 to 0.5 inches. Pendulum arm pin 79 functions to slideably attach head 78 on pendulum arm 76 of Y-turn hub 70 to the upper arm 84 of bolt retraction lever 80. Pendulum arm pin 79 nests within or rides within a pendulum arm pin slot track 86 on bolt retraction lever 80 that causes bolt retraction lever 80 and Y-turn hub 70 to rotate together as either one is rotated or in unison.

Bolt retraction lever 80 is a rigid oblong planar member with a first side, a second side, and a longitudinal axis. Bolt retraction lever 80 is pivotally attached to the first side of socket 92 on lever hub 90 as discussed below. Bolt retraction lever 80 comprises: a pivot hole 82; an upper arm 84; and a lower arm 88. Bolt retraction lever 80 functions to transfer translational or linear motion from screw 112 on electric motor 110 into translation motion of deadbolt shaft 60 and vice versa. The rotation of bolt retraction lever 80 causes deadbolt shaft 60 to slide back and forth, which causes deadbolt 50 to latch and unlatch. The rotation of bolt retraction lever 80 also causes the electric motor 110 to slide back and forth. Bolt retraction lever 80 functions to retract and extend deadbolt 50 to unlatch and latch sliding door.

Pivot hole 82 is a circular hole through the middle section of bolt retraction lever 80. The diameter of pivot hole 82 is sized to make a slip fit with the outer diameter of socket 92 on lever hub 90. Pivot hole 82 is pivotally attached to the outer diameter of socket 92 on lever hub 90 wherein the bolt retraction lever 80 is sandwiched in between lever hub 90 and the first side of mortise housing base 10. As discussed below, lever hub 90 is pivotally attached to lever hub mounting hole 16 and lever hub mounting hole 45, wherein bolt retraction lever 80 and lever hub 90 may rotate independently from each other.

Upper arm 84 is a rigid oblong member or arm protruding radially outward from pivot hole 82. Upper arm 84 has a width, a length, and a longitudinal axis. Upper arm 84 has a width of about 0.25 to 1.0 inches and a length of about 2 to 4 inches. When bolt retraction lever 80 is pivotally attached properly, upper arm 84 extends and points upwards towards the upper side of mortise housing base 10. The radial end of upper arm 84 has a pendulum arm pin slot track 86. Pendulum arm pin slot track 86 is an oblong hole or slot in upper arm 84. Pendulum arm pin slot track 86 has a width, a length, and a longitudinal axis. The width of pendulum arm pin slot track 86 is about 0.0625 to 0.5 inches. The length of pendulum arm pin slot track 86 is about 0.25 to 1.5 inches. The longitudinal axis of pendulum arm pin slot track 86 is parallel with that of upper arm 84. Pendulum arm pin slot track 86 functions to engage with pendulum arm pin 79 on Y-turn hub 70. Pendulum arm pin 79 on Y-turn hub 70 nests within or rides within pendulum arm pin slot track 86. Pendulum arm pin 79 slides within pendulum arm pin slot track 86 but never leaves or escapes from pendulum arm pin slot track 86 and therefore bolt retraction lever 80 rotates with Y-turn hub 70 and vice versa.

Lower arm 88 is a rigid oblong member or arm protruding radially outward from pivot hole 82. Lower arm 88 has a width, a length, and a longitudinal axis. Lower arm 88 has a width of about 0.25 to 1.0 inches and a length of about 0.5 to 1.5 inches. When bolt retraction lever 80 is pivotally attached properly, lower arm 88 extends and points downwards towards the lower side of mortise housing base 10. The longitudinal axis of upper arm 84 is parallel with that of lower arm 88. The radial end of lower arm 88 has a screw bracket pin slot track 89. Screw bracket pin slot track 89 is an oblong hole or slot in lower arm 88. Screw bracket pin slot track 89 has a width, a length, and a longitudinal axis. The width of screw bracket pin slot track 89 is about 0.0625 to 0.5 inches. The length of screw bracket pin slot track 89 is about 0.125 to 0.5 inches. The longitudinal axis of screw bracket pin slot track 89 is parallel with that of lower arm 88. Screw bracket pin slot track 89 functions to engage with screw bracket pin 116 on electric motor 110. Screw bracket pin 116 nests within or rides within screw bracket pin slot track 89. Screw bracket pin 116 slides within screw bracket pin slot track 89 but never leaves or escapes from screw bracket pin slot track 89 and therefore bolt retraction lever 80 rotates as screw 112 on electric motor 110 slides laterally and vice versa.

Lever hub 90 is a hub or center of a wheel or rotating member. Lever hub 90 is a rigid member. Lever hub 90 has a first side and a second side. Lever hub 90 comprises: a socket 92; a first key tab 94; a second key tab 96; a first ridge 98; and a second ridge 99. Socket 92 is a hole through the center of lever hub 90. First key tab 94 is a rigid protrusion or tab that extends radially outward from the first side of lever hub 90. Second key tab 96 is a rigid protrusion or tab that extends radially outward from the second side of lever hub 90. First ridge 98 is a rigid oblong member or arm protruding outward from socket 92. Second ridge 99 is a rigid oblong member or arm protruding outward from socket 92. The first side of lever hub 90 is pivotally attached to lever hub mounting hole 16 on the first side of mortise housing base 10. The second side of lever hub 90 is pivotally attached to lever hub mounting hole 45 on mortise housing cover plate 40. Lever hub 90 functions to transfer rotational motion from the interior door knob (not depicted) or interior door lever (not depicted) to rotational motion on screw lever 100 as discussed below. The rotation of lever hub 90 functions to extend and retract deadbolt 50 as discussed below.

Socket 92 is a rigid cylindrical hole through lever hub 90. Socket 92 has open ends. Socket 92 runs thorough the center of lever hub 90. Socket 92 has a first end, a second end, an inner diameter, an inner surface, an outer diameter, an outer surface, and a longitudinal axis. Lever hub 90 is pivotally attached to the first side of mortise housing base 10 and mortise housing cover plate 40 so that the longitudinal axis of socket 92 is perpendicular to the planes of first side of mortise housing base 10 and mortise housing cover plate 40. The outer diameter of socket 92 is sized to make a slip fit with the diameters of lever hub mounting holes 16,45. The outer surface of socket 92 is smooth. The inner surface of socket 92 has a plurality of points or ridges that function to engage with a square spindle or shaft from a door knob (not depicted) or door lever (not depicted). A spindle or shaft from the interior door knob or door lever is inserted and installed through socket 92 to engage and connect therewith so that lever hub 90 rotates along with the spindle or shaft from the interior door knob or door lever. The first end or second end of the socket 92 may be on the interior side or adjacent to in the interior of the room. Thus, the spindle or shaft from the interior door knob or door lever may be inserted and installed into the first end or the second end of socket 92. The exterior door knob would not engage with or connect to socket 92 or lever hub 90. The exterior door knob does not have a spindle and simply would be attached to the exterior door face or the exterior door trim without any connection to lever hub 90. The interior and exterior door knobs or door levers are not elements of electrified mortise lock for sliding door 2 but are included with a mortise lock set.

First key tab 94 is a rigid tab, protrusion, or catch that extends or protrudes radially outward from the outer diameter of socket 92 on the first side of lever hub 90. First key tab 94 nests within key notch 17 on the first side of mortise housing base 10 to pivotally attach or slideably attach therein. First key tab 94 has a width. First key tab 94 has an opening side and a retracting side. The width of key notch 17 must be larger than that of first key tab 94 so that first key tab 94 may slide back and forth or rotate back and forth within key notch 17. First key tab 94 functions to contact or catch on key notch 17 and thereby limit the rotation of lever hub 90 within lever hub mounting hole 16. When lever hub 90 is rotated one way, the opening side of first key tab 94 contacts the opening end of key notch 17 to prevent any more rotation of lever hub 90 beyond this contact. When lever hub 90 is rotated the other way, the retracting side of first key tab 94 contacts the retracting end of key notch 17 to prevent any more rotation of lever hub 90 beyond this contact point.

Second key tab 96 is a rigid tab, protrusion, or catch that extends or protrudes radially outward from the outer diameter of socket 92 on the second side of lever hub 90. Second key tab 96 nests within key notch 46 on mortise housing cover plate 40 to pivotally attach or slideably attach therein. Second key tab 96 has a width. Second key tab 96 has an opening side and a retracting side. The width of key notch 46 must be larger than that of second key tab 96 so that second key tab 96 may slide back and forth or rotate back and forth within key notch 46. Second key tab 96 functions to contact or catch on key notch 46 and thereby limit the rotation of lever hub 90 within lever hub mounting hole 45. When lever hub 90 is rotated one way, the opening side of second key tab 96 contacts the opening end of key notch 46 to prevent any more rotation of lever hub 90 beyond this contact. When lever hub 90 is rotated the other way, the retracting side of second key tab 96 contacts the retracting end of key notch 46 to prevent any more rotation of lever hub 90 beyond this contact point.

First ridge 98 is a rigid oblong protrusion or rib extending outward from the outer surface of socket 92. First ridge 98 has a width, a length, a height, and a longitudinal axis. The height of first ridge 98 is about 0.0625 to 0.25 inches. The longitudinal axis of first ridge 98 is parallel with that of socket 92. First ridge 98 is located on the lower half of lever hub 90. When lever hub 90 is pivotally attached properly, first ridge 98 protrudes, extends, or points downwards towards the corner between the retracting side of mortise housing base 10 and the lower side of mortise housing base 10. First ridge 98 engages with the upper end 102 of screw lever 100 and functions as a stop or limiter to prevent the upper end 102 of screw lever 100 from rotating beyond first ridge 98. When electrified mortise lock for sliding door 2 is functioning properly, upper end 102 remains on the opening side of first ridge 98, in between first ridge 98 and second ridge 99.

Second ridge 99 is a rigid oblong protrusion or rib extending outward from the outer surface of socket 92. Second ridge 99 has a width, a length, a height, and a longitudinal axis. The height of second ridge 99 is about 0.0625 to 0.25 inches. The longitudinal axis of second ridge 99 is parallel with that of socket 92. Second ridge 99 is located on the lower half of lever hub 90. When lever hub 90 is pivotally attached properly, second ridge 99 protrudes, extends, or points downwards towards the corner between the mortise housing face plate 30 and the lower side of mortise housing base 10. Second ridge 99 engages with the upper end 102 of screw lever 100 and functions as a stop or limiter to prevent the upper end 102 of screw lever 100 from rotating beyond second ridge 99. When electrified mortise lock for sliding door 2 is functioning properly, upper end 102 remains on the retracting side of second ridge 99, in between first ridge 98 and second ridge 99.

Screw lever 100 is a rigid oblong member, arm, or lever. Screw lever 100 has a first side, a second side, a width, a length, and a longitudinal axis. Screw lever 100 has a width of about 0.25 to 0.5 inches and a length of about 0.5 to 1.5 inches. Screw lever 100 functions to transfer rotational motion from lever hub 90 to translational or linear motion of screw 112 and vice versa. Screw lever 100 comprises: an upper end 102; a pivot pin 104; a lower end 106; and a screw bracket pin slot track 108. Screw lever 100 is pivotally attached to mortise housing cover plate 40 at pivot pin 104. Thus, screw lever 100 pivots about pivot pin 104. When screw lever 100 is pivotally attached properly, upper end 102 extends or points upwards and lower end 106 extends or points downwards. The upper end 102 is the upper end of screw lever 100 as depicted. The lower end 106 is the lower end of screw lever 100 as depicted.

Pivot pin 104 is a solid rigid horizontal cylindrical member with a diameter, a length, a first end, a second end, and a longitudinal axis. Pivot pin 104 has a diameter of about 0.0625 to 0.5 inches. The length of pivot pin 104 is about 0.0625 to 0.5 inches. The first end of pivot pin 104 is rigidly attached to the second side of the upper end 102 of screw lever 100 with its longitudinal axis perpendicular to that of screw lever 100 as depicted. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of Pivot pin 104 into a hole in the second side of screw lever 100. The second end of pivot pin 104 is pivotally attached to within screw lever pivot pin mounting hole 49 in mortise housing cover plate 40. Screw lever 100 pivots about this pivotal connection.

Screw bracket pin slot track 108 is an oblong hole or slot in lower end 106. Screw bracket pin slot track 108 has a width, a length, and a longitudinal axis. The width of screw bracket pin slot track 108 is about 0.0625 to 0.5 inches. The length of screw bracket pin slot track 108 is about 0.0625 to 0.5 inches. The length of screw bracket pin slot track 108 must be longer than the width of screw bracket pin 116. The longitudinal axis of screw bracket pin slot track 108 is parallel with that of screw lever 100. Screw bracket pin slot track 108 functions to engage with screw bracket pin 116 on screw bracket 114. Screw bracket pin 116 nests within or rides within screw bracket pin slot track 108. Screw bracket pin 116 slides within screw bracket pin slot track 108 but never leaves or escapes from screw bracket pin slot track 108 and therefore screw lever 100 rotates as screw bracket 114 and screw bracket pin 116 move linearly and vice versa.

Note that electrified mortise lock for sliding door 2 may be operated manually to extend and retract deadbolt 50 without any electrical power. Using the above referenced elements and without using any elements listed below, deadbolt 50 may be manually retracted and extended by rotating a thumb turn or a coin turn engaged with Y-turn hub 70. To extend deadbolt 50 from the retracted position, a thumb turn or a coin turn is rotated towards the retracting side 9 of mortise lock, which rotates pendulum arm 76 towards the opening side 8 of mortise lock, which rotates upper arm 84 towards the opening side 8 of mortise lock, which slides deadbolt shaft 60 towards the opening side 8 of mortise lock, which extends deadbolt 50 into the extend position. To retract deadbolt 50 from the extended position, a thumb turn or a coin turn is rotated towards the opening side 8 of mortise lock, which rotates pendulum arm 76 towards the retracting side 9 of mortise lock, which rotates upper arm 84 towards the retracting side 9 of mortise lock, which slides deadbolt shaft 60 towards the retracting side 9 of mortise lock, which retracts deadbolt 50 into the retracted position.

Also deadbolt 50 may be manually retracted by rotating the interior door knob or door lever engaged with lever hub 90. To retract deadbolt 50 from the extended position, the interior door knob or door lever is rotated towards the opening side 8 of mortise lock, which rotates the lower end 106 of screw lever 100 towards the opening side 8 of mortise lock, which rotates the lower arm 88 of bolt retraction lever 80 towards the opening side 8 of mortise lock, which rotates upper arm 84 towards the retracting side 9 of mortise lock, which slides deadbolt shaft 60 towards the retracting side 9 of mortise lock, which retracts deadbolt 50 into the retracted position. The rotation of lever hub 90 drives the linkage to extend and retract deadbolt 50. Thus, persons in the interior of the room can always exit the room even without connecting mortise lock for sliding door 2 to an electrical power source.

Electric motor 110 is an electric motor with a first side, a second side, an upper side, a lower side, an opening side, and a retracting side. An electric motor is an electrical machine that converts electrical energy into mechanical energy. An electric motor has a stator and a rotor. The stator has a hollow center with the rotor is installed within. The stator remains stationary while the rotor rotates within the stator when the electric motor is powered or energized. The rotor has a female threaded cavity or cylindrical cavity with thread on the cavity's inner surface. A particular type of electric motor is used with electrified mortise lock for sliding door 2, where the rotor has female threads that engage male thread on the exterior of a screw 112. When electric motor 110 is powered or energized to rotate the rotor, the rotor engages with screw 112 to extend or retract screw 112. When electric motor 110 rotates one way, the rotor forces screw 112 to extend in one direction. When electric motor 110 rotates the other way, the rotor forces screw 112 to extend in the other direction. With this type of electric motor, the rotor rotates to retract and extend screw 112. In best mode, electric motor 110 is a screw stepper motor. Any known type of screw stepper motor may be used.

Electric motor 110 is rigidly attached to electric motor mounting hole 18 on mortise housing base 10 and electric motor mounting hole 47 in mortise housing cover plate 40 so that electric motor 110 remains stationary relative to mortise housing base 10 and mortise housing cover plate 40. Electric motor 110 is positioned within or nested within mounting holes 18,47 so that electric motor 110 is retained within mounting holes 18,47. When installed, the first side of electric motor 110 may extend slightly through electric motor mounting hole 47 in mortise housing cover plate 40 and the second side of electric motor 110 may extend slightly through electric motor mounting hole 47 in mortise housing cover plate 40.

Electric motor 110 further comprises: a screw 112; a screw bracket 114; a screw bracket pin 116; and power wires 118.

Screw 112 is a rigid solid oblong member with an opening end, a retracting end, a length, an exterior surface, and a longitudinal axis. The exterior surface of screw 112 has male thread or pipe thread that extend along the full length of screw 112. The male thread is sized to engage with the female thread on rotor. When electric motor 110 is installed properly, the longitudinal axis of screw 112 is parallel with the planes of the upper and lower sides of mortise housing base 10 and perpendicular to the plane of mortise housing face plate 30 as depicted. When electric motor 110 is powered to rotate one way, the opening end of screw 112 laterally moves toward the opening side 8 of mortise lock and protrudes out of and extends out of the opening side of electric motor 110. When electric motor 110 is powered to rotate the other way, the retracting end of screw 112 laterally moves toward the retracting side 9 of mortise lock and protrudes out of and extends out of the retracting side of electric motor 110. Thus, screw 112 moves linearly left and right through electric motor 110 as depicted. Screw 112 is connected to the lower arm 88 of bolt retraction lever 80 to cause bolt retraction lever 80 to rotate as screw 112 is moved laterally. Screw 112 is also connected to the lower end 106 of screw lever 100 to also cause screw lever 100 to rotate as screw 112 is moved laterally.

Screw bracket 114 is a bracket that functions to rigidly connect or attach screw bracket pin 116 to the retracting end of screw 112. Screw bracket 114 is a rigid oblong member with an opening end and a retracting end. The opening end of screw bracket 114 is rigidly attached to the retracting end of screw 112. The retracting end of screw bracket 114 is rigidly attached to screw bracket pin 116.

Screw bracket pin 116 is a solid rigid horizontal cylindrical member with a diameter, a length, a first end, a second end, and a longitudinal axis. Screw bracket pin 116 has a diameter of about 0.0625 to 0.5 inches. The length of screw bracket pin 116 is equal to the width of upper side of mortise housing base 10. Screw bracket pin 116 is rigidly attached to the retracting end of screw bracket 114. The longitudinal axis of screw bracket pin 116 is perpendicular to the planes of the upper and lower sides of mortise housing base 10 as depicted. Screw bracket pin 116 functions to pivotally attached to lever hub 90 and screw lever 100 to screw bracket 114. Screw bracket pin 116 is slideably attached to screw bracket pin slot track 89 on bolt retraction lever 80 and screw bracket pin slot track 108 on screw lever 100. Screw bracket pin 116 nests within or rides within screw bracket pin slot tracks 89,108. Screw bracket pin 116 slides within screw bracket pin slot track 89,108 but never leaves or escapes from screw bracket pin slot track 89,108 and therefore lever hub 90 and screw lever 100 rotate as screw bracket 114 and screw bracket pin 116 move linearly and vice versa.

Power wires 118 on electric motor 110 are electrical wires that are used to power the electric motor 110. Electrical power or current passes through power wires 118 in order to power electric motor 110 or cause electric motor to spin the rotor, which in turn causes screw 112 to extend and retract. Power wires 118 have a first end and a second end. The first end of power wires 118 attached to or connected to electric motor 110 so that there is electrical continuity between these members. The second end of power wires 118 is attached to or connected to mortise lock circuit board 120 so that there is electrical continuity between these members Mortise lock circuit board 120 is a printed circuit board that supports and electrically connects electronic or electrical components attached to the circuit board using conductive tracks, pads, solder, or other features etched or laminated onto the circuit board so that there is electrical continuity between these electronic or electrical components. Mortise lock circuit board 120 has a first side, a second side, an upper edge, a lower edge, an opening edge, and a retracting edge. Mortise lock circuit board 120 is rigidly attached to circuit board mounting pillars 21 on mortise housing base 10. In best mode, mortise lock circuit board 120 is rigidly attached to circuit board mounting pillars 21 with mortise housing screws 26. Mortise lock circuit board 120 further comprises: a microprocessor, integrated circuit, or chip 122; a deadbolt retracted sensor 124; a deadbolt extended sensor 126; a positive power wire 128; and a negative power wire 129.

Microprocessor, integrated circuit, or chip 122 is an integrated circuit or monolithic integrated circuit, also referred to as an "IC", a chip, or a microchip that is a set of electronic circuits on one small flat piece of semiconductor material. Microprocessor, integrated circuit, or chip 122 has read only memory and random access memory. A special and custom operating software is loaded into the read only memory that may be updated through a wireless network connection or other network connection. Microprocessor, integrated circuit, or chip 122 is attached to or connected to mortise lock circuit board 120 so that there is electrical continuity between these members.

Deadbolt retracted sensor 124 is an electronic sensor that functions to detect deadbolt position indicator 69. Deadbolt retracted sensor 124 is attached to or connected to mortise lock circuit board 120 so that there is electrical continuity between these members. When deadbolt position indicator 69 is within a few millimeters of deadbolt retracted sensor 124, deadbolt retracted sensor 124 detects this and indicates this to the microprocessor, integrated circuit, or chip 122 through is electrical connection with mortise lock circuit board 120. Deadbolt retracted sensor 124 is located on the upper edge of mortise lock circuit board 120 adjacent to the retracting edge of mortise lock circuit board 120. Any known type of electronic sensor that performs this function may be used.

Deadbolt extended sensor 126 is an electronic sensor that functions to detect deadbolt position indicator 69. Deadbolt extended sensor 126 is attached to or connected to mortise lock circuit board 120 so that there is electrical continuity between these members. When deadbolt position indicator 69 is within a few millimeters of deadbolt extended sensor 126, deadbolt extended sensor 126 detects this and indicates this to the microprocessor, integrated circuit, or chip 122 through is electrical connection with mortise lock circuit board 120. Deadbolt extended sensor 126 is located on the upper edge of mortise lock circuit board 120 adjacent to the opening edge of mortise lock circuit board 120. Any known type of electronic sensor that performs this function may be used.

Electrical power is supplied to mortise lock circuit board 120 in order to power electrified mortise lock for sliding door 2. As stated, microprocessor, integrated circuit, or chip 122 receives electrical power from mortise lock circuit board 120 and electric motor receives electrical power from mortise lock circuit board 120. Mortise lock circuit board 120 receives electrical power from positive power wire 128 and negative power wire 129. In best mode, mortise lock circuit board 120 is powered by direct current electrical power.

Positive power wire 128 on mortise lock circuit board 120 is a length of electrical wire that is used to power mortise lock circuit board 120. Electrical power or current passes through positive power wire 128 in order to power mortise lock circuit board 120. Positive power wire 128 has a first end and a second end. The first end of positive power wire 128 is attached to or connected to mortise lock circuit board 120 so that there is electrical continuity between these members. The second end of positive power wire 128 is connected to a power source that may be: a battery, a building power wire, an external control unit, a user interface, or a positive power contact 134 on a power transfer unit 130.

Negative power wire 129 on mortise lock circuit board 120 is a length of electrical wire that is used to power mortise lock circuit board 120. Electrical power or current passes through negative power wire 129 in order to power mortise lock circuit board 120. Negative power wire 129 has a first end and a second end. The first end of negative power wire 129 is attached to or connected to mortise lock circuit board 120 so that there is electrical continuity between these members. The second end of negative power wire 129 is connected to a power source that may be: a battery, a building power wire, an external control unit, a user interface, or a negative power contact 136 on a power transfer unit 130.

The special and custom operating software loaded onto microprocessor, integrated circuit, or chip 122 controls electrified mortise lock for sliding door 2. The special and custom operating software loaded onto microprocessor, integrated circuit, or chip 122 is the brain that operates electrified mortise lock for sliding door 2 and causes deadbolt 50 to electrically extend and retract. Positive and negative power wires 128,129 are energized with electrical power and de-energized or turned off to control and operate the electrified mortise lock for sliding door 2. Microprocessor, integrated circuit, or chip 122 is only powered intermittently. When at rest, microprocessor, integrated circuit, or chip 122 does not receive electrical power. Integrated circuit, or chip 122 is only powered on when the deadbolt 50 is required to electrically move. When positive and negative power wires 128,129 are energized to deliver electrical current to microprocessor, integrated circuit, or chip 122, the special and custom operating software first checks to see if the deadbolt 50 is extended or retracted as indicated by the position of the deadbolt position indicator 69 and detected by deadbolt sensors 124,126. If deadbolt 50 starts from the extended position, the special and custom operating software causes deadbolt 50 to retract, by powering on electric motor 110 to rotate its rotor and cause the retracting end of screw 112 to travel towards the opening side 8 of mortise lock, which rotates lower arm 88 towards the opening side 8 of mortise lock, which rotates upper arm 84 towards the retracting side 9 of mortise lock, which slides deadbolt shaft 60 towards the retracting side 9 of mortise lock, which retracts deadbolt 50 into the retracted position. If deadbolt 50 starts from the retracted position, the special and custom operating software causes deadbolt 50 to extend, by powering on electric motor 110 to rotate its rotor and cause the retracting end of screw 112 to travel towards the retracting side 9 of mortise lock, which rotates lower arm 88 towards the retracting side 9 of mortise lock, which rotates upper arm 84 towards the opening side 8 of mortise lock, which slides deadbolt shaft 60 towards the opening side 8 of mortise lock, which extends deadbolt 50 into the extended position. There is an external control unit (not depicted) that sends power to electrified mortise lock for sliding door 2. The external control unit is not an element of electrified mortise lock for sliding door 2. The external control unit sends power to the microprocessor, integrated circuit, or chip 122 through positive and negative power wires 128,129. This external control unit uses a user interface or human interface to control electrified mortise lock for sliding door 2 and send power to retract and extend deadbolt 50. This user interface or human interface could be: an electrical switch, a lock cylinder, a keyboard, a pin pad, a fingerprint scanner, a retinal scanner, or any other known type of user interface to control access to electrified mortise lock for sliding door 2 and send power to microprocessor, integrated circuit, or chip 122 in order to retract and extend deadbolt 50.

Electrified mortise lock for sliding door 2 may further comprise a power transfer unit 130. Power transfer unit 130 is special electrical connector that is rigidly attached to the sliding door or alternately located inside electrified mortise lock for sliding door 2. Power transfer unit 130 is an electrical connector that helps electrically connect microprocessor, integrated circuit, or chip 122 to the external control unit. Power transfer unit 130 electrically connects the second end of positive power wire 128 to a positive power contact 144 on a power unit 140 so that there is electrical continuity between these members. Power transfer unit 130 also electrically connects the second end of negative power wire 129 to a negative power contact 146 on a power unit 140 so that there is electrical continuity between these members.

Figure 18:
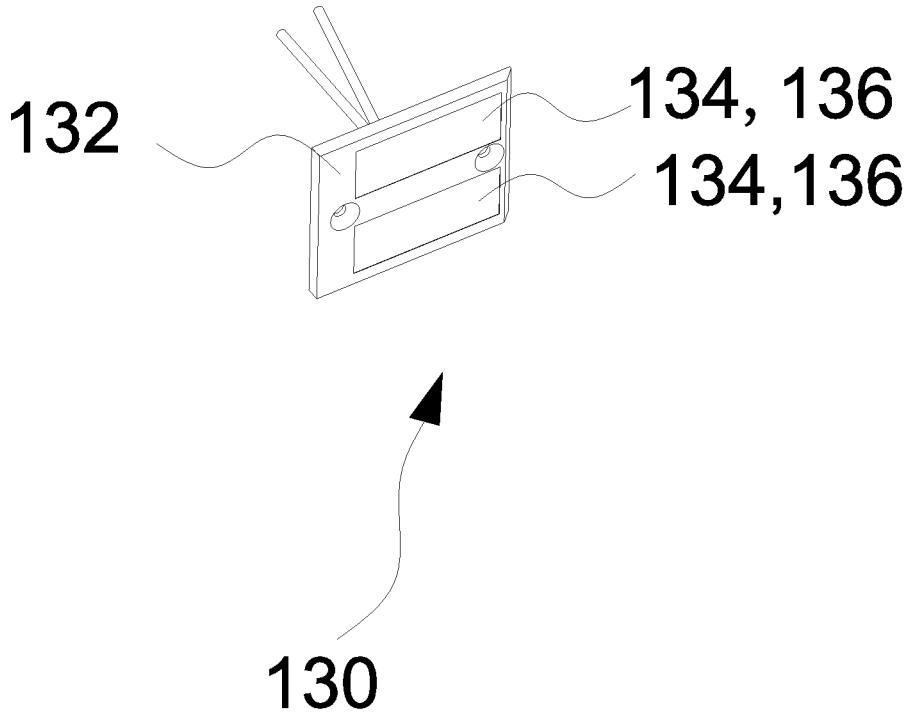
FIG. 18 is an enlarged view of power transfer unit.

Power transfer unit 130 comprises: a base 132; a positive power contact 134; and a negative power contact 136. Base 132 is a rigid planar member that supports positive power contact 134 and negative power contact 136. Base 132 is rigidly attached to the upper side of sliding door or rigidly attached to mortise housing base 10 or mortise housing face plate 30. A power transfer unit 130 attached to the sliding door is depicted in FIG. 18. A power transfer unit 130 attached to mortise housing base 10 or mortise housing face plate 30 is depicted in FIGS. 20-24C. Rigid attachment may be accomplished by any known means such as: pressed fit, pressed seam, weld, glue, epoxy, adhesive, bolts, screws, rivets, clips, snaps, pins, or fasteners. Positive power contact 134 is an electrical contact or piece of electrically conductive material such as metal. Positive power contact 134 is rigidly attached to base 132 by any known means. Positive power contact 134 is connected to the second end of positive power wire 128 so that there is electrical continuity between these members. Negative power contact 136 is an electrical contact or piece of electrically conductive material such as metal. Negative power contact 136 is rigidly attached to base 132 by any known means. Negative power contact 136 is connected to the second end of negative power wire 129 so that there is electrical continuity between these members.

Figure 19:
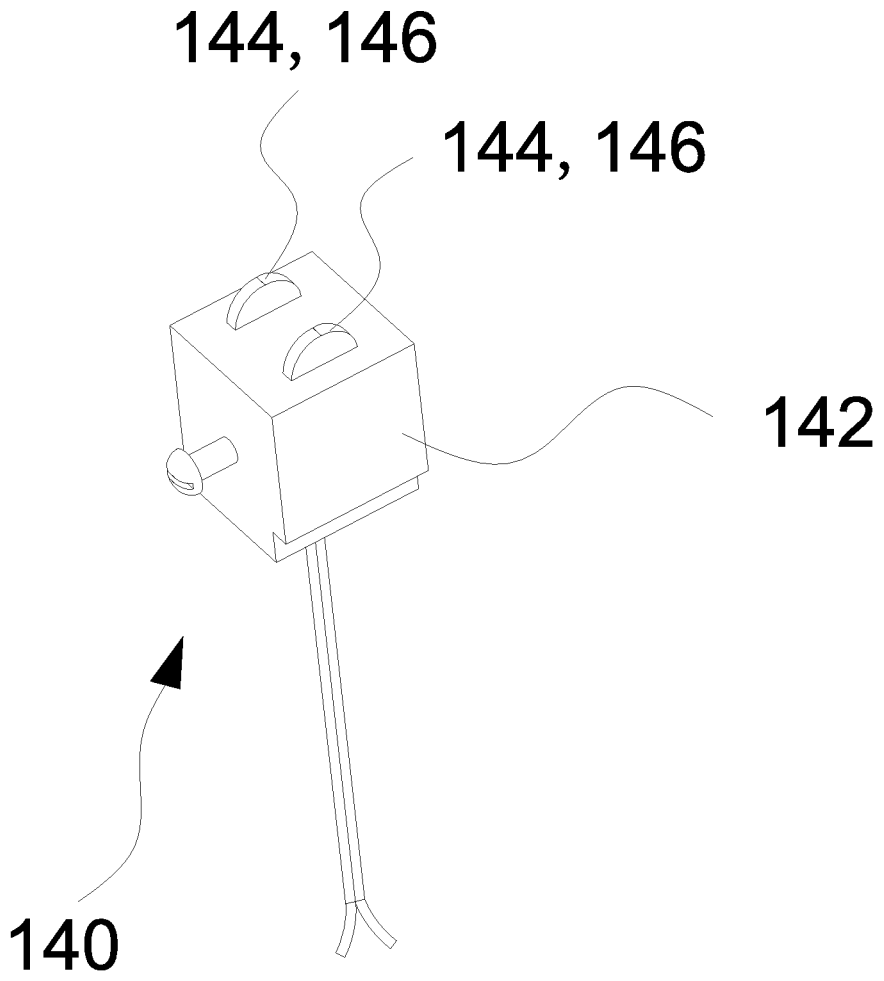
FIG. 19 is an enlarged view of power unit.
Figure 20:
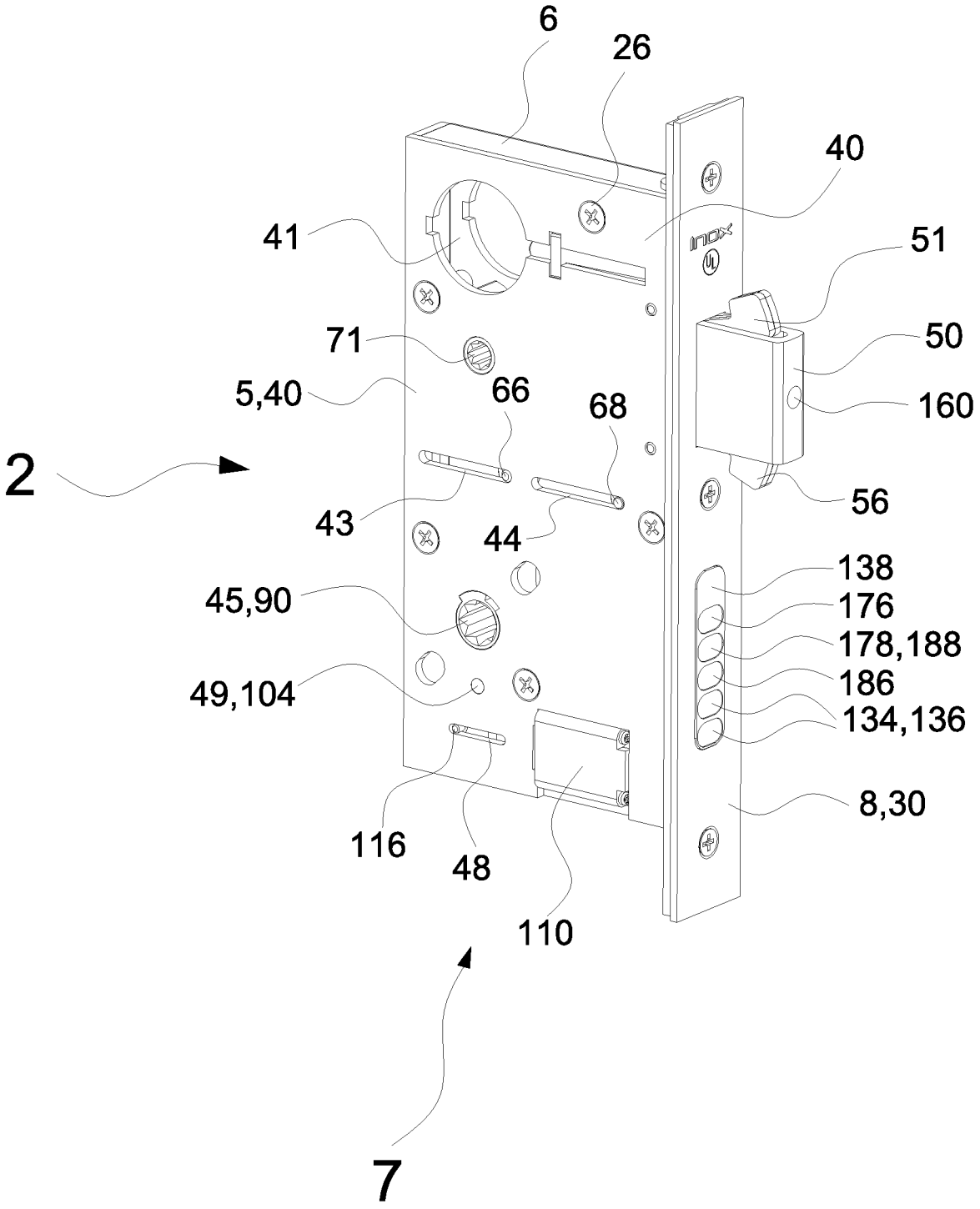
FIG. 20 is front perspective view of an advanced embodiment of electrified mortise lock for sliding door with power transfer unit located inside mortise lock and with a deadbolt monitoring switch and a lever hub monitoring switch.
Figure 21:
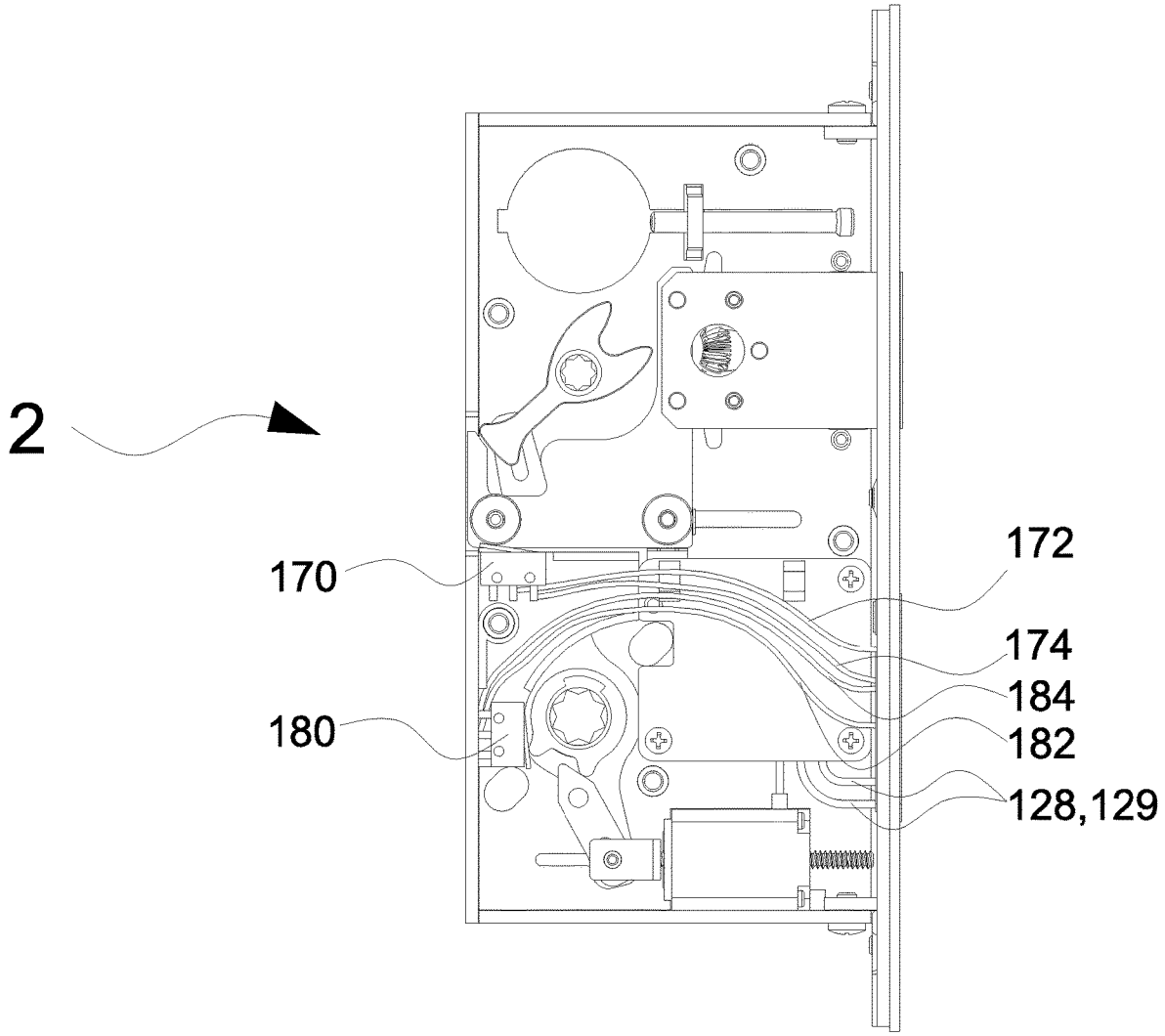
FIG. 21 is a side elevation view of the second side of an advanced embodiment of electrified mortise lock for sliding door with power transfer unit located inside mortise lock and with a deadbolt monitoring switch and a lever hub monitoring switch, with the mortise housing cover plate removed and the deadbolt in the retracted position.
Figure 22:
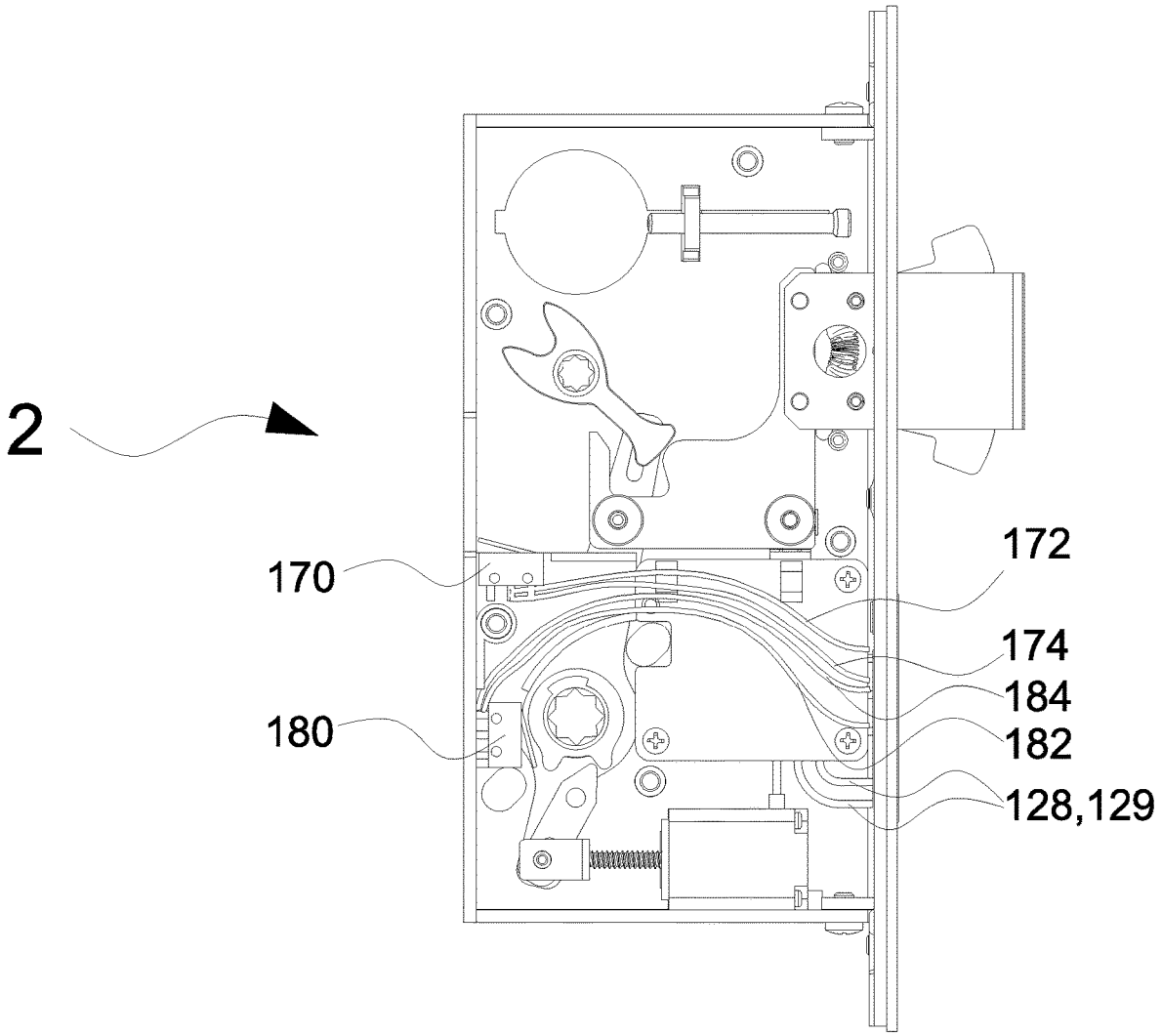
FIG. 22 is a side elevation view of the second side of an advanced embodiment of electrified mortise lock for sliding door with power transfer unit located inside mortise lock and with a deadbolt monitoring switch and a lever hub monitoring switch, with the mortise housing cover plate removed and the deadbolt in the extended position.
Figure 23:
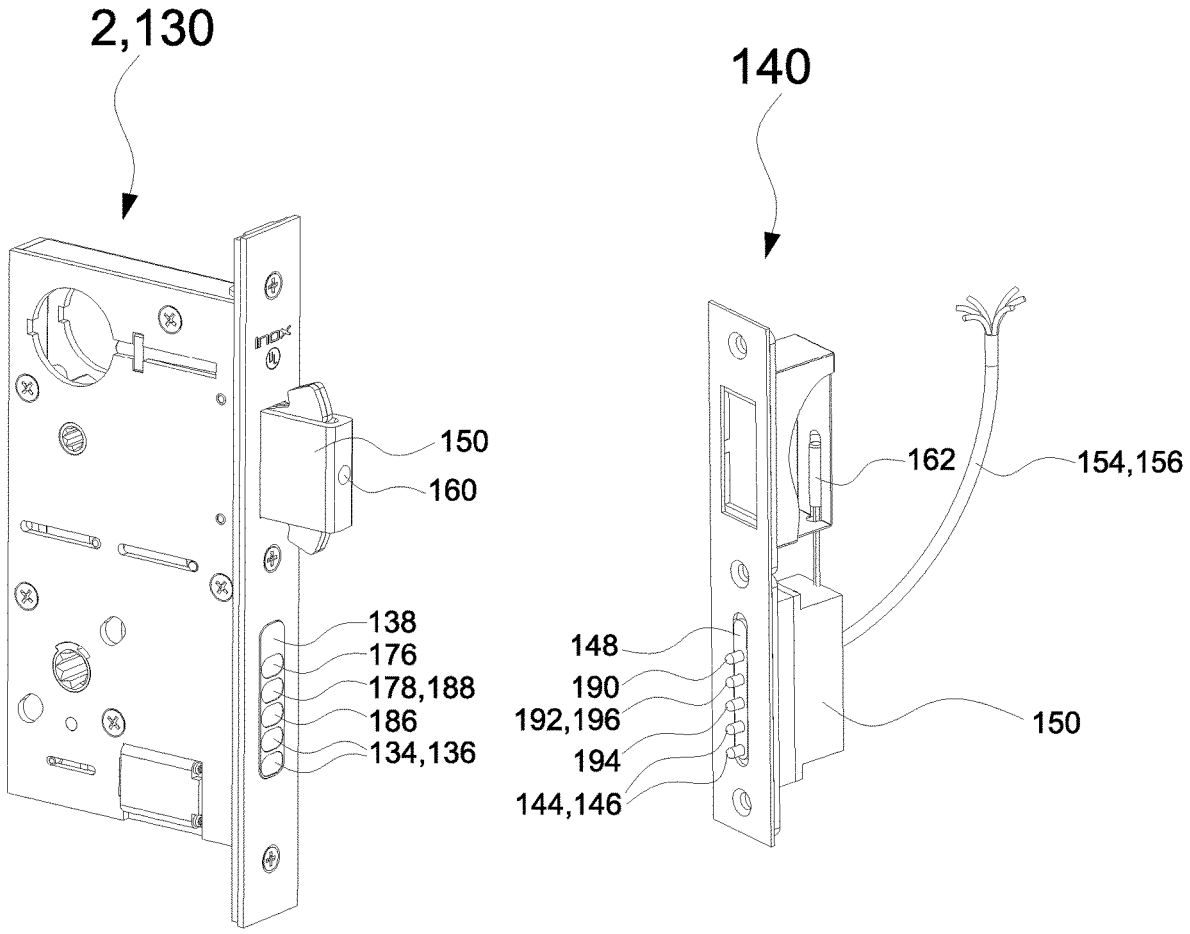
FIG. 23 is a perspective view of an advanced embodiment of electrified mortise lock for sliding door with power transfer unit located inside mortise lock and with a deadbolt monitoring switch and a lever hub monitoring switch and an advanced embodiment of power unit 140 located inside the strike plate in the door jamb that is equipped with a deadbolt magnet sensor and wiring for deadbolt monitoring switch and lever hub monitoring switch.
Figure 24A:
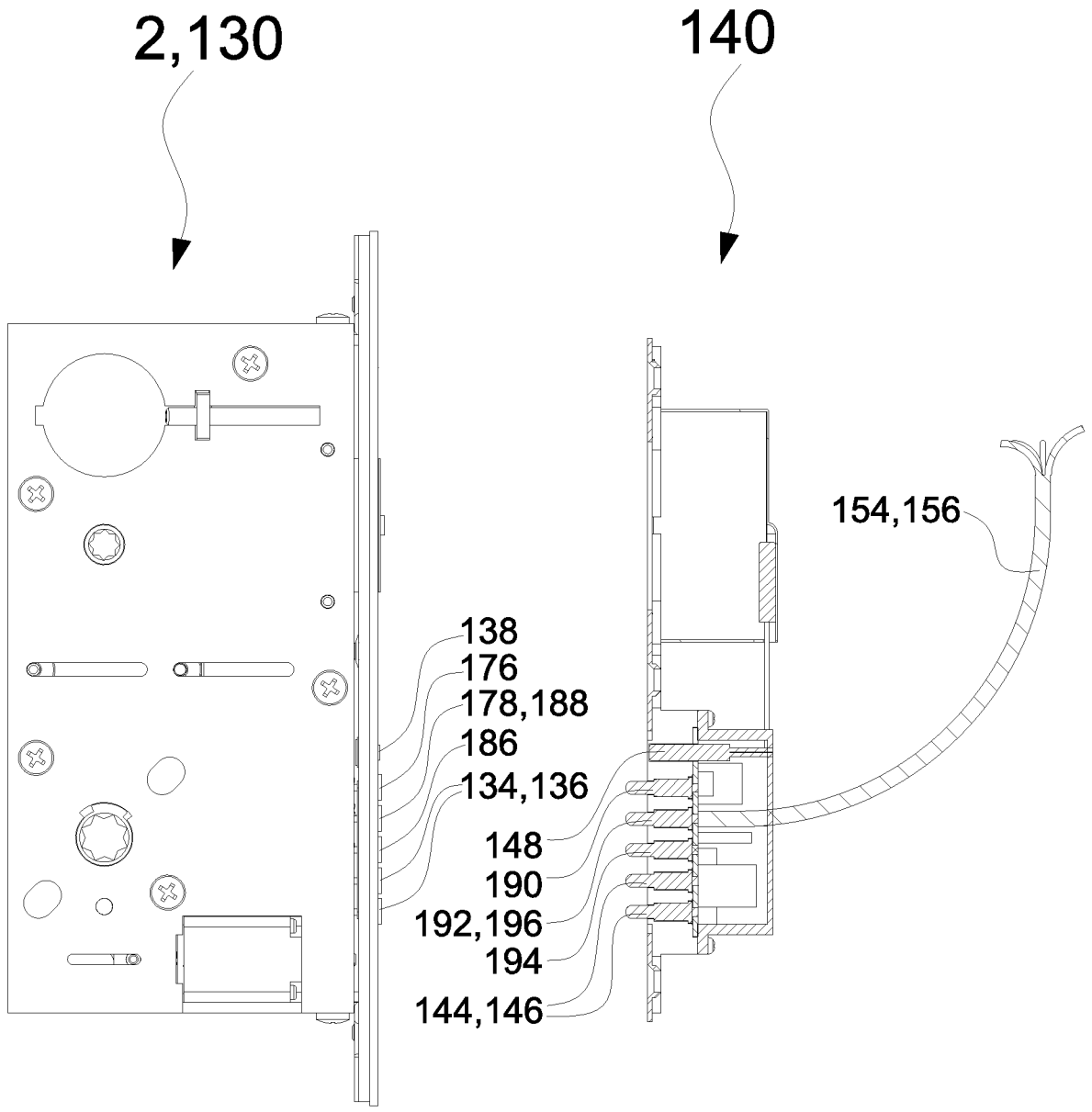
FIG. 24*a* side elevation view of FIG. 23 with sliding door open and deadbolt in the retracted position.
Figure 24B:
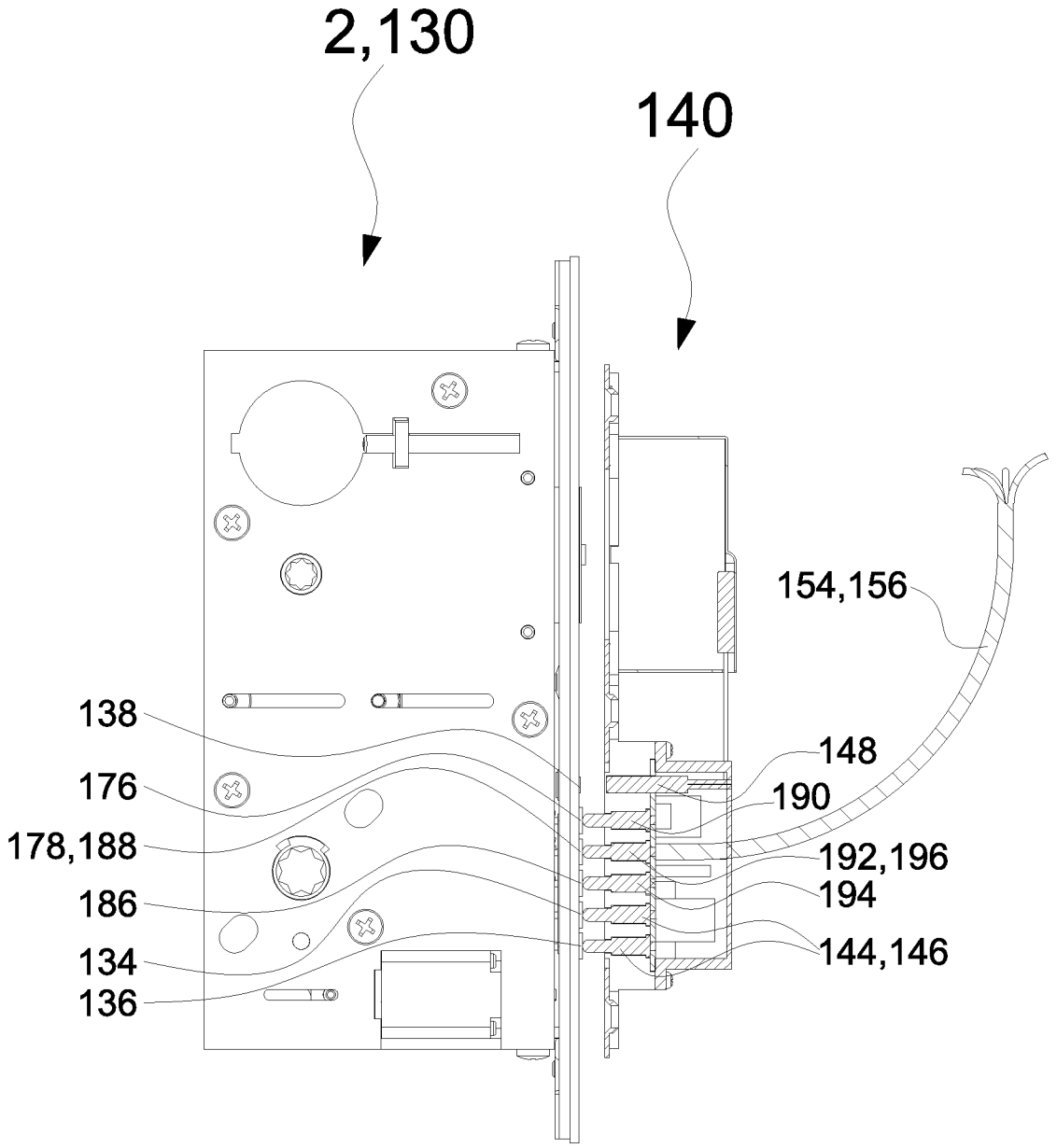
FIG. 24B side elevation view of FIG. 23 with sliding door closed and deadbolt in the retracted position.
Figure 24C:
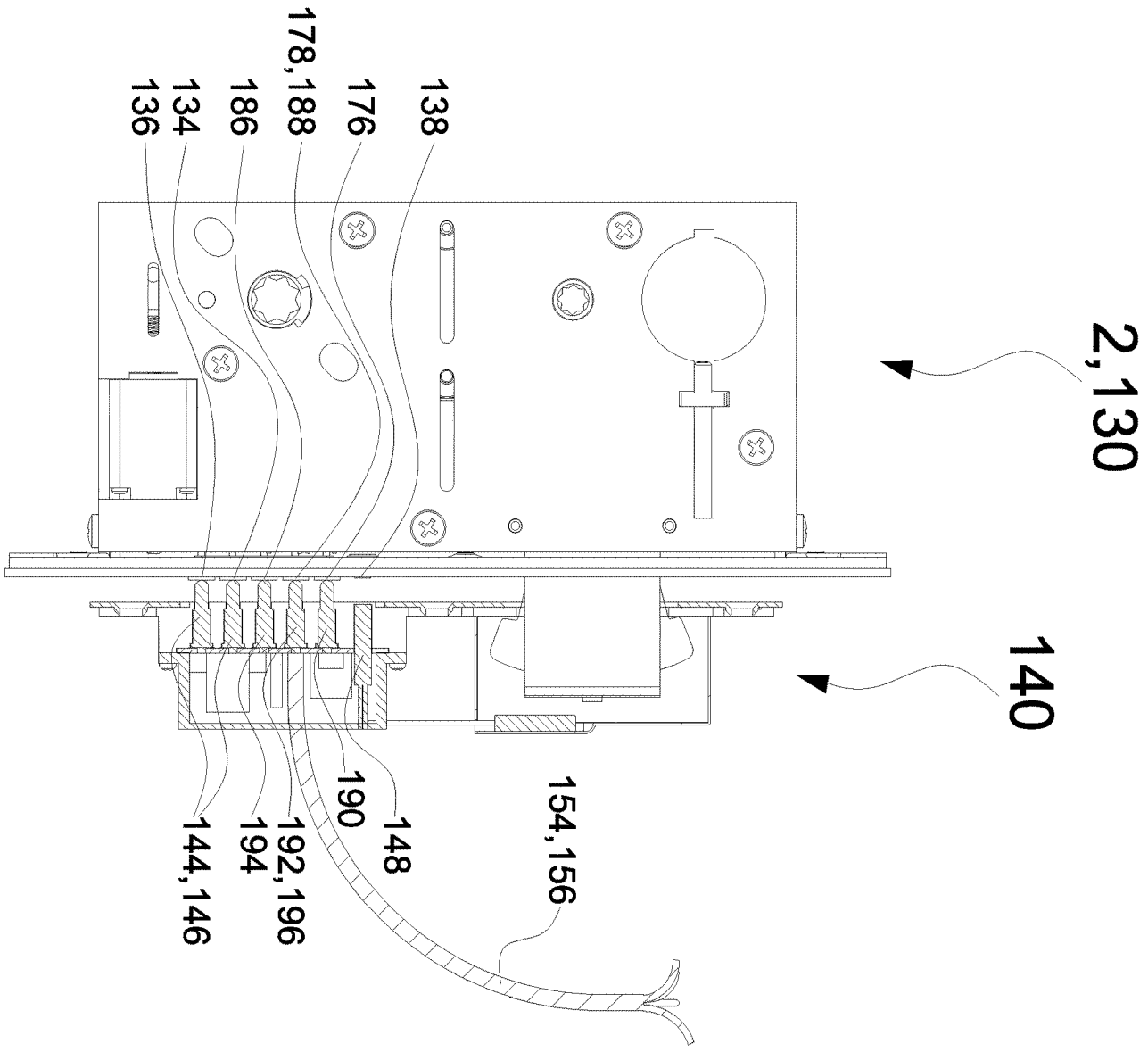
FIG. 24C side elevation view of FIG. 23 with sliding door closed and deadbolt in the extended position.

Electrified mortise lock for sliding door 2 may further comprise a power unit 140. Power unit 140 is special electrical connector that is rigidly attached to the door jam. Power unit 140 is an electrical connector that helps electrically connect microprocessor, integrated circuit, or chip 122 to the external control unit. Power unit 140 electrically connects positive power contact 134 to a positive power wire on the external control unit so that there is electrical continuity between these members. Power unit 140 also electrically connects negative power contact 136 to a negative power wire on the external control unit so that there is electrical continuity between these members. Power unit 140 comprises: a base 142; a positive power contact 144; a positive power wire 145, a negative power contact 146, and a negative power wire 147. Base 142 is a rigid planar member that supports positive power contact 144 and negative power contact 146. Base 142 is rigidly attached to the upper side of the door jamb or the strike plate in the door jamb. A power unit 140 attached to the door jamb is depicted in FIG. 19. A power unit 140 attached to the strike plate in the door jamb is depicted in FIGS. 23-24C. Rigid attachment may be accomplished by any known means such as: pressed fit, pressed seam, weld, glue, epoxy, adhesive, bolts, screws, rivets, clips, snaps, pins, or fasteners. Positive power contact 144 is an electrical contact or piece of electrically conductive material such as metal. Positive power contact 144 is rigidly attached to base 142 by any known means. Positive power wire 145 is a length of electrical wire that is used to power power unit 140. Positive power wire 145 has a first end and a second end. The first end of positive power wire 145 is attached to or connected to positive power contact 144 so that there is electrical continuity between these members. The second end of positive power wire 145 is connected to a power source that may be: a battery, a building power wire, an external control unit, or a user interface. Negative power contact 146 is an electrical contact or piece of electrically conductive material such as metal. Negative power contact 146 is rigidly attached to base 142 by any known means. Negative power contact 146 is connected to the negative power wire 147, which is the negative power wire on the external control, so that there is electrical continuity between these members. Negative power wire 147 is a length of electrical wire that is used to power power unit 140. Negative power wire 147 has a first end and a second end. The first end of negative power wire 147 is attached to or connected to negative power contact 146 so that there is electrical continuity between these members. The second end of negative power wire 147 is connected to a power source that may be: a battery, a building power wire, an external control unit, or a user interface.

When the sliding door is closed, positive power contact 134 on power transfer unit 130 contacts positive power contact 144 on power unit 140 so that there is electrical continuity between these members and negative power contact 136 on power transfer unit 130 contacts negative power contact 146 on power unit 140 so that there is electrical continuity between these members. When the sliding door is open, positive power contact 134 on power transfer unit 130 does not contact positive power contact 144 on power unit 140 so that there is no electrical continuity between these members and negative power contact 136 on power transfer unit 130 does not contact negative power contact 146 on power unit 140 so that there is no electrical continuity between these members. Thus, the sliding door must be closed for microprocessor, integrated circuit, or chip 122 to receive power.

In more advanced embodiments of electrified mortise lock for sliding door 2, power transfer unit 130 may further comprise: a magnet 138 and power unit 140 further comprises a magnetic sensor 148. Magnet 138 is a magnet or a material or object that produces a magnetic field made of ferromagnetic material such as iron. Magnet 138 is rigidly attached to base 132 on power transfer unit 130 by any known means. Magnet 138 is located or positioned on base 132 so that magnet 138 aligns with magnetic sensor 148 on power unit 140 when the sliding door is closed. Magnetic sensor 148 is a magnetic sensor or a microelectronic device that detects the presence of a magnetic field. Magnetic sensors operate by detecting a variation in the Lorentz force when a magnet is positioned in proximity to the magnetic sensor, which causes a change in voltage or resonant frequency output from the magnetic sensor, which signals the presence of a magnet. There are many magnetic sensor devices in the prior art. Any known type of magnetic sensor may be used. Magnetic sensor 148 is rigidly attached to base 142 on power unit 140 by any known means. Magnetic sensor 148 is located or positioned on base 142 so that magnetic sensor 148 aligns with magnet 138 on power transfer unit 130 when the sliding door is closed. Magnet 138 and magnetic sensor 148 work in tandem. When the sliding door in closed, magnetic sensor 148 detects magnet 138 and signals that the sliding door is closed. This signal from magnetic sensor 148 may be passed to the external control unit, a power unit circuit board 150, or a microprocessor, integrated circuit, or chip 152, as discussed below.

In still more advanced embodiments of electrified mortise lock for sliding door 2, power unit 140 may further comprise a power unit circuit board 150 wherein the positive power contact 144 and negative power contact 146 are both spring loaded to extend and retract into power unit 140. These advanced embodiments are depicted in FIGS. 20-24C. With these advanced embodiments, power transfer unit 130 is located inside of mortise lock and power unit 140 is located in the strike plate in the door jamb. The retraction of positive and negative power contacts 144,166 is done for safety purposes because the retracted positive and negative power contacts 144,166 will not be exposed for a person's fingers to contact.

Power unit circuit board 150 is a printed circuit board that supports and electrically connects electronic or electrical components attached to the circuit board using conductive tracks, pads, solder, or other features etched or laminated onto the circuit board so that there is electrical continuity between these electronic or electrical components. Power unit circuit board 150 has a first side, a second side, an upper edge, a lower edge, an opening edge, and a retracting edge. Power unit circuit board 150 is rigidly attached to base 142 on power unit 140 by any known means. Power unit circuit board 150 may further comprises: a microprocessor, integrated circuit, or chip 152; a positive power wire 154; and a negative power wire 156.

Microprocessor, integrated circuit, or chip 152 is an integrated circuit or monolithic integrated circuit, also referred to as an "IC", a chip, or a microchip that is a set of electronic circuits on one small flat piece of semiconductor material. Microprocessor, integrated circuit, or chip 152 has read only memory and random access memory. A special and custom operating software is loaded into the read only memory that may be updated through a wireless network connection or other network connection. Microprocessor, integrated circuit, or chip 152 is attached to or connected to power unit circuit board 150 so that there is electrical continuity between these members. With these advanced embodiments, magnetic sensor 148 is attached to or connected to power unit circuit board 150 or microprocessor, integrated circuit, or chip 152 so that there is electrical continuity between these members.

Positive power wire 154 on power unit circuit board 150 is a length of electrical wire that is used to power the power unit circuit board 150. Electrical power or current passes through positive power wire 154 in order to power the power unit circuit board 150. Positive power wire 154 has a first end and a second end. The first end of positive power wire 154 is attached to or connected to power unit circuit board 150 so that there is electrical continuity between these members. The second end of positive power wire 154 is connected to a power source that may be: a battery, a building power wire, an external control unit, or a user interface. In this advanced embodiment, the second end of positive power wire 145 is connected to microprocessor, integrated circuit, or chip 152 so that there is electrical continuity between these members.

Negative power wire 156 on power unit circuit board 150 is a length of electrical wire that is used to power the power unit circuit board 150. Electrical power or current passes through negative power wire 156 in order to power the power unit circuit board 150. Negative power wire 156 has a first end and a second end. The first end of negative power wire 156 is attached to or connected to power unit circuit board 150 so that there is electrical continuity between these members. The second end of negative power wire 156 is connected to a power source that may be: a battery, a building power wire, an external control unit, or a user interface. In this advanced embodiment, the second end of negative power wire 147 is connected to microprocessor, integrated circuit, or chip 152 so that there is electrical continuity between these members.

With these advanced embodiments, the special and custom operating software loaded onto microprocessor, integrated circuit, or chip 152 controls electrified mortise lock for sliding door 2. The special and custom operating software loaded onto microprocessor, integrated circuit, or chip 152 is the brain that operates electrified mortise lock for sliding door 2 and causes deadbolt 50 to electrically extend and retract. Positive and negative power wires 154,156 continuously power microprocessor, integrated circuit, or chip 152. When the sliding door is closed, magnetic sensor 148 on power unit 140 detects magnet 138 on power transfer unit 130 and signals this back to the special and custom operating software loaded onto microprocessor, integrated circuit, or chip 152 which causes positive and negative power contacts 144,146 to extend from the retracted position to contact positive and negative power contacts 134,136 to make electrical continuity therewith. After this electrical connection is made, electrified mortise lock for sliding door 2 continues to operate as described above. When the sliding door is opened, magnetic sensor 148 on power unit 140 does not detects magnet 138 on power transfer unit 130 and signals this back to the special and custom operating software loaded onto microprocessor, integrated circuit, or chip 152 which causes positive and negative power contacts 144,146 to retract from the extended position to disallow contact with a person's fingers when the sliding door is open.

In still more advanced embodiments of electrified mortise lock for sliding door 2, deadbolt 50 may further comprise a deadbolt magnet 160 and power unit 140 may further comprise a deadbolt magnetic sensor 162. Deadbolt magnet 160 is a magnet or a material or object that produces a magnetic field made of ferromagnetic material such as iron. Deadbolt magnet 160 is rigidly attached to the opening side of deadbolt 50 by any known means. Deadbolt magnet 160 is located or positioned on deadbolt 50 so that deadbolt magnet 160 aligns with deadbolt magnetic sensor 162 on the deadbolt strike plate in the door jamb when the sliding door is closed. Deadbolt magnetic sensor 162 is a magnetic sensor or a microelectronic device that detects the presence of a magnetic field. Any known type of magnetic sensor may be used. Deadbolt magnetic sensor 162 is rigidly attached to the deadbolt strike plate in the door jamb by any known means. Deadbolt magnetic sensor 162 is located or positioned within deadbolt strike plate in the door jamb so that deadbolt magnetic sensor 162 aligns with deadbolt magnet 160 when the sliding door is closed and deadbolt 50 is in the extended position. Deadbolt magnet 160 and deadbolt magnetic sensor 162 work in tandem. When the sliding door in closed and deadbolt 50 is extended, deadbolt magnetic sensor 162 detects deadbolt magnet 160 and signals that the sliding door is closed and the deadbolt 50 is extended. This signal from deadbolt magnetic sensor 162 is passed to the external control unit, power unit circuit board 150, or microprocessor, integrated circuit, or chip 152. With this advanced embodiment, the special and custom operating software loaded onto microprocessor, integrated circuit, or chip 152 knows when the sliding door is closed or open and also knows when the deadbolt is extended or retracted.

In still more advanced embodiments of electrified mortise lock for sliding door 2, electrified mortise lock for sliding door 2 may further comprise: a deadbolt monitoring switch 170; a positive power wire for deadbolt monitoring switch 172; a negative power wire for deadbolt monitoring switch 174; a positive power contact for deadbolt monitoring switch on power transfer unit 176; a negative power contact for deadbolt monitoring switch on power transfer unit 178; a positive power contact for deadbolt monitoring switch on power unit 190; and a negative power contact for deadbolt monitoring switch on power unit 190.

Deadbolt monitoring switch 170 is an electrical contact switch that sends a certain electronic signal when the switch makes contact with deadbolt shaft 60 and sends a different electronic signal when the switch is not in contact with deadbolt shaft 60. Any known type of electrical contact switch may be used. Deadbolt monitoring switch 170 functions to send an electronic signal to the external control unit, power unit circuit board 150, or microprocessor, integrated circuit, or chip 152 when deadbolt 50 is moved or changes from a retracted position to an extended position or changes from an extended position to a retracted position. Deadbolt monitoring switch 170 is rigidly attached to the first side of mortise housing base 10 at a position where deadbolt monitoring switch 170 makes contact with deadbolt shaft 60 when deadbolt 50 is in the retracted position and does not make contact with deadbolt shaft 60 when deadbolt 50 is in the extended position. Positive power wire for deadbolt monitoring switch 172 is a length of electrical wire with a first end and a second end that is used to power deadbolt monitoring switch 170. The first end of positive power wire for deadbolt monitoring switch 172 is attached to or connected to deadbolt monitoring switch 170 so that there is electrical continuity between these members. The second end of positive power wire for deadbolt monitoring switch 172 is connected to positive power contact for deadbolt monitoring switch on power transfer unit 176 so that there is electrical continuity between these members. Negative power wire for deadbolt monitoring switch 174 is a length of electrical wire with a first end and a second end that is used to power deadbolt monitoring switch 170. The first end of negative power wire for deadbolt monitoring switch 174 is attached to or connected to deadbolt monitoring switch 170 so that there is electrical continuity between these members. The second end of negative power wire for deadbolt monitoring switch 174 is connected to negative power contact for deadbolt monitoring switch on power transfer unit 178 so that there is electrical continuity between these members. Positive power contact for deadbolt monitoring switch on power transfer unit 176 is an electrical contact or piece of electrically conductive material such as metal. Positive power contact for deadbolt monitoring switch on power transfer unit 176 is rigidly attached to power transfer unit 130 by any known means. The second end of positive power wire for deadbolt monitoring switch 172 is attached to or connected to positive power contact for deadbolt monitoring switch on power transfer unit 176 so that there is electrical continuity between these members. Negative power contact for deadbolt monitoring switch on power transfer unit 178 is an electrical contact or piece of electrically conductive material such as metal. Negative power contact for deadbolt monitoring switch on power transfer unit 178 is rigidly attached power transfer unit 130 by any known means. The second end of negative power wire for deadbolt monitoring switch 174 is attached to or connected negative power contact for deadbolt monitoring switch on power transfer unit 178 so that there is electrical continuity between these members. Positive power contact for deadbolt monitoring switch on power unit 190 is an electrical contact or piece of electrically conductive material such as metal. Positive power contact for deadbolt monitoring switch on power unit 190 is rigidly attached to power unit 140 by any known means. Positive power contact for deadbolt monitoring switch on power unit 190 is attached to or connected to an electrical wire in power unit 190 that is connected to the external control unit so that there is electrical continuity between these members. Negative power contact for deadbolt monitoring switch on power unit 192 is an electrical contact or piece of electrically conductive material such as metal. Negative power contact for deadbolt monitoring switch on power unit 192 is rigidly attached to power unit 140 by any known means. Negative power contact for deadbolt monitoring switch on power unit 190 is attached to or connected to an electrical wire in power unit 190 that is connected to the external control unit so that there is electrical continuity between these members.

When the sliding door is closed, positive power contact for deadbolt monitoring switch on power transfer unit 176 contacts positive power contact for deadbolt monitoring switch on power unit 190 so that there is electrical continuity between these members and negative power contact for deadbolt monitoring switch on power transfer unit 178 contacts negative power contact for deadbolt monitoring switch on power unit 192 so that there is electrical continuity between these members. When the sliding door is open, positive power contact for deadbolt monitoring switch on power transfer unit 176 does not contact positive power contact for deadbolt monitoring switch on power unit 190 so that there is no electrical continuity between these members and negative power contact for deadbolt monitoring switch on power transfer unit 178 does not contact negative power contact for deadbolt monitoring switch on power unit 192 so that there is no electrical continuity between these members.

In still more advanced embodiments of electrified mortise lock for sliding door 2, electrified mortise lock for sliding door 2 may further comprise: a lever hub monitoring switch 180; a positive power wire for lever hub monitoring switch 182; a negative power wire for lever hub monitoring switch 184; a positive power contact for lever hub monitoring switch on power transfer unit 186; a negative power contact for lever hub monitoring switch on power transfer unit 188; a positive power contact for lever hub monitoring switch on power unit 194; and a negative power contact for lever hub monitoring switch on power unit 196.

Lever hub monitoring switch 180 is an electrical contact switch that sends a certain electronic signal when the switch makes contact with lever hub 90 and sends a different electronic signal when the switch is not in contact with lever hub 90. Any known type of electrical contact switch may be used. Lever hub monitoring switch 180 functions to send an electronic signal to the external control unit, power unit circuit board 150, or microprocessor, integrated circuit, or chip 152 when lever hub 90 is rotated or deadbolt 50 changes from a retracted position to an extended position or changes from an extended position to a retracted position. Lever hub monitoring switch 180 is rigidly attached to the first side of mortise housing base 10 at a position where lever hub monitoring switch 180 makes contact with lever hub 90 when deadbolt 50 is in the retracted position and does not make contact with lever hub 90 when deadbolt 50 is in the extended position. Positive power wire for lever hub monitoring switch 182 is a length of electrical wire with a first end and a second end that is used to power lever hub monitoring switch 180. The first end of positive power wire for lever hub monitoring switch 182 is attached to or connected to lever hub monitoring switch 180 so that there is electrical continuity between these members. The second end of positive power wire for lever hub monitoring switch 182 is connected to positive power contact for lever hub monitoring switch on power transfer unit 186 so that there is electrical continuity between these members. Negative power wire for lever hub monitoring switch 184 is a length of electrical wire with a first end and a second end that is used to power lever hub monitoring switch 180. The first end of negative power wire for lever hub monitoring switch 184 is attached to or connected to lever hub monitoring switch 180 so that there is electrical continuity between these members. The second end of negative power wire for lever hub monitoring switch 184 is connected to negative power contact for lever hub monitoring switch on power transfer unit 188 so that there is electrical continuity between these members. Positive power contact for lever hub monitoring switch on power transfer unit 186 is an electrical contact or piece of electrically conductive material such as metal. Positive power contact for lever hub monitoring switch on power transfer unit 186 is rigidly attached to power transfer unit 130 by any known means. The second end of positive power wire for lever hub monitoring switch 182 is attached to or connected to positive power contact for lever hub monitoring switch on power transfer unit 186 so that there is electrical continuity between these members. Negative power contact for lever hub monitoring switch on power transfer unit 188 is an electrical contact or piece of electrically conductive material such as metal. Negative power contact for lever hub monitoring switch on power transfer unit 188 is rigidly attached power transfer unit 130 by any known means. The second end of negative power wire for lever hub monitoring switch 184 is attached to or connected negative power contact for lever hub monitoring switch on power transfer unit 188 so that there is electrical continuity between these members. Positive power contact for lever hub monitoring switch on power unit 194 is an electrical contact or piece of electrically conductive material such as metal. Positive power contact for lever hub monitoring switch on power unit 194 is rigidly attached to power unit 140 by any known means. Positive power contact for lever hub monitoring switch on power unit 194 is attached to or connected to an electrical wire in power unit 190 that is connected to the external control unit so that there is electrical continuity between these members. Negative power contact for lever hub monitoring switch on power unit 196 is an electrical contact or piece of electrically conductive material such as metal. Negative power contact for lever hub monitoring switch on power unit 192 is rigidly attached to power unit 140 by any known means. Negative power contact for lever hub monitoring switch on power unit 194 is attached to or connected to an electrical wire in power unit 190 that is connected to the external control unit so that there is electrical continuity between these members.

When the sliding door is closed, positive power contact for lever hub monitoring switch on power transfer unit 186 contacts positive power contact for lever hub monitoring switch on power unit 192 so that there is electrical continuity between these members and negative power contact for lever hub monitoring switch on power transfer unit 188 contacts negative power contact for lever hub monitoring switch on power unit 194 so that there is electrical continuity between these members. When the sliding door is open, positive power contact for lever hub monitoring switch on power transfer unit 186 does not contact positive power contact for lever hub monitoring switch on power unit 192 so that there is no electrical continuity between these members and negative power contact for lever hub monitoring switch on power transfer unit 188 does not contact negative power contact for lever hub monitoring switch on power unit 194 so that there is no electrical continuity between these members.

What is claimed is:

1. An electrified mortise lock for a sliding door comprising: a mortise housing base; a mortise housing face plate; a mortise housing cover plate; a plurality of mortise housing screws; a deadbolt; a deadbolt shaft; a Y-turn hub; a bolt retraction lever; a lever hub; a screw lever; an electric motor; and a mortise lock circuit board, wherein, said mortise housing base is rigid hollow four-sided rectangular cuboid or box-shaped member, said mortise housing base comprises: a first side, an upper side, a lower side, and a retracting side, said first side of said mortise housing base is a rigid rectangular planar member with a length, a width, an inside surface, an outside surface, an upper edge, a lower edge, an opening edge, and a retracting edge, said upper side of said mortise housing base is a rigid rectangular planar member with a length, a width, an inside surface, an outside surface, a first edge, a second edge, an opening edge, and a retracting edge, said lower side of said mortise housing base is a rigid rectangular planar member with a length, a width, an inside surface, an outside surface, a first edge, a second edge, an opening edge, and a retracting edge, said retracting side of mortise housing base is a rigid rectangular planar member with a length, a width, an inside surface, an outside surface, a first edge, a second edge, an upper edge, and a lower edge, said upper edge of said first side said mortise housing base is rigidly attached to said first edge of said upper side of said mortise housing base, said lower edge of said first side said mortise housing base is rigidly attached to said first edge of said lower side of said mortise housing base, said retracting edge of said first side of said mortise housing base is rigidly attached to said first side of said retracting side or said mortise housing base, said first side of said mortise housing base comprises: an upper deadbolt mounting pin; a lower deadbolt mounting pin; a Y-turn hub mounting hole; a deadbolt shaft slot track; a lever hub mounting hole; an electric motor mounting hole; a screw bracket slot track; a plurality of support pillars; and a plurality of circuit board mounting pillars, said upper deadbolt mounting pin is a solid rigid horizontal cylindrical member with a diameter, a length, a first end, a second end, and a longitudinal axis, said first end of said upper deadbolt mounting pin is rigidly attached to said inside surface of said first side of said mortise housing base with said longitudinal axis perpendicular to said first side of said mortise housing base, said lower deadbolt mounting pin is a solid rigid horizontal cylindrical member with a diameter, a length, a first end, a second end, and a longitudinal axis, said first end of said lower deadbolt mounting pin is rigidly attached to said inside surface of said first side of said mortise housing base with said longitudinal axis perpendicular to said first side of said mortise housing base, said Y-turn hub mounting hole is a circular hole in said first side of said mortise housing base, said deadbolt shaft slot track is an oblong hole or slot in said first side of said mortise housing base, said lever hub mounting hole is a circular hole, with a circumference, in said first side of said mortise housing base, said lever hub mounting hole has a key notch on said circumference, said key notch is notch, void, or crenellation in said first side of said mortise housing base along said circumference of said lever hub mounting hole, said key notch has a width, an opening end, and a retracting end, said electric motor mounting hole is a rectangular hole in said first side of said mortise housing base, said electric motor mounting hole has a width, length, and a longitudinal axis, said screw bracket slot track is an oblong hole or slot in said first side of said mortise housing base, said screw bracket slot track has a width, a length, and a longitudinal axis, each of said plurality of support pillars is a hollow rigid horizontal cylindrical member with an inner diameter, an outer diameter, a length, a first end, a second end, an inside surface, an outside surface, and a longitudinal axis, said first end of each of said plurality of support pillars is rigidly attached to said inside surface of said first side of said mortise housing base with said longitudinal axis perpendicular to said first side of said mortise housing base, said inner diameter of said second end of each of said plurality of support pillars is lined with female thread, each of said plurality of circuit board mounting pillars is a hollow rigid horizontal cylindrical member with an inner diameter, an outer diameter, a length, a first end, a second end, an inside surface, an outside surface, and a longitudinal axis, said first end of each of said plurality of circuit board mounting pillars is rigidly attached to said inside surface of said first side of said mortise housing base with said longitudinal axis perpendicular to said first side of mortise housing base, said inner diameter on said second end of each of said plurality of circuit board mounting pillars is lined with female thread, said mortise housing face plate is a rigid rectangular planar member with a length, a width, an inside surface, an outside surface, a first edge, a second edge, an upper edge, and a lower edge, said mortise housing face plate is reversibly attachable to said mortise housing base, said mortise housing face plate comprises: a deadbolt clearance hole, said deadbolt clearance hole is a rectangular, square, or circular hole in said mortise housing face plate, said mortise housing cover plate is a rigid rectangular planar member with a length, a width, an inside surface, an outside surface, an upper edge, a lower edge, an opening edge, and a retracting edge, said mortise housing cover plate is reversibly attachable to said mortise housing base, said mortise housing cover plate comprises: a Y-turn hub mounting hole; a retracting side deadbolt shaft slot track; an opening side deadbolt shaft slot track; a lever hub mounting hole; an electric motor mounting hole; a screw bracket slot track; a screw lever pivot pin mounting hole; a plurality of pin mounting holes; and a plurality of screw holes, said Y-turn hub mounting hole is a circular hole, said retracting side deadbolt shaft slot track is an oblong hole or slot, said retracting side deadbolt shaft slot track has a width, a length, and a longitudinal axis, said opening side deadbolt shaft slot track is an oblong hole or slot, said opening side deadbolt shaft slot track has a width, a length, and a longitudinal axis, said lever hub mounting hole is a circular hole with a circumference, said lever hub mounting hole has a key notch on its said circumference, said key notch is notch, void, or crenellation, said key notch has a width, an opening end, and a retracting end, said electric motor mounting hole is a rectangular hole, said electric motor mounting hole has a width, length, and a longitudinal axis, said screw bracket slot track is an oblong hole or slot, said screw lever pivot pin mounting hole is a circular hole, each of said plurality of pin mounting holes is a circular hole, each of said plurality of screw holes is a circular hole with a beveled edge, each of said plurality of mortise housing screws is a screw, bolt, fastener, or clip, said deadbolt is a rigid rectangular cuboid shaped member, said deadbolt has a first side, a second side, an upper side, a lower side, an opening side, a retracting side, a longitudinal axis, and a longitudinal bisect, said longitudinal axis of said deadbolt runs through said opening side and said retracting side of said deadbolt, said deadbolt is slideably attached to said mortise housing base and said mortise housing cover plate, said deadbolt has a retracted position and an extended position, in said extended position, said deadbolt extends or protrudes through said deadbolt clearance hole on said mortise housing face plate so that said longitudinal bisect of said deadbolt extends beyond said deadbolt clearance hole, in said retracted position, said deadbolt retracts through deadbolt clearance hole on said mortise housing face plate so that said longitudinal bisect of said deadbolt retracts within deadbolt clearance hole, said deadbolt is partially hollow with a rectangular cuboid shaped hollow cavity extending from said lower edge of said deadbolt to said upper edge of said deadbolt, said rectangular cuboid shaped hollow cavity breaks through said upper side of said deadbolt and said lower side of said deadbolt, said rectangular cuboid shaped hollow cavity comprises: an upper deadbolt wing; an upper deadbolt wing pivot pin; an upper deadbolt wing latch protrusion; an upper deadbolt wing heel protrusion; a deadbolt wing spring; a lower deadbolt wing; a lower deadbolt wing pivot pin; a lower deadbolt wing latch protrusion; and a lower deadbolt wing heel protrusion, said upper deadbolt wing is a rigid oblong member with a first side, a second side, an upper side, a lower side, an opening side, a retracting side, an upper deadbolt wing pivot pin hole, an upper deadbolt wing latch protrusion, an upper deadbolt wing heel protrusion, a center, and a longitudinal axis, said upper deadbolt wing latch protrusion is a rigid tab, protrusion, or catch that extends or protrudes upwards from said upper side of said upper deadbolt wing adjacent to said opening side of said upper deadbolt wing, said upper deadbolt wing heel protrusion is a rigid tab, protrusion, or catch that extends or protrudes upwards from said lower side of said upper deadbolt wing adjacent to said retracting side of said upper deadbolt wing, said upper deadbolt wing pivot pin hole is located at said center of said upper deadbolt wing in between said upper deadbolt wing latch protrusion and said upper deadbolt wing heel protrusion, said upper deadbolt wing is pivotally attached within said rectangular cuboid shaped hollow cavity of said deadbolt with said upper deadbolt wing pivot pin inserted through said upper deadbolt wing latch pivot pin hole, said upper deadbolt wing 51 is a lever member that pivots about said upper deadbolt wing pivot pin, said upper deadbolt wing latch protrusion pivots upwards to catch within a strike plate in a door jamb in order to latch said sliding door with said deadbolt in said extended position, said upper deadbolt wing latch protrusion pivots downwards to clear said strike plate in said door jamb in order to unlatch said sliding door with said deadbolt in said retracted position, said lower deadbolt wing is a rigid oblong member with a first side, a second side, an upper side, a lower side, an opening side, a retracting side, a lower deadbolt wing pivot pin hole, a lower deadbolt wing latch protrusion 58, a lower deadbolt wing heel protrusion 59, a center, and a longitudinal axis, said lower deadbolt wing latch protrusion is a rigid tab, protrusion, or catch that extends or protrudes downwards from said lower side of said lower deadbolt wing adjacent to said opening side of said lower deadbolt wing, said lower deadbolt wing heel protrusion is a rigid tab, protrusion, or catch that extends or protrudes downwards from said lower side of said lower deadbolt wing adjacent to said retracting side of said lower deadbolt wing, said lower deadbolt wing pivot pin hole is located at said center of said lower deadbolt wing in between said lower deadbolt wing latch protrusion and said lower deadbolt wing heel protrusion, said lower deadbolt wing is pivotally attached within said rectangular cuboid shaped hollow cavity of deadbolt with said lower deadbolt wing pivot pin inserted through said lower deadbolt wing pivot pin hole, said lower deadbolt wing is a lever member that pivots about said lower deadbolt wing pivot pin, said lower deadbolt wing latch protrusion pivots downwards to catch within said strike plate in said door jamb in order to latch said sliding door with said deadbolt in said extended position, said lower deadbolt wing latch protrusion pivots upwards to clear said strike plate in said door jamb in order to unlatch said sliding door with said deadbolt in said retracted position, said deadbolt wing spring is a compression spring with an upper end, a lower end, and a longitudinal axis, said deadbolt wing spring is installed between said upper deadbolt wing and said lower deadbolt wing, said upper deadbolt wing is installed in said rectangular cuboid shaped hollow cavity of said deadbolt and pivotally attached to said deadbolt with said upper deadbolt wing pivot pin, said lower deadbolt wing is installed in said rectangular cuboid shaped hollow cavity of said deadbolt and pivotally attached to said deadbolt with said lower deadbolt wing pivot pin, said deadbolt wing spring is installed in said rectangular cuboid shaped hollow cavity of said deadbolt with said longitudinal axis of said deadbolt wing spring running vertically with said upper end of said deadbolt wing spring in contact with said lower side of said upper deadbolt wing and said lower end of said deadbolt wing spring in contact with said upper side of said lower deadbolt wing, said upper deadbolt wing latch protrusion is actuated to rotate upwards by said heel protrusion contacting said upper deadbolt mounting pin as said deadbolt extends out of said deadbolt clearance hole to said extended position, when said deadbolt is in said retracted position, said heel protrusion is not in contact with said upper deadbolt mounting pin and said deadbolt wing spring forces said retracting side of said upper deadbolt wing upwards to retract said upper deadbolt wing latch protrusion within said rectangular cuboid shaped hollow cavity of said deadbolt, when said deadbolt is in said extended position, said heel protrusion is in contact with said upper deadbolt mounting pin, which pushes said retracting side of said upper deadbolt wing downwards to extend said upper deadbolt wing latch protrusion upwards to extend out of said rectangular cuboid shaped hollow cavity of deadbolt, said lower deadbolt wing latch protrusion is actuated to rotate downwards by said heel protrusion contacting said lower deadbolt mounting pin as said deadbolt extends out of said deadbolt clearance hole to said extended position, when said deadbolt 50 is in said retracted position, said heel protrusion is not in contact with said lower deadbolt mounting pin and said deadbolt wing spring forces said retracting side of said lower deadbolt wing downwards to retract said lower deadbolt wing latch protrusion within said rectangular cuboid shaped hollow cavity of said deadbolt, when said deadbolt is in said extended position, said heel protrusion is in contact with said lower deadbolt mounting pin, which pushes said retracting side of said lower deadbolt wing upwards to extend said lower deadbolt wing latch protrusion downwards to extend out of said rectangular cuboid shaped hollow cavity of said deadbolt, said deadbolt shaft is a rigid oblong planar member with a first side, a second side, an upper edge, a lower edge, an opening edge, a retracting edge, and a longitudinal axis, said deadbolt shaft comprises: a deadbolt attachment arm; a pendulum arm pocket; a retracting side slide pin; an opening side slide pin; and deadbolt position indicator, said deadbolt attachment arm is a long planar protrusion or arm member protruding from said upper edge of said deadbolt shaft, adjacent to said opening edge of said deadbolt shaft, said deadbolt attachment arm is rigidly attached to said retracting side of said deadbolt, said pendulum arm pocket is rectangular or square shaped notch or void in said upper edge of said deadbolt shaft, adjacent to said retracted edge of said deadbolt shaft, said retracting side slide pin is a solid rigid horizontal cylindrical member with a diameter, a length, a first end, a second end, a longitudinal axis, and a longitudinal bisect, said longitudinal bisect of said retracting side slide pin is rigidly attached to said deadbolt shaft with said longitudinal axis of said retracting side slide pin perpendicular to said first side of said mortise housing base, said second end of said retracting side slide pin slides within or rides within said retracting side deadbolt shaft slot track on said mortise housing cover plate to slideably attach said deadbolt shaft to said mortise housing cover plate, said opening side slide pin is a solid rigid horizontal cylindrical member with a diameter, a length, a first end, a second end, a longitudinal axis, and a longitudinal bisect, said longitudinal bisect of said opening side slide pin is rigidly attached to said deadbolt shaft with said longitudinal axis of said opening side slide pin perpendicular to said first side of said mortise housing base, said first end of said opening side slide pin slides within or rides within said deadbolt shaft slot track on said mortise housing base to slideably attach said deadbolt shaft to said mortise housing base, said second end of said opening side slide pin slides within or rides within said opening side deadbolt shaft slot track on said mortise housing cover plate to slideably attach said deadbolt shaft to mortise housing cover plate 40, said deadbolt position indicator is a rigid tab member with an upper end and a lower end, said upper end of said deadbolt position indicator is rigidly attached to said opening side slide pin on said deadbolt shaft or to said lower edge of said deadbolt shaft, said deadbolt position indicator projects or extends downward from said lower edge of said deadbolt shaft, said Y-turn hub is a rigid hub member with a center, said Y-turn hub comprises: a socket; a first arm; a second arm; a pendulum arm; and a pendulum arm pin, said socket is a hole through said center of said Y-turn hub, said first arm is a rigid protrusion or arm that extends radially outward from said socket, said second arm a rigid protrusion or arm that extends radially outward from said socket, said pendulum arm a rigid protrusion or arm that extends radially outward from said socket, rotation of said Y-turn hub causes said deadbolt shaft to slide back and forth and said deadbolt to extend and retract or to latch and unlatch, said socket is a rigid cylindrical hole through said center of said Y-turn hub, said socket has a first end, a second end, an inner diameter, an inner surface, an outer diameter, an outer surface, and a longitudinal axis, said Y-turn hub is pivotally attached to said first side of said mortise housing base at said first end of said socket and pivotally attached to said mortise housing cover plate at said second end of said socket so that said longitudinal axis of said socket 71 is perpendicular to said first side of said mortise housing base, said outer surface of said socket is smooth, said inner surface of said socket has a plurality of points or ridges that engage with a square spindle or shaft from a thumb turn or coin turn, said first arm is a rigid oblong member or arm protruding radially outward from said exterior surface of said socket, said second arm is a rigid oblong member or arm protruding radially outward from said exterior surface of said socket, said first arm and said second arm engage with a swing arm on a lock cylinder to rotate said Y-turn hub as said swing arm on said lock cylinder is rotated, said pendulum arm is a rigid oblong member or arm protruding radially outward from said exterior surface of said socket with a radial end, said pendulum arm further comprises a head, said head is a widened portion of said pendulum arm on said radial end of said pendulum arm, said head has a first side and a second side, said head nests within or rides within said pendulum arm pocket in said deadbolt shaft so that said deadbolt shaft slides back and forth within said deadbolt shaft slot track, said retracting side deadbolt shaft slot track, and said opening side deadbolt shaft slot track as said pendulum arm rotates, said pendulum arm slides or laterally moves said deadbolt shaft as said pendulum arm is rotated, said pendulum arm pin is a rigid solid cylindrical member extending from said first side of said head, said pendulum arm pin nests within or rides within a pendulum arm pin slot track on said bolt retraction lever to slideably attach said head to an upper arm of said bolt retraction lever, which causes said bolt retraction lever and said Y-turn hub to rotate together or in unison, said bolt retraction lever is a rigid oblong planar member with a first side, a middle section, a second side, and a longitudinal axis, said bolt retraction lever is pivotally attached to said first side of said socket on said lever hub, rotation of said bolt retraction lever causes said deadbolt shaft to slide back and forth, which causes said deadbolt to retract and extend, said bolt retraction lever comprises: a pivot hole; an upper arm; and a lower arm, said pivot hole is a circular hole through said middle section of said bolt retraction lever, said pivot hole is pivotally attached to an outer diameter of said socket on said lever hub, said upper arm is a rigid oblong member or arm protruding radially outward from said pivot hole, said upper arm has a width, a length, a longitudinal axis, and a radial end, said radial end of upper arm has a pendulum arm pin slot track, said pendulum arm pin slot track is an oblong hole or slot with a width, a length, and a longitudinal axis, said longitudinal axis of said pendulum arm pin slot track is parallel with said longitudinal axis of said upper arm, said pendulum arm pin slot track engages with said pendulum arm pin on said Y-turn hub, said pendulum arm pin nests within or rides within said pendulum arm pin slot track, said lower arm is a rigid oblong member or arm protruding radially outward from said pivot hole, said lower arm has a width, a length, a longitudinal axis, and a radial end, said longitudinal axis of said upper arm is parallel with said longitudinal axis of said lower arm, said radial end of lower arm has a screw bracket pin slot track, said screw bracket pin slot track is an oblong hole or slot with a width, a length, and a longitudinal axis, said longitudinal axis of said screw bracket pin slot track is parallel with said longitudinal axis of said lower arm, said screw bracket pin slot track engages with a screw bracket pin on said electric motor, said screw bracket pin nests within or rides within said screw bracket pin slot track, said lever hub is a rigid hub with a center of a wheel, said lever hub has a first side and a second side, said first side of said lever hub is pivotally attached to said lever hub mounting hole on said first side of said mortise housing base, said second side of said lever hub is pivotally attached to said lever hub mounting hole on said mortise housing cover plate, said lever hub comprises: a socket; a first key tab; a second key tab; a first ridge; and a second ridge, said socket is a hole through said center of said lever hub, said socket has a first end, a second end, an inner diameter, an inner surface, an outer diameter, an outer surface, and a longitudinal axis, said longitudinal axis of said socket is perpendicular to said mortise housing base, said outer surface of said socket is smooth, said inner surface of said socket has a plurality of points or ridges that engage with a square spindle or shaft from a door knob or door lever, said lever hub rotates along with said spindle or shaft from said door knob or door lever, said first key tab is a rigid tab, protrusion, or catch that extends or protrudes radially outward from said outer diameter of said socket on said first side of said lever hub, said first key tab nests within said key notch on said first side of said mortise housing base, said first key tab has a width, an opening side, and a retracting side, said first key tab contacts or catches on said key notch during rotation of said lever hub and thereby limits rotation of said lever hub 90 within said lever hub mounting hole, said second key tab is a rigid tab, protrusion, or catch that extends or protrudes radially outward from said outer diameter of said socket on said second side of said lever hub, said second key tab nests within said key notch on said mortise housing cover plate, said second key tab has a width, an opening side, and a retracting side, said second key tab contacts or catches on said key notch during rotation of said lever hub and thereby limits rotation of said lever hub within said lever hub mounting hole, said first ridge is a rigid oblong protrusion or rib extending outward from said outer surface of said socket, said first ridge has a width, a length, a height, and a longitudinal axis, said first ridge engages with an upper end of said screw lever and functions as a stop or limiter to prevent said upper end of said screw lever from rotating beyond said first ridge, said second ridge is a rigid oblong protrusion or rib extending outward from said outer surface of said socket, said second ridge engages with said upper end of said screw lever and functions as a stop or limiter to prevent said upper end of screw lever from rotating beyond said second ridge, said screw lever is a rigid oblong member, arm, or lever, said screw lever has a first side, a second side, a width, a length, and a longitudinal axis, said screw lever comprises: an upper end; a pivot pin; a lower end; and a screw bracket pin slot track, said screw lever is pivotally attached to said mortise housing cover plate by said pivot pin, said screw lever pivots about said pivot pin, said pivot pin is a solid rigid horizontal cylindrical member with a diameter, a length, a first end, a second end, and a longitudinal axis, said first end of said pivot pin is rigidly attached to said second side of said screw lever at said upper end of said screw lever, said second end of said pivot pin is pivotally attached within said screw lever pivot pin mounting hole in said mortise housing cover plate, said screw lever pivots about said pivot pin, said screw bracket pin slot track is an oblong hole or slot in said lower end of said screw lever, said screw bracket pin slot track has a width, a length, and a longitudinal axis, said longitudinal axis of said screw bracket pin slot track is parallel with said longitudinal axis of said screw lever, said screw bracket pin slot track engages with a screw bracket pin on a screw bracket, said electric motor is an electric motor with a first side, a second side, an upper side, a lower side, an opening side, and a retracting side, said electric motor is an electrical machine that converts electrical energy into mechanical energy said electric motor has a stator and a rotor, said rotor has a female threaded cavity or a cylindrical cavity with a set of female threads, said electric motor is rigidly attached to said electric motor mounting hole on said mortise housing base and to said electric motor mounting hole on said mortise housing cover plate, said electric motor further comprises: a screw; a screw bracket; a screw bracket pin; and power wires, said screw is a rigid solid oblong member with an opening end, a retracting end, a length, an exterior surface, and a longitudinal axis, said exterior surface of said screw has a male thread or a set of male threads that extends along said length of said screw, said male thread said exterior surface of said screw engages with said female threaded cavity on said rotor, said longitudinal axis of said screw is parallel to said upper side of said mortise housing base and perpendicular to said mortise housing face plate, rotation of said electric motor in a first direction causes said opening end of said screw to laterally move towards said mortise housing face plate, rotation of said electric motor in a second direction causes said retracting end of said screw to laterally move towards said retracting side of said mortise housing base, said screw is connected to said lower arm of said bolt retraction lever which causes said bolt retraction lever to rotate as said screw is moved laterally, said screw is connected to said lower end of said screw lever which causes said screw lever to rotate as said screw is moved laterally, said screw bracket is a rigid oblong member with an opening end and a retracting end, said opening end of said screw bracket is rigidly attached to said retracting end of said screw, said retracting end of said screw bracket is rigidly attached to said screw bracket pin, said screw bracket pin is a solid rigid horizontal cylindrical member with a diameter, a length, a first end, a second end, and a longitudinal axis, said screw bracket pin is slideably attached to said screw bracket pin slot track on said bolt retraction lever and to said screw bracket pin slot track on said screw lever, said screw bracket pin nests within or rides within said screw bracket pin slot track on said bolt retraction lever and within said screw bracket pin slot track on said screw lever, said power wires are electrical wires that are used to power said electric motor, said power wires have a first end and a second end, said first end of said power wires are attached to or connected to said electric motor so that there is electrical continuity there between, said second end of said power wires is attached to or connected to said mortise lock circuit board so that there is electrical continuity therebetween, said mortise lock circuit board is a printed circuit board that supports and electrically connects a set of electronic or electrical components attached to said printed circuit board, said mortise lock circuit board has a first side, a second side, an upper edge, a lower edge, an opening edge, and a retracting edge, said mortise lock circuit board is rigidly attached to said plurality of circuit board mounting pillars on said mortise housing base, mortise lock circuit board further comprises: a first microprocessor, integrated circuit, or chip; a deadbolt retracted sensor; a deadbolt extended sensor; a positive power wire; and a negative power wire, said first microprocessor, integrated circuit, or chip is an integrated circuit, monolithic integrated circuit, chip, or microchip that is a set of electronic circuits on a small flat piece of semiconductor material, said first microprocessor, integrated circuit, or chip has a read only memory and a random access memory, a special and custom operating software is loaded into said read only memory said first microprocessor, integrated circuit, or chip is attached to or connected to said mortise lock circuit board so that there is electrical continuity therebetween, said deadbolt retracted sensor is an electronic sensor that detects said deadbolt position indicator, said deadbolt retracted sensor is attached to or connected to said mortise lock circuit board so that there is electrical continuity therebetween, when said deadbolt position indicator is proximal to said deadbolt retracted sensor, said deadbolt retracted sensor detects said deadbolt retracted sensor and communicates said detection to said first microprocessor, integrated circuit, or chip, said deadbolt retracted sensor is located on said upper edge of said mortise lock circuit board adjacent to said retracting edge of said mortise lock circuit board, said deadbolt extended sensor is an electronic sensor that detect said deadbolt position indicator, said deadbolt extended sensor is attached to or connected to said mortise lock circuit board so that there is electrical continuity therebetween, when deadbolt position indicator is proximal to said deadbolt extended sensor, said deadbolt extended sensor detects said deadbolt extended sensor and communicates said detection to said first microprocessor, integrated circuit, or chip, said deadbolt extended sensor is located on said upper edge of said mortise lock circuit board adjacent to said opening edge of said mortise lock circuit board, said positive power wire is a length of electrical wire that is used to said power mortise lock circuit board, said positive power wire has a first end and a second end, said first end of said positive power wire is attached to or connected to said mortise lock circuit board so that there is electrical continuity therebetween, said second end of said positive power wire is connected to a power source, an external control unit, a user interface, or a positive power contact, said negative power wire is a length of electrical wire that is used to power said mortise lock circuit board, said negative power wire has a first end and a second end, said first end of said negative power wire is attached to or connected to said mortise lock circuit board so that there is electrical continuity therebetween, said second end of said negative power wire is connected to said power source, said external control unit, said user interface, or a negative power contact, 136 on a power transfer unit 130, said Integrated circuit, or chip is supplied with electrical power or current when said deadbolt is required to move from said retracted position to said extended position or from said extended position to said retracted position, when said positive power wire and said negative power wire are energized to deliver electrical current to said first microprocessor, integrated circuit, or chip, said special and custom operating software first checks to see if said deadbolt is in said extended position or in said retracted as indicated by said deadbolt position indicator and detected by said deadbolt retracted sensor or by said deadbolt extended sensor, if said deadbolt starts from said extended position, said special and custom operating software causes said deadbolt to retract to said retracted position by powering on said electric motor to rotate said rotor and cause said retracting end of said screw to travel towards said mortise housing face plate, which rotates said lower arm towards said mortise housing face plate, which rotates said upper arm towards said retracting side of said mortise housing base, which slides said deadbolt shaft towards said retracting side of said mortise housing base, which retracts said deadbolt 50 into said retracted position, and if said deadbolt starts from said retracted position, said special and custom operating software causes said deadbolt to extend to said extended position by powering on said electric motor to rotate said rotor and cause said retracting end of said screw to travel towards said retracting side of said mortise housing base, which rotates lower arm towards said retracting side of said mortise housing base, which rotates upper arm 84 towards said mortise housing face plate, which slides said deadbolt shaft towards said mortise housing face plate, which extends said deadbolt into said extended position.

2. An electrified mortise lock for a sliding door as recited in claim 1 further comprising: a power transfer unit, wherein, said power transfer unit comprises: a base; a power transfer positive power contact; and a power transfer negative power contact, said base is a rigid planar member that supports said power transfer positive power contact and said power transfer negative power contact, said base is rigidly attached to: an upper side of said sliding door, said mortise housing base, or said mortise housing face plate, said power transfer positive power contact is an electrical contact or piece of electrically conductive material, said power transfer positive power contact is rigidly attached to said base, said power transfer positive power contact is connected to said second end of said positive power wire so that there is electrical continuity therebetween, said power transfer negative power contact is an electrical contact or piece of electrically conductive material, said power transfer negative power contact is rigidly attached to said base, and said power transfer negative power contact is connected to said second end of said negative power wire so that there is electrical continuity therebetween.

3. An electrified mortise lock for a sliding door as recited in claim 2 further comprising: a power unit, wherein, said power unit comprises: a base; a power unit positive power contact; a positive power wire, a power unit negative power contact, and a negative power wire, said base is a rigid planar member that supports said power unit positive power contact and said power unit negative power contact, said base is rigidly attached to: an upper side of said door jamb or said strike plate in said door jamb, said power unit positive power contact is an electrical contact or piece of electrically conductive material, said power unit positive power contact is rigidly attached to said base, said positive power wire is a length of electrical wire that is used to power said power unit, said positive power wire has a first end and a second end, said first end of said positive power wire is attached to or connected to said power unit positive power contact so that there is electrical continuity therebetween, said second end of said positive power wire is connected to said power source, said power unit negative power contact is an electrical contact or piece of electrically conductive material, said power unit negative power contact is rigidly attached to said base, said power unit negative power contact is connected to said negative power wire so that there is electrical continuity therebetween, said negative power wire is a length of electrical wire that is used to power said power unit, said negative power wire has a first end and a second end, said first end of said negative power wire is attached to or connected to said power unit negative power contact so that there is electrical continuity therebetween, and said second end of negative power wire is connected to said power source.

4. An electrified mortise lock for a sliding door as recited in claim 3 wherein said a power unit further comprises a power unit circuit board, wherein, said power unit circuit board is a printed circuit board that supports and electrically connects electronic or electrical components attached to said printed circuit board, said power unit circuit board has a first side, a second side, an upper edge, a lower edge, an opening edge, and a retracting edge, said power unit circuit board is rigidly attached to said base on said power unit, said power unit circuit board comprises: a second microprocessor, integrated circuit, or chip; a power unit circuit board positive power wire; and a power unit circuit board negative power wire, said second microprocessor, integrated circuit, or chip is an integrated circuit or monolithic integrated circuit that is a set of electronic circuits on a small flat piece of semiconductor material, said second microprocessor, integrated circuit, or chip has a read only memory and a random access memory, a second special and custom operating software is loaded into said read only memory, said second microprocessor, integrated circuit, or chip is attached to or connected to said power unit circuit board so that there is electrical continuity therebetween, said power unit circuit board positive power wire is a length of electrical wire that is used to power said power unit circuit board, said power unit circuit board positive power wire has a first end and a second end, said first end of said power unit circuit board positive power wire is attached to or connected to said power unit circuit board so that there is electrical continuity therebetween, said second end of said power unit circuit board positive power wire is connected to said second microprocessor, integrated circuit, or chip so that there is electrical continuity therebetween, said power unit circuit board negative power wire a length of electrical wire that is used to power said power unit circuit board, said power unit circuit board negative power wire has a first end and a second end, said first end of said power unit circuit board negative power wire is attached to or connected to said power unit circuit board so that there is electrical continuity therebetween, and said second end of said power unit circuit board negative power wire is connected to said second microprocessor, integrated circuit, or chip so that there is electrical continuity therebetween.

5. An electrified mortise lock for a sliding door as recited in claim 4 wherein said power transfer unit further comprises a magnet and said a power unit further comprises a magnetic sensor, wherein, said magnet is a magnet or a material or object that produces a magnetic field made of ferromagnetic material, said magnet is rigidly attached to said base on said power transfer unit, said magnet is located or positioned on said base so that said magnet aligns with said magnetic sensor on said power unit when said sliding door is closed, said magnetic sensor is a magnetic sensor or a microelectronic device that detects the presence of a magnetic field, said magnetic sensor is rigidly attached to said base on said power unit, said magnetic sensor is located or positioned on said base so that said magnetic sensor aligns with said magnet on said power transfer unit when said sliding door is closed, said magnetic sensor is attached to or connected to: said power unit circuit board or said second microprocessor, integrated circuit, or chip so that there is electrical continuity therebetween, and when said sliding door in closed, said magnetic sensor detects said magnet and sends an electrical signal or message to: said power unit circuit board, said second microprocessor, integrated circuit, or chip, or said external control unit stating that said sliding door is closed.

6. An electrified mortise lock for a sliding door as recited in claim 4 wherein said dead bolt further comprises a deadbolt magnet and said power unit further comprise a deadbolt magnetic sensor, wherein, said deadbolt magnet is a magnet or a material or object that produces a magnetic field made of ferromagnetic material, said deadbolt magnet is rigidly attached to said opening side of said deadbolt, said deadbolt magnetic sensor is a magnetic sensor or a microelectronic device that detects the presence of a magnetic field, said deadbolt magnetic sensor is rigidly attached to said strike plate in said door jamb, said deadbolt magnetic sensor is located or positioned so that said deadbolt magnetic sensor aligns with said deadbolt magnet when said sliding door is closed and said deadbolt is in said extended position, said deadbolt magnetic sensor is attached to or connected to: said power unit circuit board or said second microprocessor, integrated circuit, or chip so that there is electrical continuity therebetween, and when said deadbolt magnetic sensor detects said deadbolt magnet said deadbolt magnetic sensor sends an electrical signal or message to: said power unit circuit board, said second microprocessor, integrated circuit, or chip, or said external control unit stating that said sliding door is closed and said deadbolt is in said extended position.

* * * * *